US006167718B1

(12) United States Patent
Halimi et al.

(10) Patent No.: US 6,167,718 B1
(45) **Date of Patent: *Jan. 2, 2001**

(54) SELF-CARBONATING SELF-COOLING BEVERAGE CONTAINER

(76) Inventors: Edward M. Halimi, 546 B, San Ysidro Rd., Montecito, CA (US) 93108; W. Carl Gans, 601 Vereda Leyenda, Goleta, CA (US) 93117

( * ) Notice: Under 35 U.S.C. 154(b), the term of this patent shall be extended for 0 days.

This patent is subject to a terminal disclaimer.

(21) Appl. No.: 08/230,123

(22) Filed: Apr. 20, 1997

(51) Int. Cl.[7] ..... F25D 3/00
(52) U.S. Cl. ..... 62/293; 62/4; 126/263.04
(58) Field of Search ..... 62/294, 4; 126/263, 126/263.04, 263.05

(56) References Cited

U.S. PATENT DOCUMENTS 3,881,321 * 5/1975 Riley ..... 62/294
4,319,464 * 3/1982 Dodd ..... 62/294
4,669,273 * 6/1987 Fischer et al. ..... 62/294
5,394,703 * 3/1995 Anthony ..... 62/294

* cited by examiner

*Primary Examiner*—John M. Sollecito

(57) ABSTRACT

There is disclosed a self-cooling self-carbonating beverage container including a beverage container housing containing a liquid beverage, a coolant gas bottle inside said beverage container storing pressurized carbon dioxide, a tab located on an external portion of said beverage container housing and apparatus actuated by movement of said tab for opening said bottle to release said carbon dioxide into said liquid beverage.

129 Claims, 39 Drawing Sheets

SELF-CARBONATING SELF-COOLING BEVERAGE CONTAINER

BACKGROUND OF THE INVENTION

1. Technical Field

The present invention is related to self-cooling beverage containers.

2. Background of the Invention

Beverage containers such as stackable aluminum cans with a pop-open tab can are well-known in the art. Referring to FIG. 1A, a beverage can 90 containing a liquid beverage 95 has a thin aluminum shell 100 forming a cylindrical side wall 105 and a circular concave base 110. The shell 100 supports a circular top 115 having a generally flat surface 115*a*, a cylindrical vertical flange 120 at the periphery of the top 115 and a cowl 125 at the top of the flange 120 under which the top edge 105*a* of the cylindrical wall 105 supportingly nests. Several features of the can 90 of FIG. 1A enhance the structural strength of the can 90, including, for example, the concave shape of the base 110 as well as a circular bead 130 formed in the base 110, as is well-known in the art. A well-known technique for further enhancing the structural strength of the can 90 is pressurizing the interior of the can 90 to a pressure of about 30 psi.

A pull-up tab 140 includes a finger grip 142 extending outwardly in the plane of the top 115 from a downwardly curving engagement section 144 terminating in a flat tab base 146. A rivet 150 extending through the can top surface 115*a* fastens the pull-up tab 140 to the can top 115. A die-cut 155 in the can top surface 115*a* has a generally oval path (not shown in FIG. 1A) which does not interdict a bendable region 157 under the engagement section 144. As the finger grip 142 is pulled upwardly away from the can top 115, the seal around the rivet 150 breaks to release pressure from the can interior. As the finger grip 142 continues to be pulled upwardly, it begins to rotate the engagement section 144 about the rivet 150, forcing the engagement section 144 to impact the can top surface 115*a* and break the die cut 155 beginning at its far end 155*a*. Further upward force on the finger grip 142 causes the die cut 155 to separate along its entire oval path. This separates from the can top 115 an oval section 160 along the oval path of the die-cut 155, the oval section 160 being joined at the bendable region 157. The oval section 160 rotates downwardly about the bendable region 157 under the urging of the downwardly thrusting engagement section 144 until the oval section 160 hangs downwardly from the can top 115 at a nearly vertical angle.

An object of the present invention is to perform both cooling and carbonation of the beverage 95 inside the can 90 with the pulling of the finger grip 142.

SUMMARY OF THE DISCLOSURE

In a first embodiment of the invention, a self-cooling beverage container includes a beverage container housing including a side wall portion, a container base and container top having a breakable die-cut therein and a downwardly displaceable portion near the die-cut, a pull tab attached to the container top at a fastener connecting the pull tab and the container top, the pull tab having an engagement end which pushes on the downwardly displaceable portion of the container top to break the die-cut whenever an opposite end of the pull-tab is pulled away from the top, a coolant gas bottle inside the beverage container containing a coolant gas stored under pressure, the bottle having a bottle top with a breakable seal through which the coolant gas is released, a needle inside the beverage container having a sharp end facing the breakable seal of the bottle, a plunger inside the beverage container having a pair of ends, one end of the plunger coupled to the downwardly displaceable portion of the container top, the other end of the plunger being coupled to one of (a) the coolant gas bottle and (b) the needle whereby to force the needle and bottle toward one another to break the breakable seal of the bottle whenever the pull-tab opens the beverage container, and a bottle support inside the beverage container and connected to the beverage container, the bottle support holding the coolant gas bottle in a position relative to the needle and holding the plunger in a position relative to the bottle.

In a first version, the breakable seal of the coolant gas bottle faces the container top, and the needle facing the breakable seal is at one end of the plunger facing the breakable seal of the bottle whereby the plunger pushes the needle toward the bottle. In a second version, the breakable seal of the coolant gas bottle faces the container base, the needle facing the breakable seal is supported from the container base and faces the breakable seal, and the other end of the plunger pushes against the base of the coolant gas bottle whereby the plunger pushes the bottle toward the needle.

In the first version, the bottle support may include a ceiling grip by which the bottle support is fastened to the container top and a bottle holder by which the bottle support is fastened to the coolant gas bottle. In one implementation, the coolant gas bottle includes a bottle neck between the bottle top and a main body of the bottle, the bottle holder being fastened to the bottle neck. The ceiling grip is fastened to the bottle top by the fastener. The fastener includes a rivet coupled to the bottle holder, the rivet penetrating through the container top. The rivet is preferably an integral portion of the bottle holder. The bottle holder may include a leg extending from the ceiling grip toward the bottle top, the leg having an elongate passage axially aligned with the breakable seal and containing the plunger, and a skirt extending from the leg around the bottle neck. The bottle support further includes a truss member extending diagonally relative to the leg between the ceiling grip and the skirt. The bottle support further includes lateral supporters extending from the leg to the side wall portion of the beverage container. The bottle support further includes a base support coupled to an interior surface of the container base and to the base of the coolant gas bottle.

Preferably, a micro-porous diffuser is provided through which the coolant gases escape from the breakable seal into a beverage stored in the beverage container. The microporous diffuser layer may be adjacent the skirt through which the coolant gases escape from the bottle to a beverage stored in the beverage container. The microporous diffuser layer may be sandwiched between the skirt and the bottle-neck. Preferably, there are coolant gas passages through the skirt, which may include radial orifices in the skirt or axial grooves in the skirt.

In the second version, the bottle support includes a base grip fastened to the container base and a bottle holder coupled to the base grip and fastened to the coolant gas bottle near the bottle top, and a ceiling grip fastened to the container top and coupled to the bottle near a bottom portion thereof. The bottle holder being is coupled to the bottle neck. The ceiling grip is fastened to the bottle top by the fastener including a rivet penetrating through the container top, which may be an integral portion of the ceiling grip. Preferably, the ceiling grip includes a leg extending from the ceiling grip to a bottom portion of the bottle, the leg having an elongate passage containing the plunger, the plunger facing the bottom portion of the bottle. Preferably, the bottle support further includes a truss member extending diagonally relative to the leg between the ceiling grip and a portion of the leg near the bottle. A skirt may extend from the base grip and surrounding the bottle top, the bottle neck being axially moveable inside the skirt toward the needle.

The beverage may further include a vortex tube cooling device inside the beverage container having an inlet, a hot exhaust and a cold exhaust, apparatus for channeling coolant gas from the bottle to the inlet of the vortex tube cooling device, and apparatus for connecting the hot exhaust through the beverage container housing to an external port.

In a second embodiment, a self-cooling beverage container includes a beverage container housing including a side wall portion, a container base and container top having a breakable die-cut therein and a downwardly displaceable portion near the die-cut, a coolant gas bottle inside the beverage container containing a coolant gas stored under pressure, the bottle having a bottle top with a breakable seal through which the coolant gas is released, a needle inside the beverage container having a sharp end facing the breakable seal of the bottle, a threaded plunger inside the beverage container having a pair of ends, one end of the plunger coupled to the downwardly displaceable portion of the container top, the other end of the plunger being coupled to one of (a) the coolant gas bottle and (b) the needle whereby to force the needle and bottle toward one another to break the breakable seal of the bottle whenever the pull-tab opens the beverage container, a bottle support inside the beverage container and connected to the beverage container, the bottle support holding the coolant gas bottle in a position relative to the needle and having a female portion threadably engaged with the plunger and holding the plunger in a position relative to the bottle, and apparatus for axially rotating the plunger relative to the female portion so as drive the plunger.

In a third embodiment, a self-cooling self-carbonating beverage container includes a beverage container housing containing a liquid beverage, a coolant gas bottle inside the beverage container storing pressurized carbon dioxide, a tab located on an external portion of the beverage container housing, and apparatus actuated by movement of the tab for opening the bottle to release the carbon dioxide into the liquid beverage. Preferably, the coolant gas bottle has a breakable seal, the apparatus for opening the bottle including a needle inside the container facing the breakable seal, a plunger having an actuator end facing one of: (a) the needle, (b) the bottle for pushing the needle and bottle together to break the breakable seal, a linearly compressed spring having a stationary end and an opposite end coupled to the plunger, apparatus for restraining the spring, and linkage between the tab and the apparatus for restraining for disengaging the spring from the apparatus for restraining upon movement of the tab.

In a fourth embodiment, a self-cooling beverage container includes a beverage container housing including a side wall portion, a container base and a container top, a storage gas held inside the beverage container under a pressure sufficient to elastically deform the container top outwardly in a direction away from the interior of the beverage container, whereby the container top elastically relaxes upon release of the pressure of the storage gas so that the container top moves inwardly toward the interior of the beverage container upon the release of the storage gas pressure, a coolant gas bottle or plural coolant gas bottles inside the beverage container containing a coolant gas stored under pressure, the bottle having a bottle top with a breakable seal through which the coolant gas is released, a needle inside the beverage container having a sharp end facing the breakable seal of the bottle, a plunger inside the beverage container having a pair of ends, one end of the plunger coupled to the container top, the other end of the plunger being coupled to one of (a) the coolant gas bottle and (b) the needle whereby to force the needle and bottle toward one another to break the breakable seal of the bottle whenever the pull-tab opens the beverage container, a bottle support inside the beverage container and connected to the beverage container, the bottle support holding the coolant gas bottle in a position relative to the needle and holding the plunger in a position relative to the bottle, and apparatus for opening the beverage container so that elastic relaxation of the container top pushes the plunger to drive the needle into the breakable seal of the coolant gas bottle. In a first version of this embodiment, the bottle support is coupled to the side wall portion so as to leave the container top free to deform. In a second version, the bottle support is a stand coupling the bottom of the bottle to the bottom floor of the container.

Preferably, the container top is circular in shape and includes an elastic annulus which enhances the deformation of the container top. In a preferred mode, the elastic annulus includes plural concentric ridges, alternate ones of the ridges facing toward the beverage container interior and remaining ones facing away from the beverage container interior. The plural concentric ridges include an outer ridge in the container top facing toward the beverage container interior, an intermediate ridge in the container top facing away from the beverage container interior, and an inner ridge in the container top facing toward the beverage container interior.

In another preferred mode, an elongate passage containing the plunger has ratcheting teeth facing the plunger, the plunger has ratcheting teeth engaging the ratcheting teeth of the elongate passage, whereby the plunger is movable in a direction toward the beverage container interior and is locked from movement in the opposite direction. The ratcheting teeth of the elongate passage each includes an annular ridge extending radially outward toward the plunger, the annular ridge being interrupted by at least an axial circumferential groove extending longitudinally along the elongate passage. Preferably, the ratcheting teeth of the plunger each including an annular ridge extending radially outward toward an interior surface of the elongate passage and having at least an axial circumferential groove extending longitudinally along the plunger, the ratcheting teeth of the elongate passage and of the plunger nesting in the groove of the other so as to disengage in one rotational position of the plunger.

DETAILED DESCRIPTION OF THE PREFERRED EMBODIMENTS

Figure 1A:
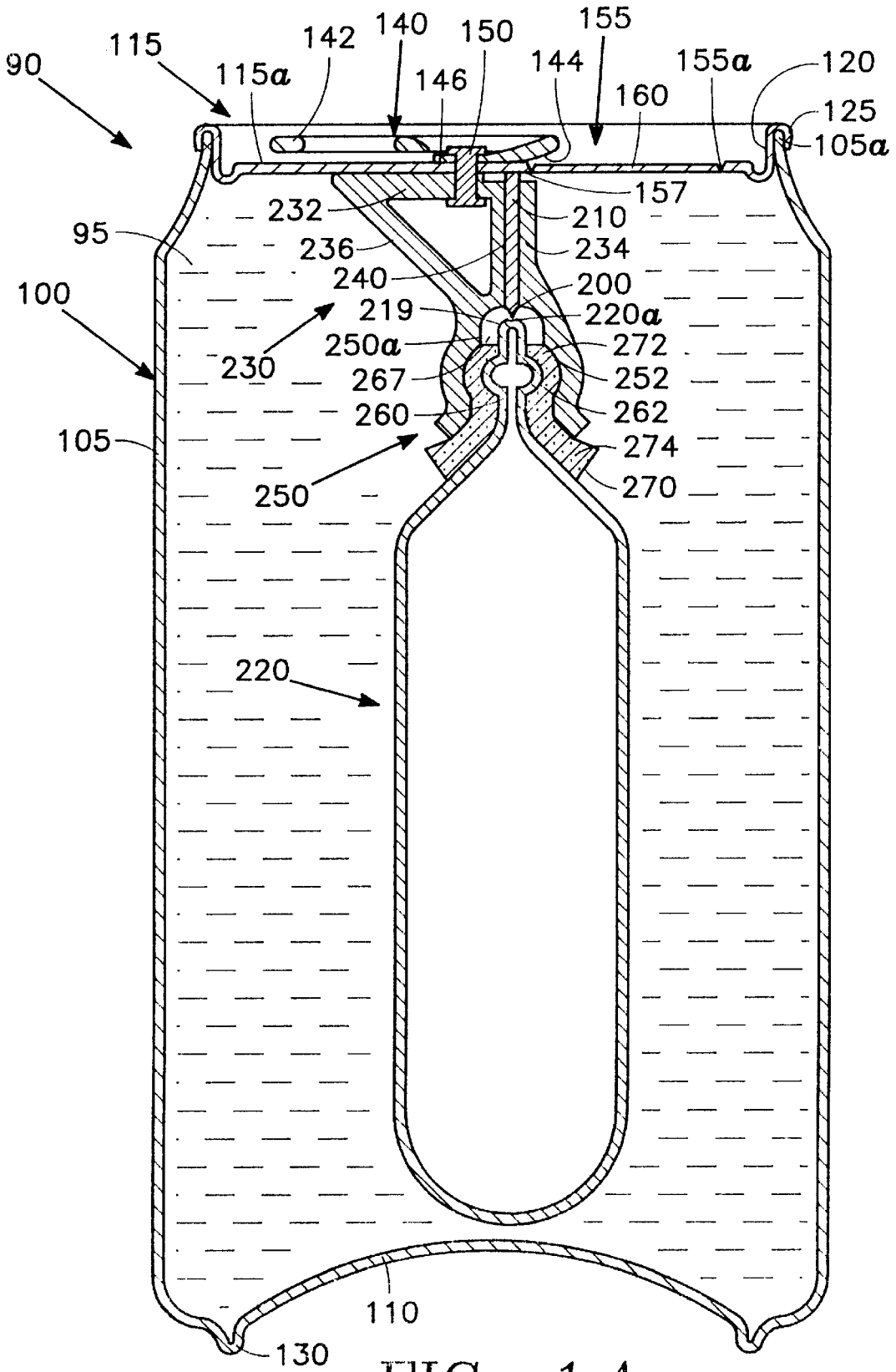
FIG. 1A is a cut-away cross-sectional view of a first embodiment of the invention in which a coolant gas bottle puncture needle is driven through a coolant gas bottle support inside the beverage can by the pull-up finger tab.

Referring to FIG. 1A, simultaneous self-carbonation and self-cooling initiated by the pull-tab 140 is accomplished by the engagement section 144 of the pull-tab 140 driving a sharp needle end 200 of a plunger 210 into the top 219 of a coolant gas bottle 220 held inside the beverage can 90. In a preferred embodiment, the coolant gas bottle 220 is a standard pressurized carbon dioxide-containing steel bottle, in which the bottle top 219 has a relatively thin breakable seal facing the needle end 200. The carbon dioxide gas released from the bottle 220 is ideal for carbonating the beverage 95. The coolant gas bottle 220 is fixedly held in the position illustrated in FIG. 1A by a support 230 having a horizontal support top 232, a vertical post 234 and a diagonal truss leg 236. The rivet 150 extends through the can top 115 and through the support top 232 to hold the support 230 to the bottom surface of the can top 115. An open cylinder 240 extending vertically downward through the vertical post 234 holds the plunger 210 directly beneath a portion of the pull-tab engagement section 144 adjacent the rivet 150, there being a slight difference between the diameters of the cylinder 240 and plunger 210 to allow axial movement of the plunger 210 inside the cylinder 240. A bottle-holding skirt 250 extends downward from the support 230 and fixedly captures the neck 260 of the coolant gas bottle 220 so as to rigidly support the bottle. In the embodiment of FIG. 1A, the skirt 250 and the bottle neck 260 are press-fit together: the bottle neck 260 has a concave annular ridge 262 extending toward the skirt 250 while the skirt 250 has a convex annular land 252 facing the ridge 262 and matching the curvature of the ridge 262.

In the embodiment of FIG. 1A, it is preferable, but not necessarily required, to provide a diffuser 270 in the interface between the skirt 250 and the bottle neck 260. As shown in FIG. 1A, the inside diameter of the skirt 250 is larger than the outside diameter of the bottle neck 260 by an amount equal to the compressed thickness of the diffuser 270. Preferably, the diffuser 270 is a layer of micro-porous material of the type which is commercially available and is typically formed of plastic material having microscopic pores therethrough. Such a material is sold by Porex Technologies of Fairburn, Ga., USA under the registered trademark "POREX". An upper portion 272 of the diffuser 270 is pressed between the skirt 250 and the bottle neck 260 while a lower portion 274 of the diffuser 270 extends downwardly from the skirt. Coolant gas escaping from the bottle 220 is forced under pressure into the upper diffuser portion 272 and escapes into the beverage 95 through the lower diffuser portion 274. The diffuser 270 regulates the coolant gas flow into the beverage 95 to prevent dispersing the beverage through the opening in the can top 115. The upper portion 250*a* of the skirt 250 surrounds a cavity 267 into which coolant gas from the bottle 220 escapes before entering the diffuser 270.

Figure 1B:
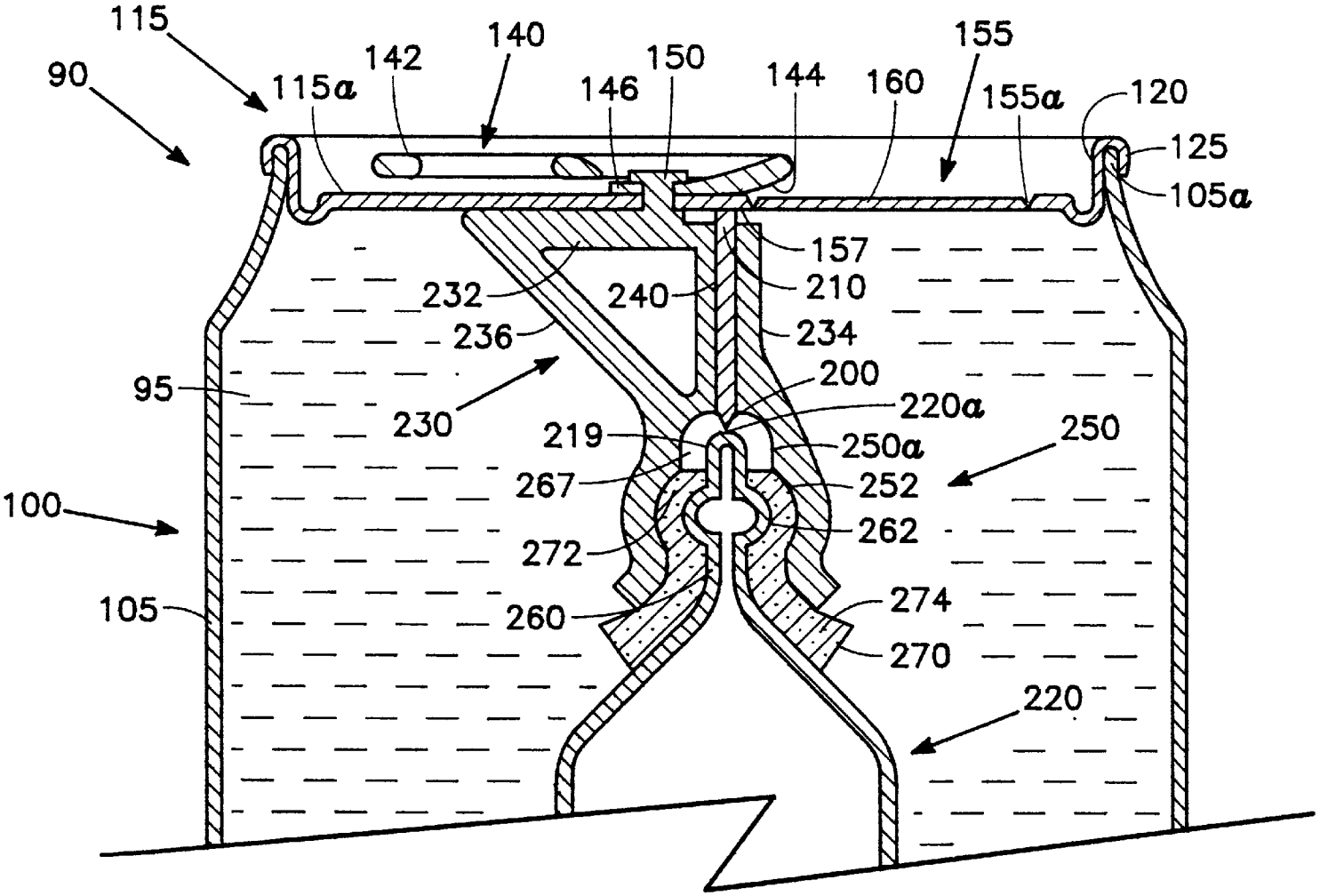
FIG. 1B is a cut-away cross-sectional view of the presently preferred embodiment of the invention having a rivet integrally formed in the coolant gas bottle support.

Referring to FIG. 1B, the rivet 150 is preferably integrally formed with the support top 232 and extends through the can top 115.

Figure 1C:
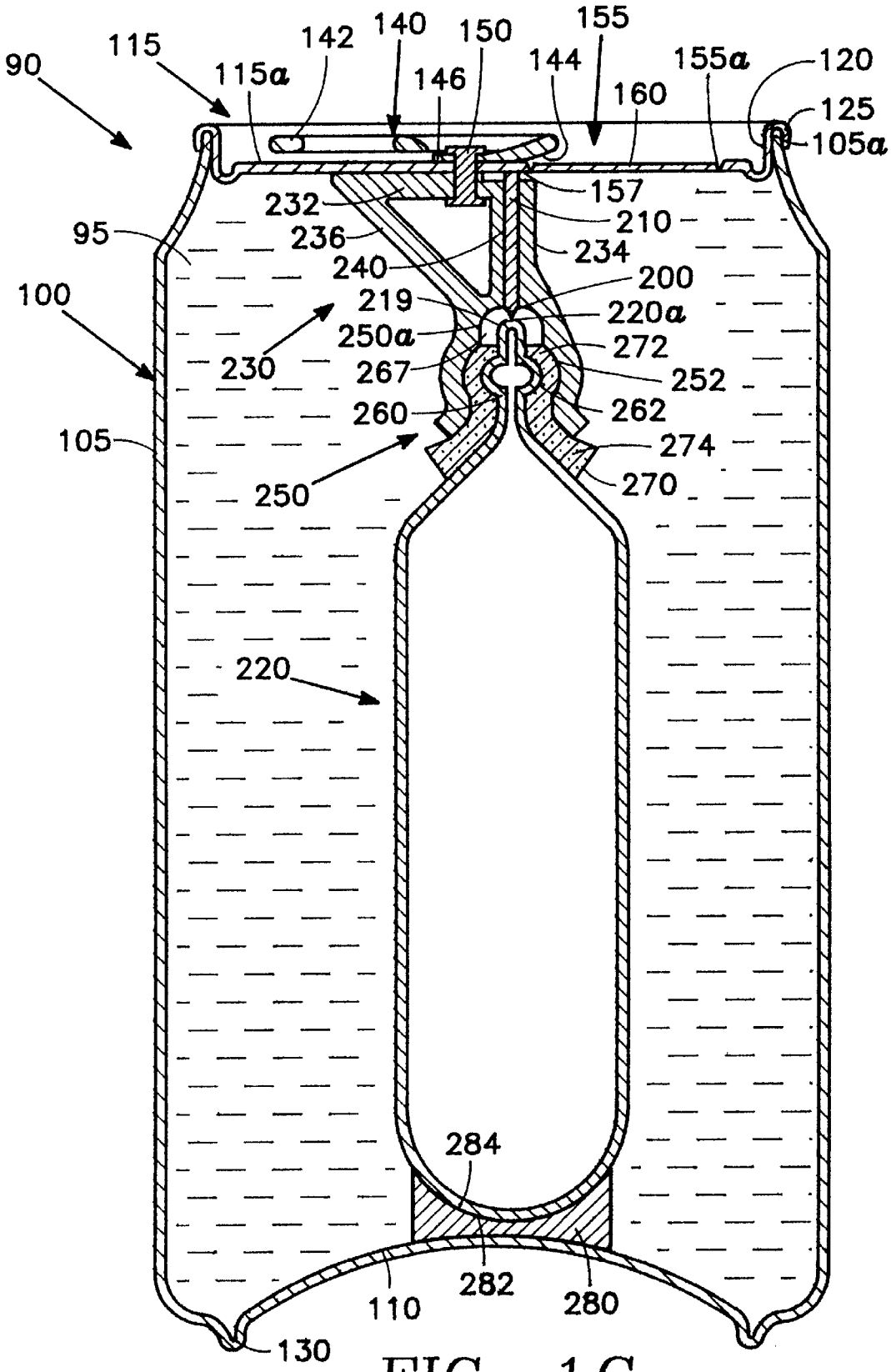
FIG. 1C is a cut-away cross-sectional view of a variation of the embodiment of FIG. 1A having a coolant gas bottle support at the bottom of the beverage can.
Figure 1D:
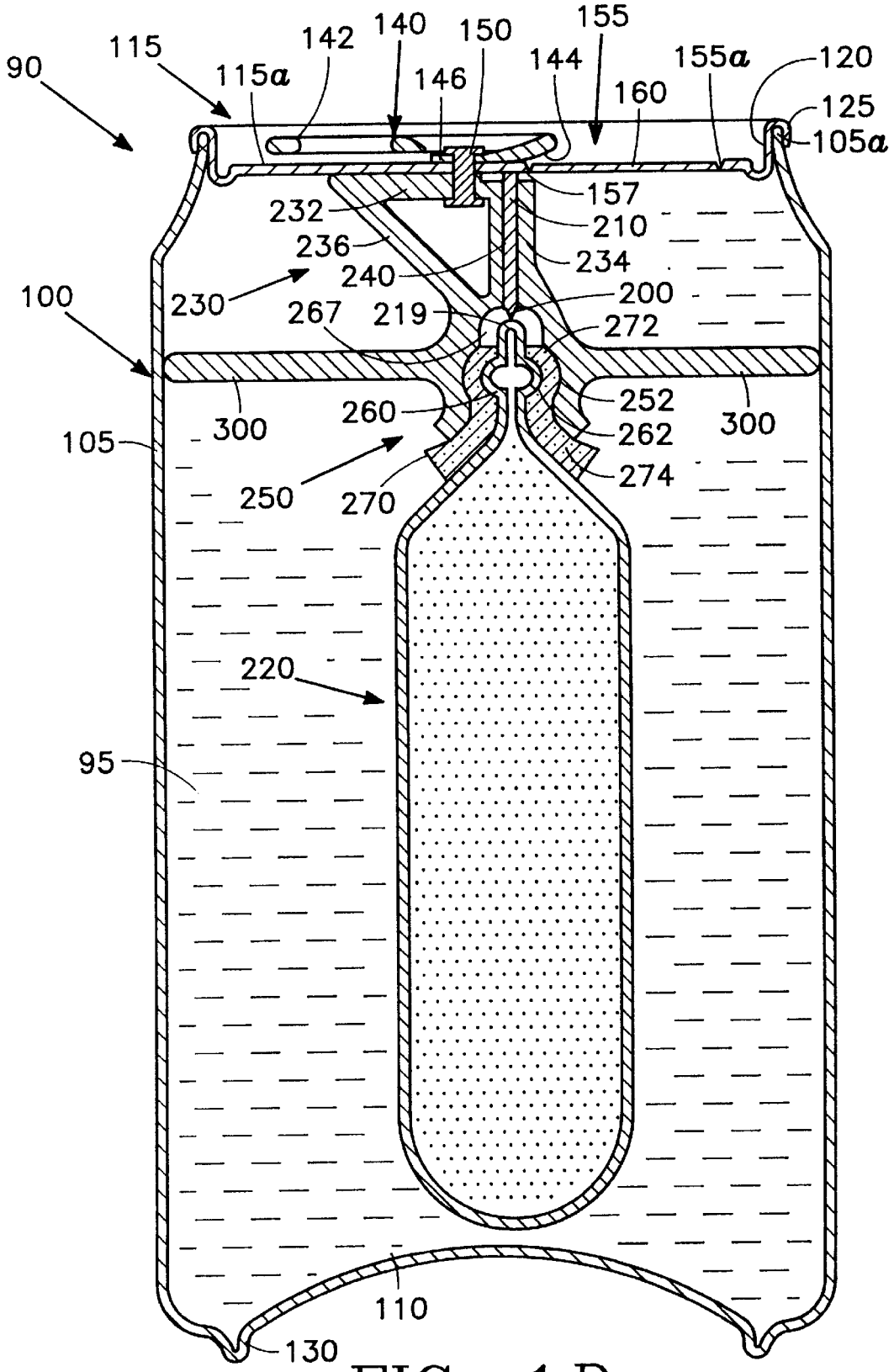
FIG. 1D is a cut-away cross-sectional view of another variation of the embodiment of FIG. 1A having lateral coolant gas bottle supports.
Figure 1E:
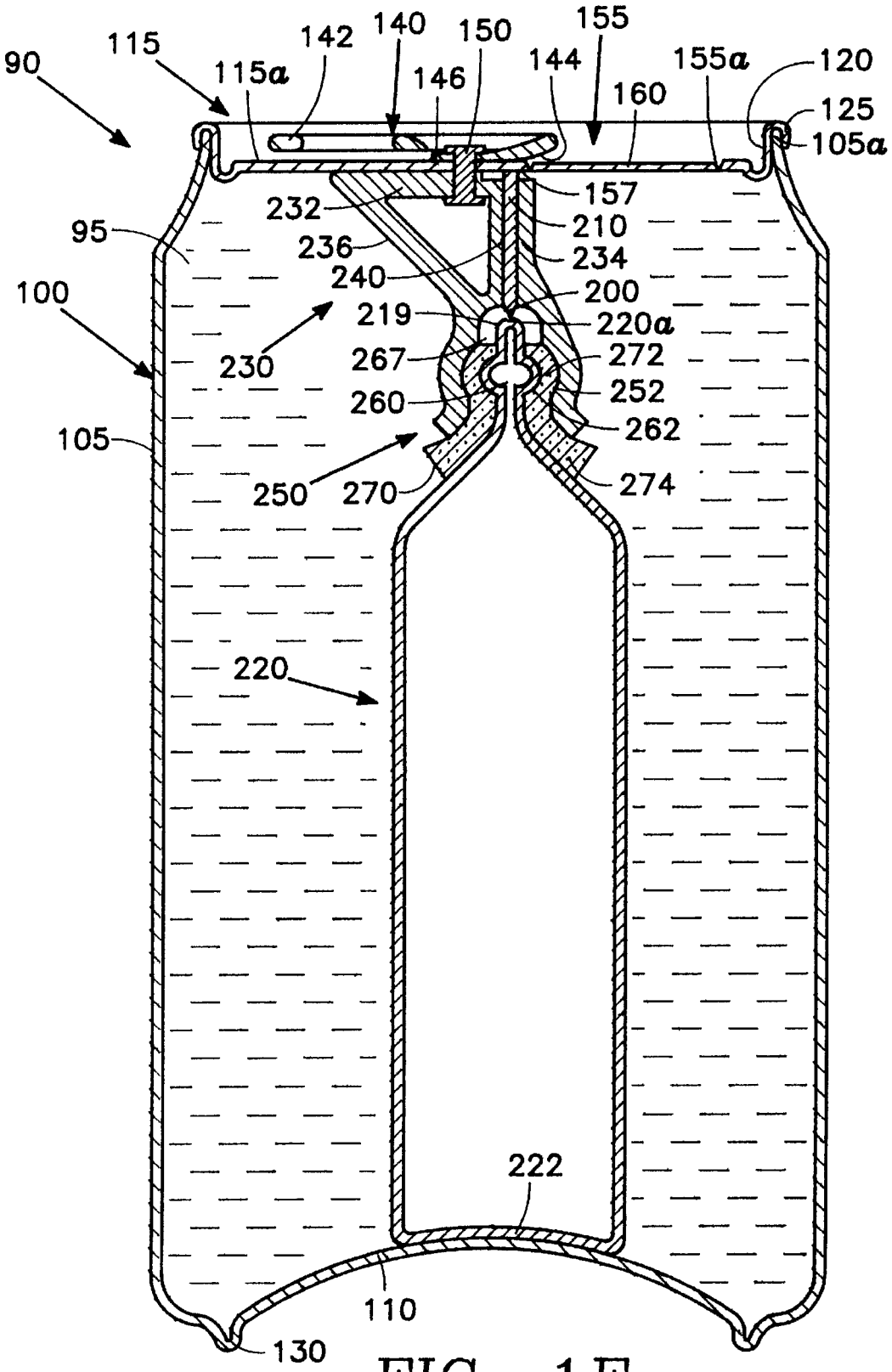
FIG. 1E is a cut-away cross-sectional view of another variation of the embodiment of FIG. 1A in which the coolant gas bottle bottom conforms with and rests on the beverage can bottom.

In an alternative embodiment illustrated in FIG. 1C, a base 280 attached to the interior surface of the can bottom 110 has a concave upper surface 282 engaging the bottom 284 of the coolant gas bottle 220. The concave base upper surface 282 conforms with the shape (e.g., hemispherical) of the coolant gas bottle bottom 284 so that they firmly nest, providing lateral support for the coolant gas bottle 220. In the alternative embodiment of FIG. 1D, at least three symmetrically disposed horizontal struts 300 extending radially from the skirt 250 to the can sides 105 provide lateral support for the coolant gas bottle 220. In the alternative embodiment of FIG. 1E, the coolant gas bottle 220 has a bottom surface 222 which conforms with and nests with the convex shape (e.g., partial hemispherical shape) of the interior surface of the beverage can bottom 110, to provide lateral support to the coolant gas bottle 220.

Figure 1F:
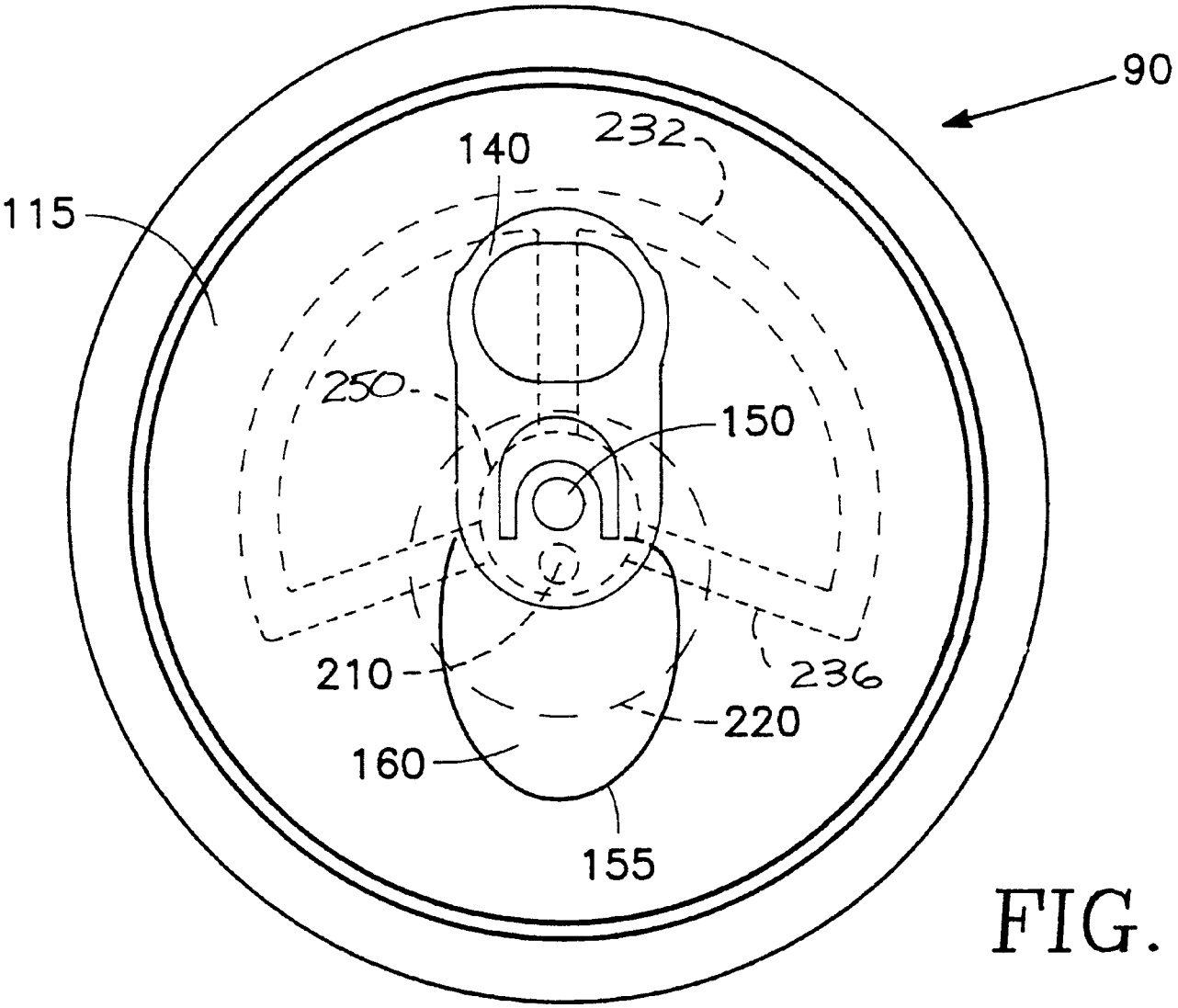
FIG. 1F is a top view of the beverage can of FIG. 1A.

Referring to FIG. 1F, the support top 232 is an annulus and there are three symmetrically disposed truss legs 236 extending diagonally downward from the annular support top 232 to the skirt 250.

Figure 2A:
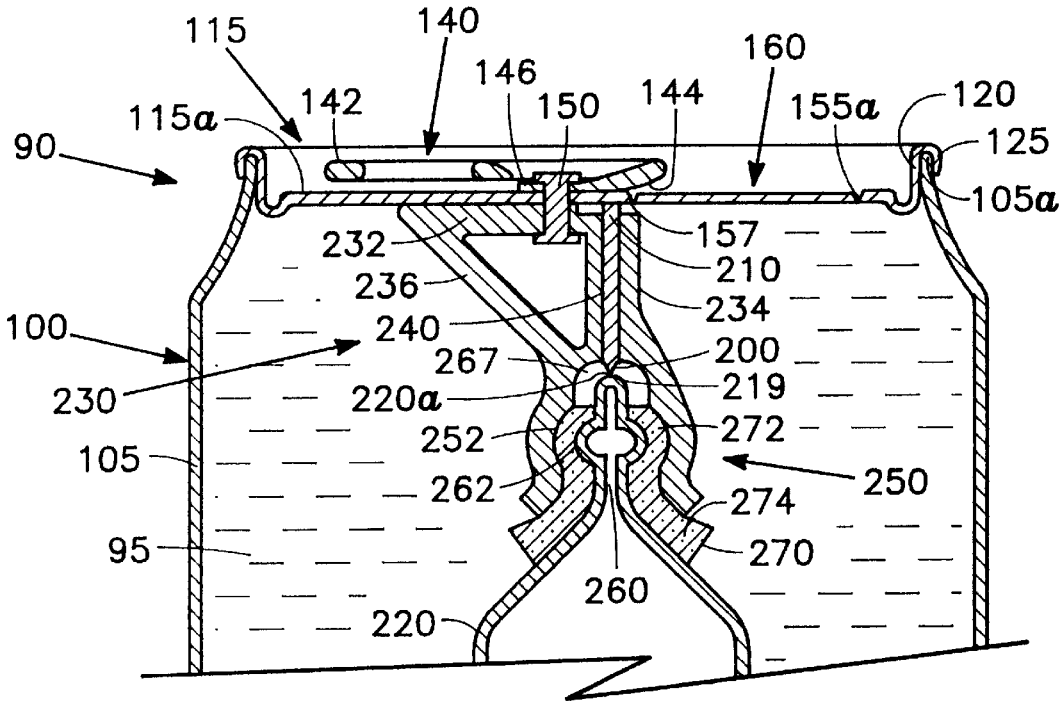
FIGS. 2A through 2F are a sequence of drawings illustrating the operation of the embodiment of FIG. 1A.
Figure 2B:
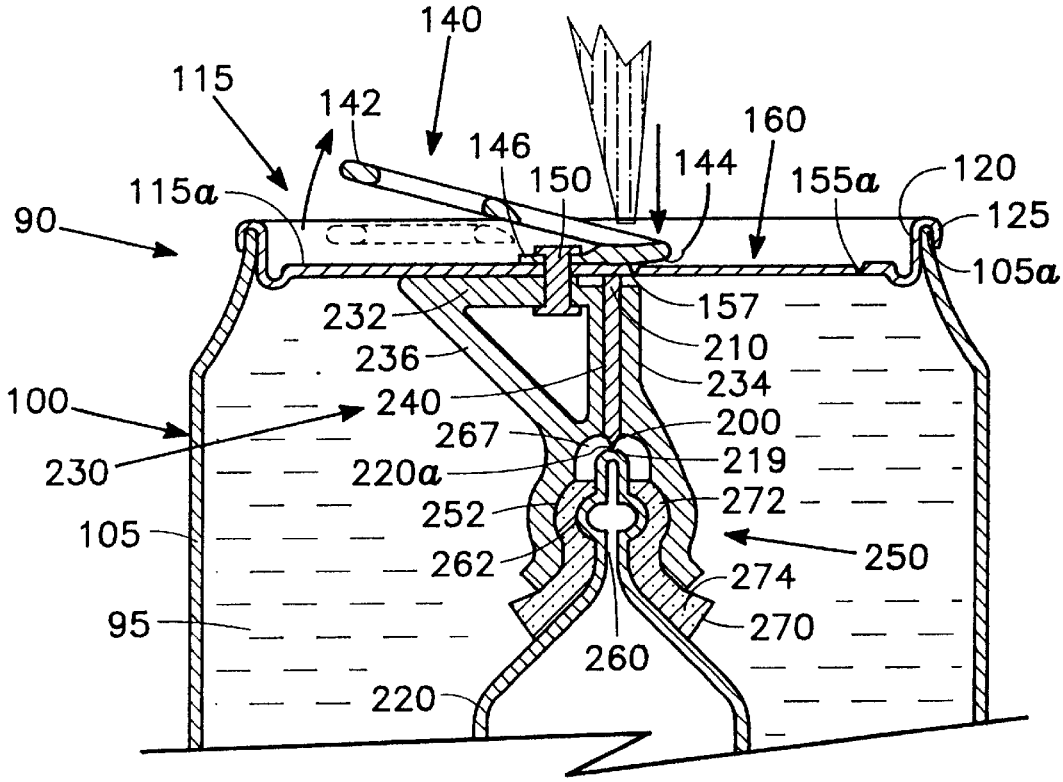
Figure 2C:
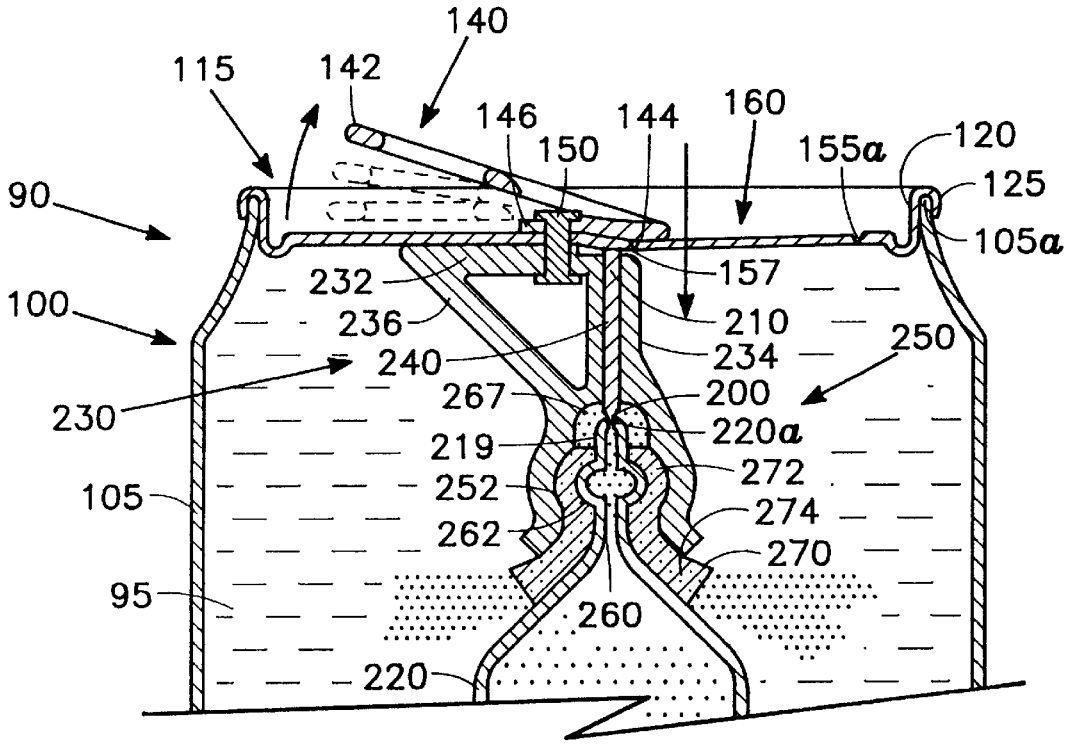
Figure 2D:
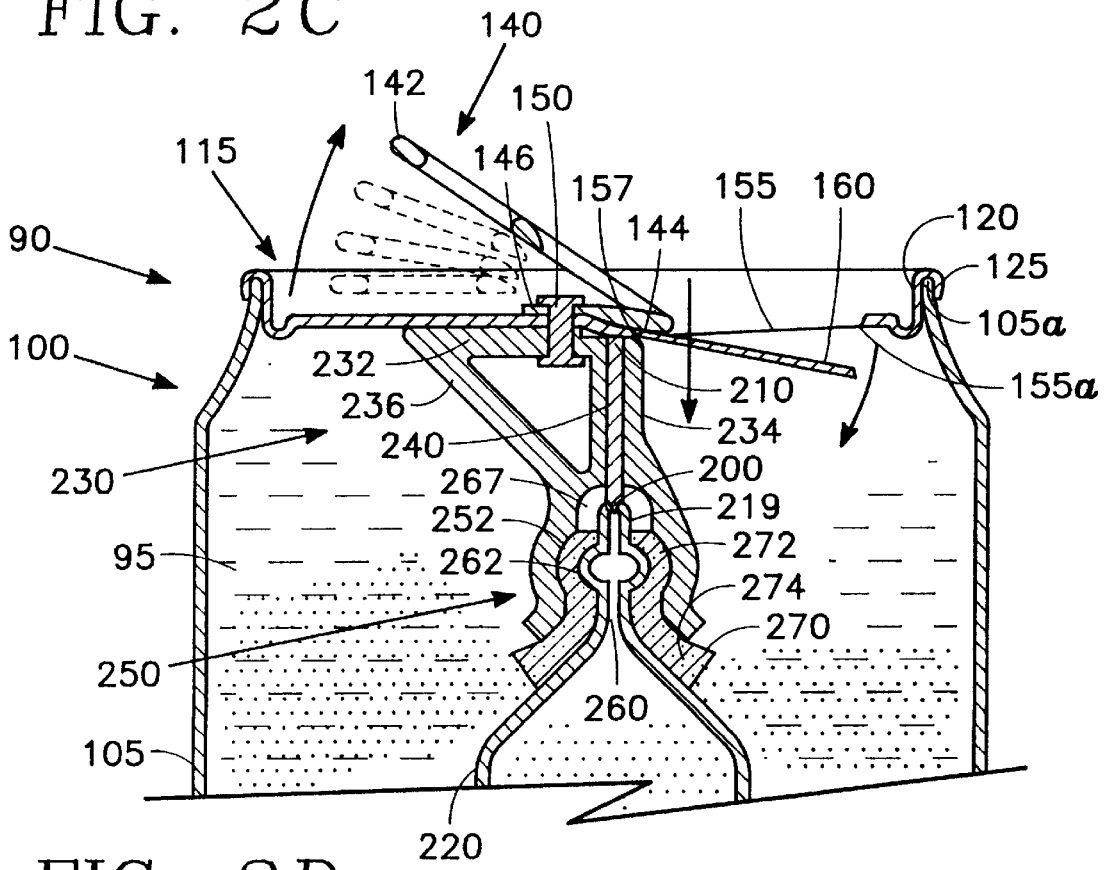
Figure 2E:
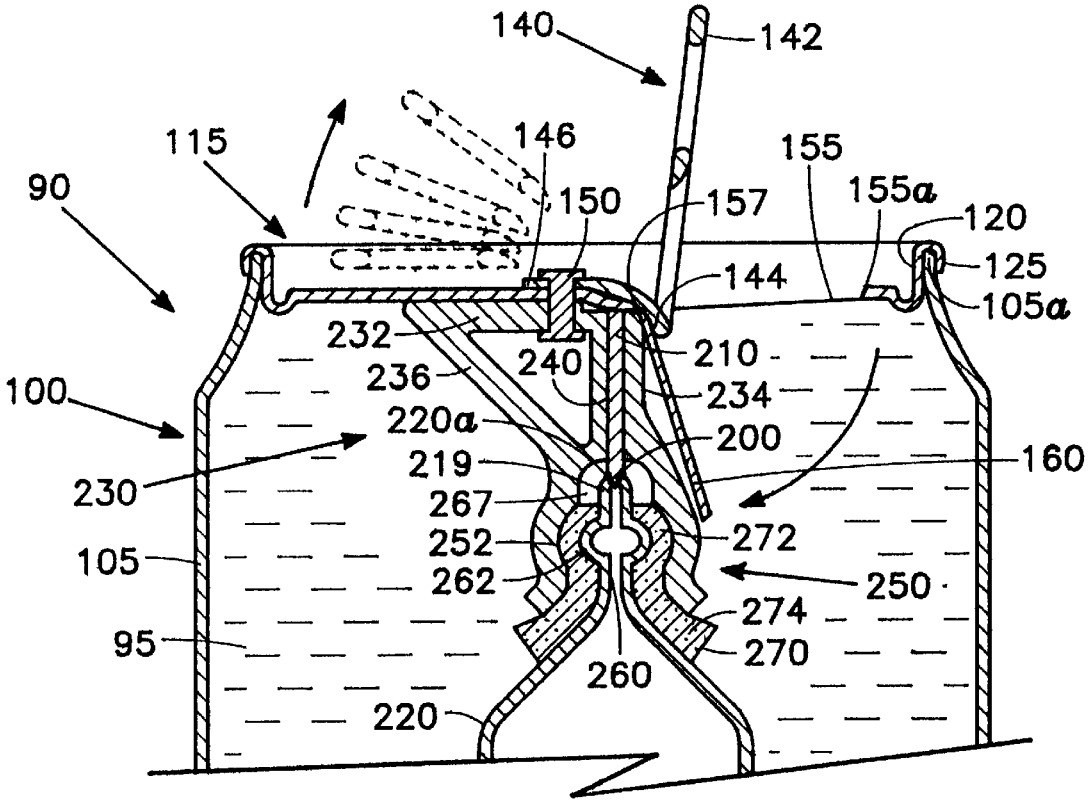
Figure 2F:
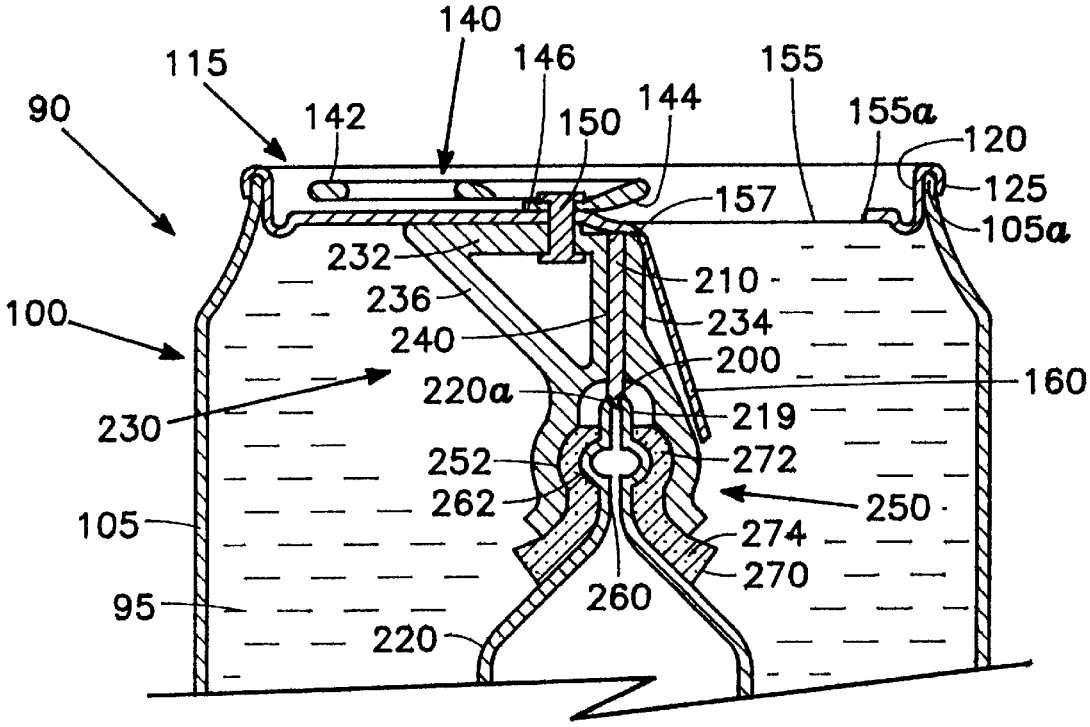

In order to thoroughly disclose the relationship between the location of the top of the plunger 210 and the location and shape of the pull-tab engagement section 144, FIGS. 2A through 2F are a chronological sequence of enlarged views corresponding to FIG. 1A illustrating the operation of the embodiment of FIG. 1A. As shown in FIG. 2A, at the beginning of the sequence, the pull-tab 140 has not been disturbed from its horizontal orientation. Then, as shown in FIG. 2B, as the pull-tab 140 is first pulled up, the stress near the rivet 150 breaks the seal around the top of the rivet 150, allowing some of the gas (with which the beverage can 90 was originally pressurized to 130 PSI) to escape from the can interior. As the tab 140 continues to be pulled upwardly, it rotates about the rivet so that, as shown in FIG. 2C, the engagement section 144 pushes the bendable region downward, deforming it and pushing the plunger 210 downward so that the needle end 200 contacts the top 219 of the coolant gas bottle 220. This begins to break the seal 220*a* at the coolant bottle top 219, so that some of the coolant gas is released from the bottle 220 through the diffuser 270 and into the beverage 95. In FIG. 2D, continued motion of the pull tab 140 increases the stress induced by the engagement section 144 on the can top 115 so that the die-cut 155 breaks, beginning at its distal section 155*a* and continuing along its entire oval path up to its terminus at the bendable region 157 of the can top 115. This releases the remaining pressurization gas from the can interior through the opening formed along the die-cut 155. Simultaneously, as shown in FIG. 2D, the increasing stress on the can top 115 induced by the motion of the engagement section 144 further depresses the bendable region 157 onto the plunger 210 so that the needle end 200 is driven completely through the seal 220*a* of the coolant gas bottle 220, thereby releasing the remainder of the coolant gas through the diffuser and into the beverage 95. In FIG. 2E the pull-tab has been pulled up completely, so that the oval section 160 is completely removed from the opening in the can top 115. In FIG. 2F, the pull-tab 140 has been returned to its original horizontal position, and the can 90 is now ready for the user to drink the beverage 95 therefrom.

Figure 3:
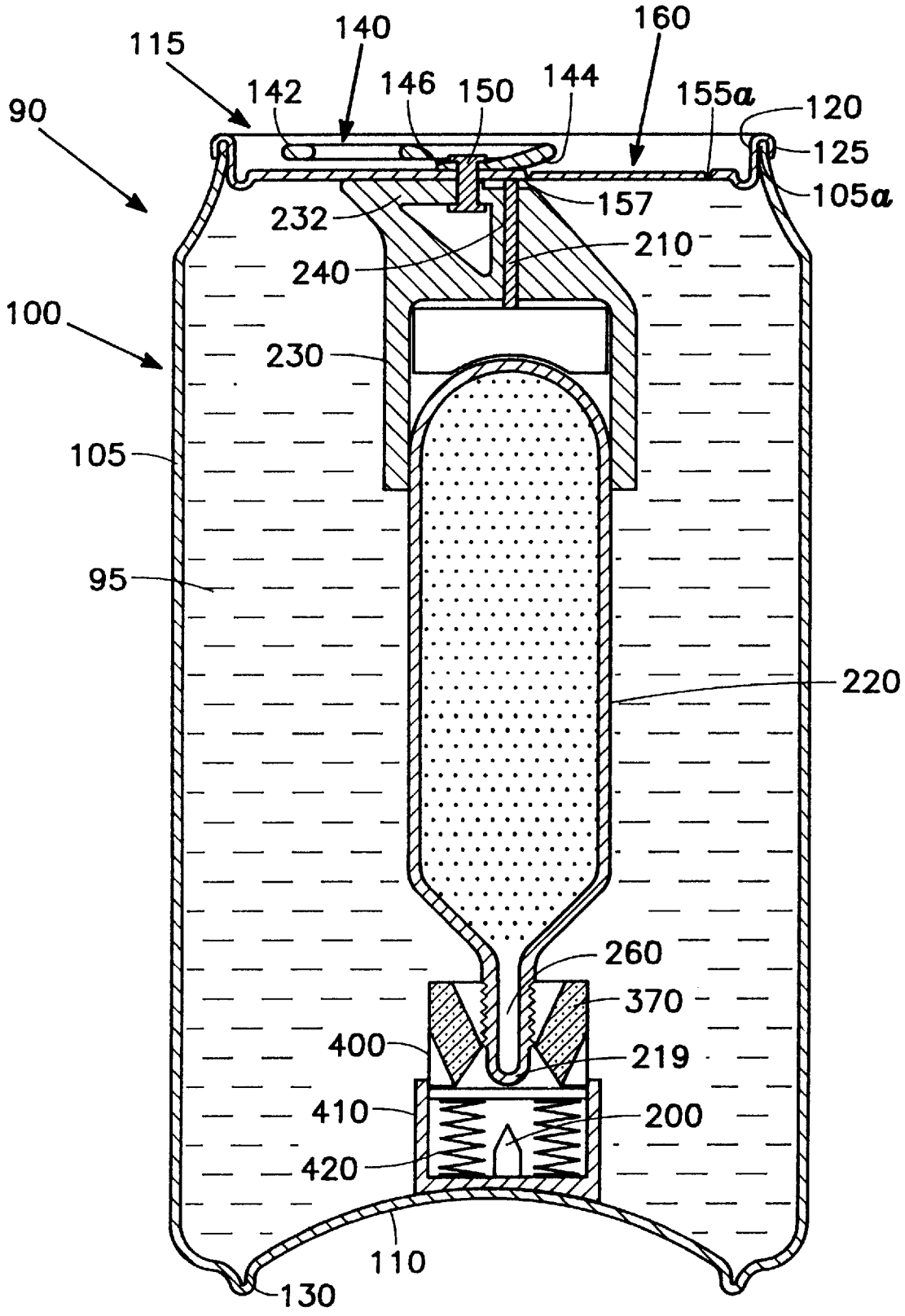
FIG. 3 is a cut-away cross-sectional view illustrating another variation of the embodiment of FIG. 1A in which the top of the coolant gas bottle faces the bottom of the beverage can (i.e., upside down).

In the embodiment of FIG. 3, the pull-tab 140 is used to drive the needle end 200 into the coolant gas bottle top 219 as in FIG. 1A, the difference being that both the needle end 200 and the bottle top 219 are at the bottom of the can 90 and what is moved by the plunger 210 is the bottle 220 itself, the needle end 200 being stationary at the can bottom. Thus, in FIG. 3 the coolant gas bottle 220 is upside down inside the beverage can 90. In the embodiment of FIG. 3, the plunger 210 drives the back end of the bottle 220 so that the bottle neck 260 is driven toward the stationary needle 200 at the bottom of the can 90. The bottle neck 260 held in a piston 400 containing an annular diffuser 370, the piston 400 being held inside a cylinder 410 at the bottom of which the needle 200 is mounted facing the bottle 220. In order to prevent the bottle 220 from being inadvertently opened by the needle, the friction fit of the piston 400 inside the cylinder 410 is relatively tight and a spring 420 compressed between the piston 400 and the floor of the cylinder 410 provides a threshold force against downward movement of the bottle 220.

Figure 5:
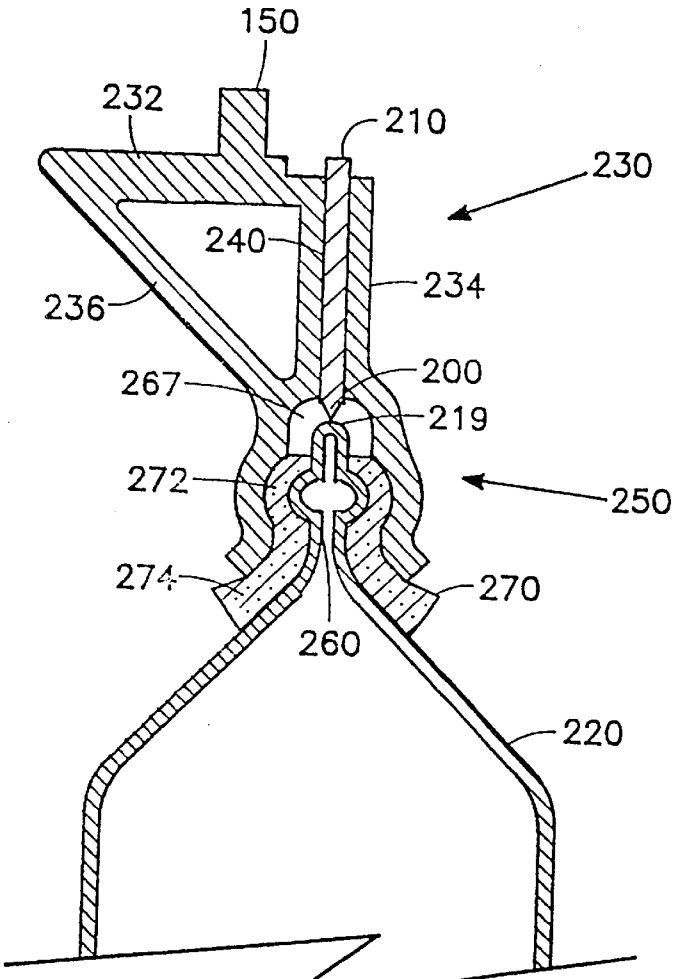
FIG. 5 is a cut-away cross-sectional view corresponding to FIG. 4 showing how the coolant gas bottle is press-fit to the bottle support.
Figure 4:
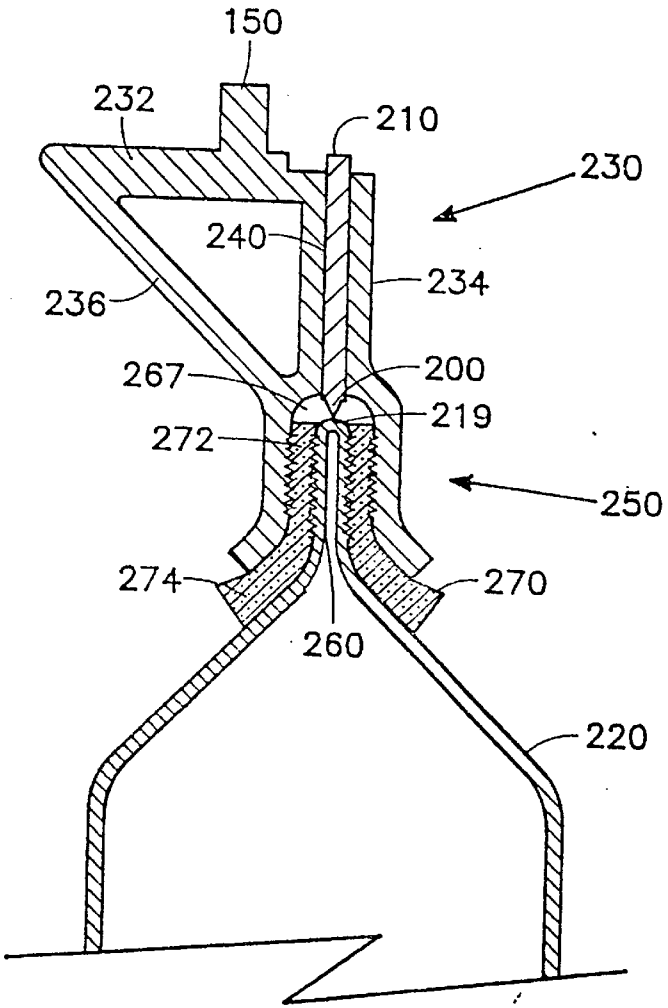
FIG. 4 is a cut-away cross-sectional view of a portion of the embodiment of FIG. 1A showing how the coolant gas bottle therein can be threaded to the bottle support.

FIG. 4 illustrates an alternative embodiment in which the coolant gas bottle 220 is threadably engaged to the support 230. FIG. 5 is an enlarged view of the preferred embodiment of FIG. 1B better illustrating how the coolant gas bottle is press fit inside the skirt 250.

Figure 6B:
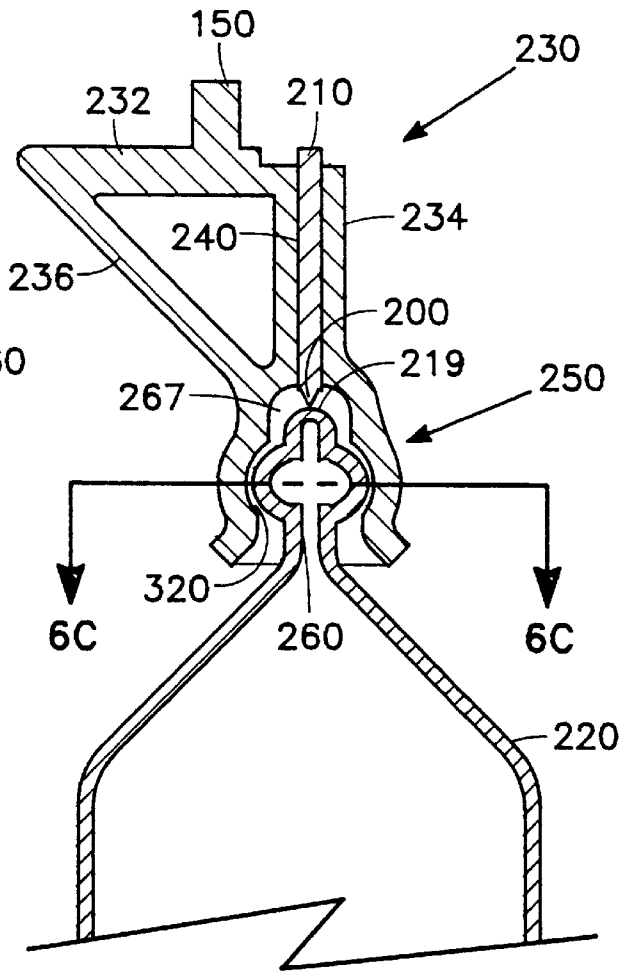
FIG. 6B illustrates a variation in which coolant gas from the coolant gas bottle enters the beverage through lands formed axially through the bottle support.
Figure 6C:
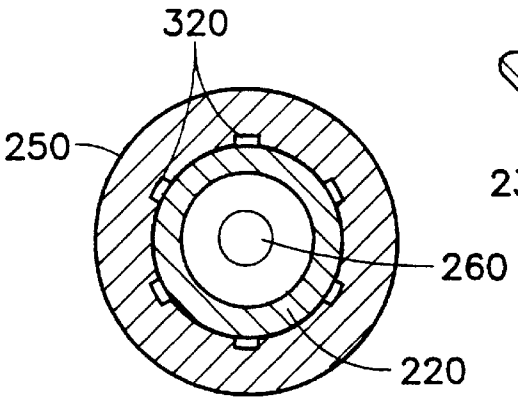
FIG. 6C is a top cross-sectional view corresponding to FIG. 6B and showing the axial lands.
Figure 6A:
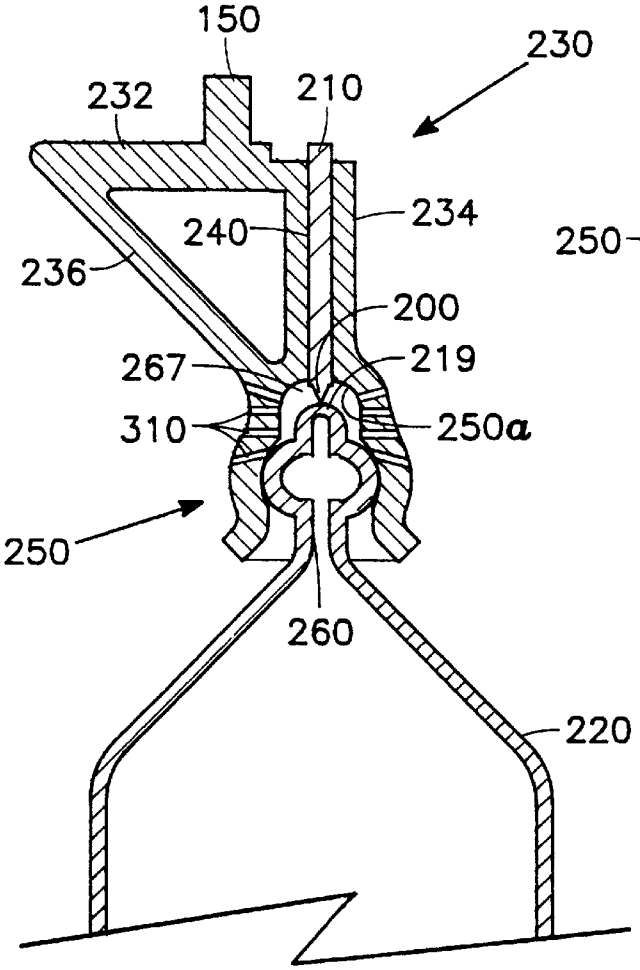
FIG. 6A illustrates a variation in which coolant gas from the coolant gas bottle enters the beverage through radial orifices through the bottle support.

FIG. 6A illustrates how the diffuser 270 can be eliminated by providing radial (horizontally extending) diffusion orifices through the upper skirt portion 250*a* surrounding the cavity 267. FIGS. 6B and 6C illustrate another way that the diffuser 270 can be eliminated by providing axial (vertically extending) lands 320 in the inner surface of the skirt 250 facing the bottle neck 260.

Figure 7A:
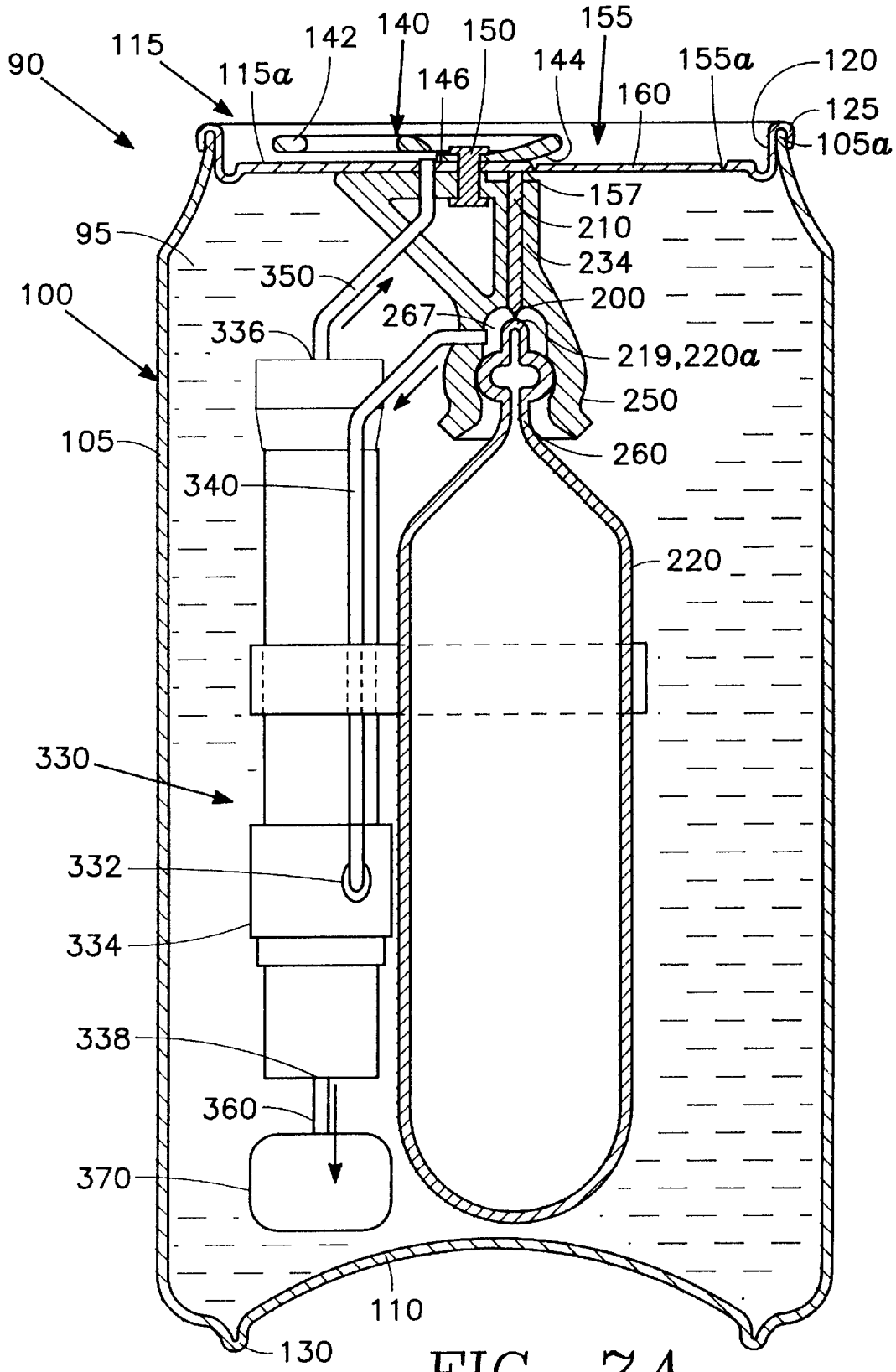
FIG. 7A is a cut-away cross-sectional view illustrating an embodiment of the invention having a vortex tube enhancing cooling of the gases from the bottle, with beverage carbonation through a diffuser.
Figure 7B:
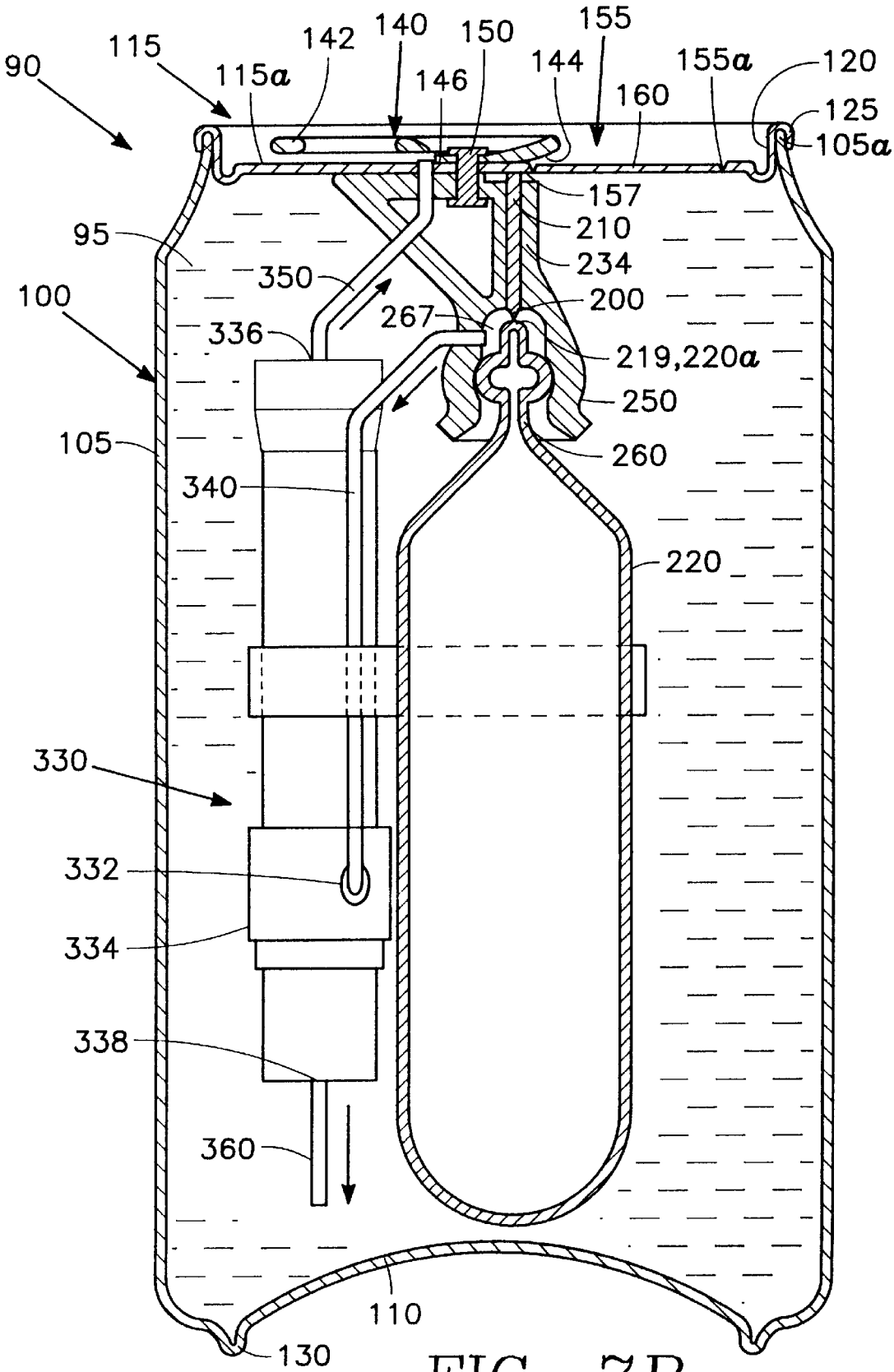
FIG. 7B is a cut-away cross-sectional view illustrating an embodiment corresponding to FIG. 7A in which coolant gas diffusion is through an outlet tube.
Figure 7C:
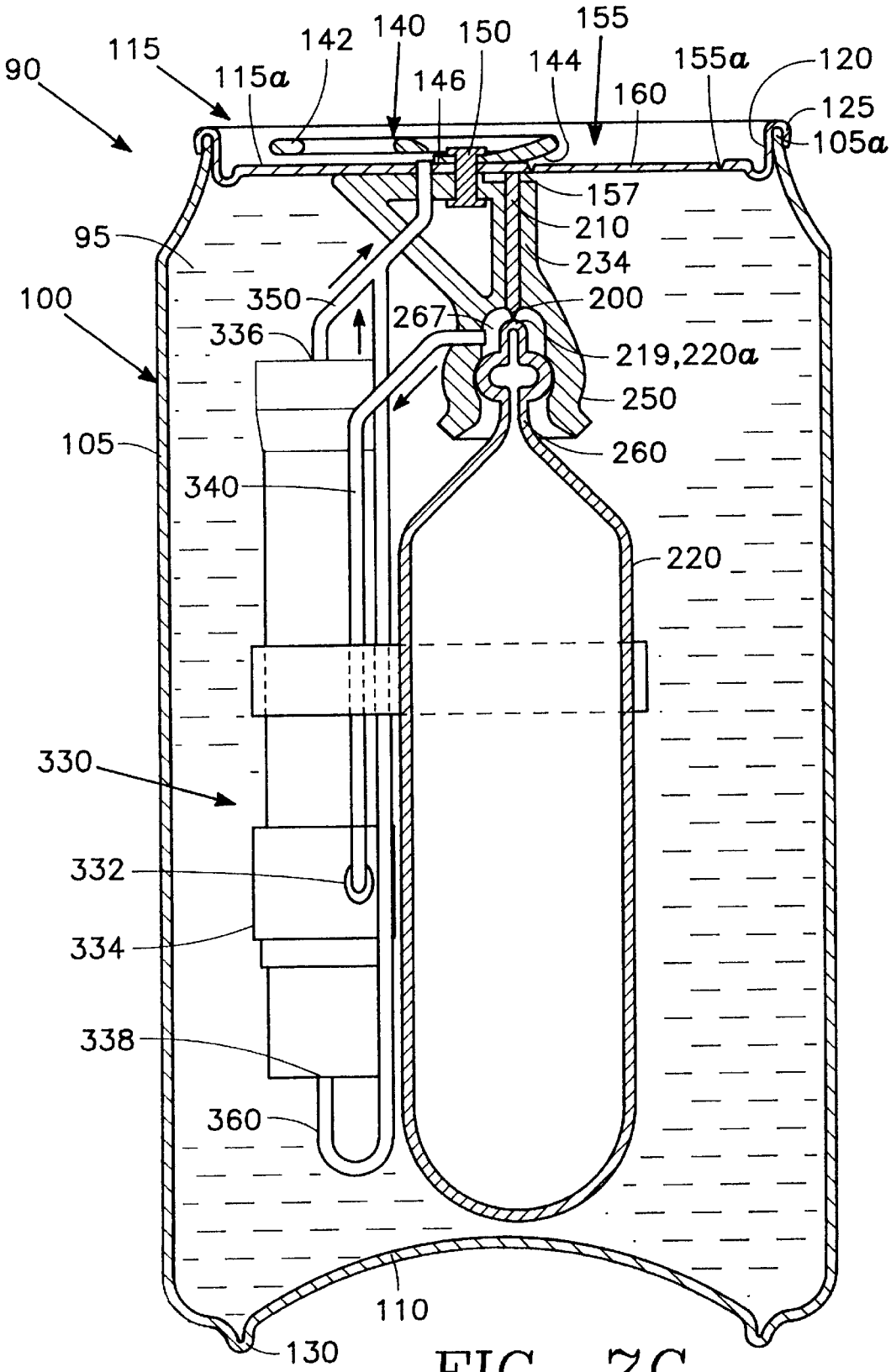
FIG. 7C is a cut-away cross-sectional view illustrating an embodiment corresponding to FIG. 7A in which all gases exhaust to the exterior of the can.

FIG. 7A illustrates a modification of the embodiment of FIG. 1A employing a vortex tube device 330 of the type manufactured by Vortec Corporation. The vortex tube device 330 has an inlet port 332 for receiving pressurized gas, a vortex tube section 334 through which heated gases migrate toward the vortex tube periphery to escape through a top heating outlet 336 while cooled gases fall through the middle of the vortex tube section 334 to escape through a lower cooling outlet 338. Pressurized gas from the coolant gas bottle 220 escapes from the cavity 267 through a gas line 340 to the vortex tube inlet 332. Heated gases from the vortex tube heating outlet 336 escape through a gas line 350 through the can top 115 to the outside. Cooled gases escape from the vortex tube cooling outlet 338 through a gas line 360 to a diffuser 370 and thence into the beverage 95. FIG. 7B illustrates a variation of the embodiment of FIG. 7A in which the diffuser 370 is eliminated. FIG. 7C illustrates a variation of the embodiment of FIG. 7A in which the tube 360 from the vortex tube cooling gas outlet 338 is not connected to the interior of the beverage can 90 but instead extends upwardly through the can top so that the cooling gases escape to the outside rather than carbonating the beverage. The advantage of combining a vortex tube device with the embodiment of FIG. 1A is that the coolant gases from the bottle are cooled to a lower temperature by the vortex tube device, thereby enhancing the cooling of the beverage 95.

Figure 8:
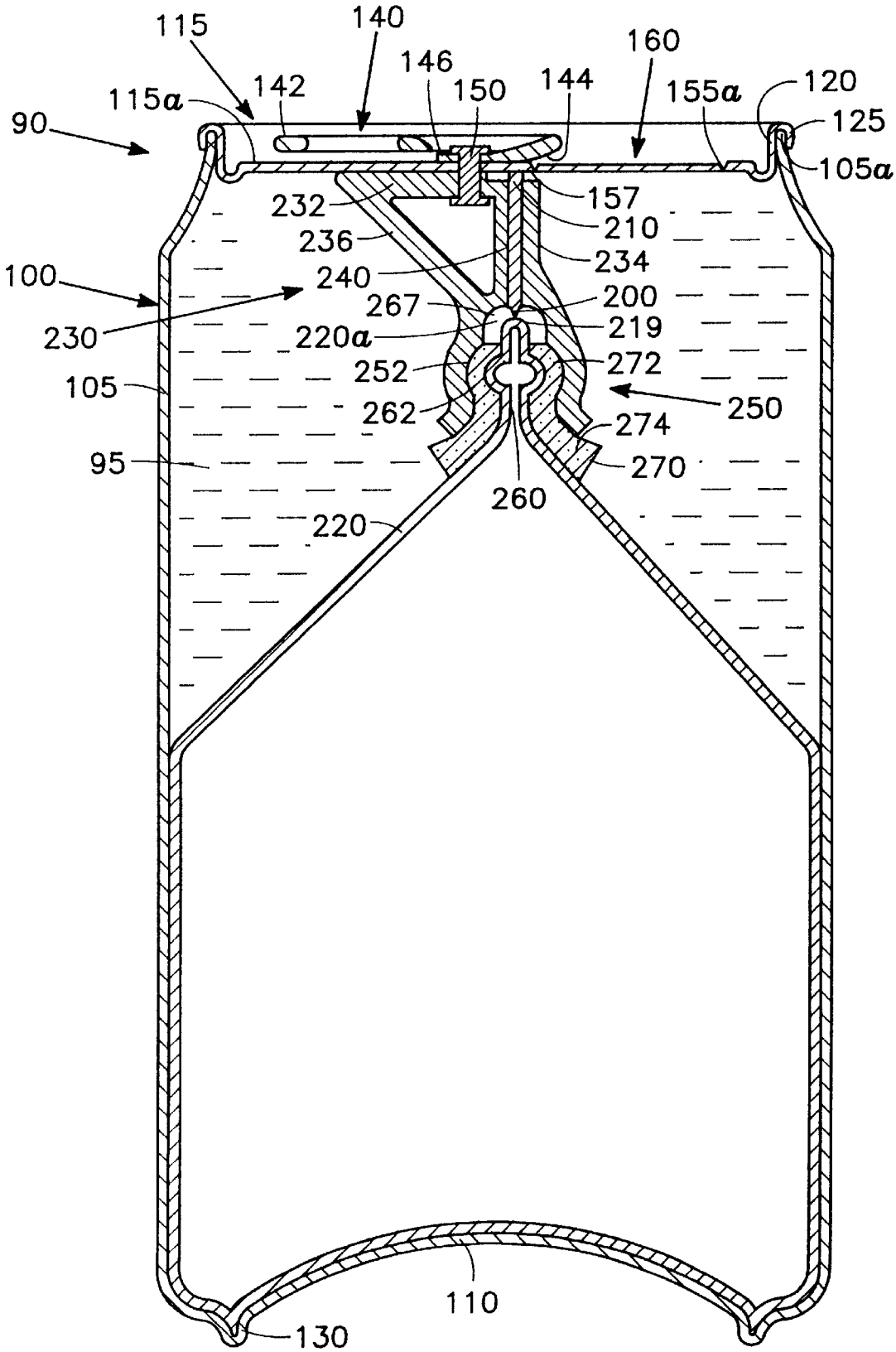
FIG. 8 is a cut-away cross-sectional view of an embodiment in which the coolant gas bottle constitutes the bottom portion of the beverage can.

FIG. 8 illustrates a variation of the embodiment of FIG. 1A in which the cooling gas bottle 220 is a vessel that occupies the bottom portion of the beverage can 90.

Figure 9A:
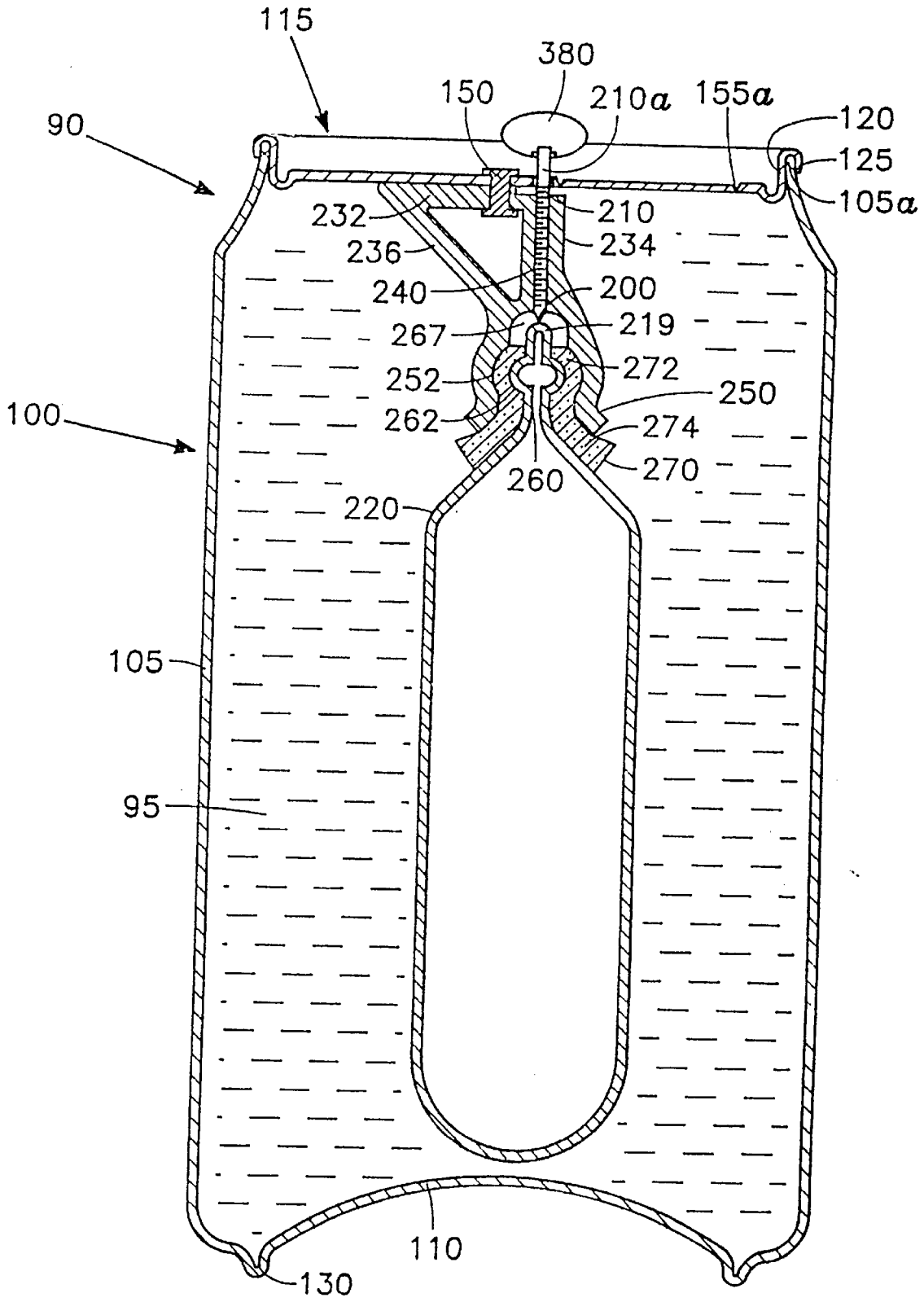
FIG. 9A is a cut-away cross-sectional view of another embodiment of the invention employing a threaded shaft for rotatably driving the puncture needle into coolant gas bottle top.

FIG. 9A illustrates an embodiment of the invention in which the outer cylindrical surface of the plunger 210 is threaded and matching threads are provided on the facing surface of the cylinder 240 so that the plunger 210 is threadably engaged with the support 230. In this embodiment, the plunger needle end 200 is driven into the top of the coolant gas bottle 220 by rotating the plunger 210. This is accomplished by rotating an external twist knob 380 attached to an exterior portion 210*a* of the plunger 210 extending outwardly through the can top 115.

Figure 9B:
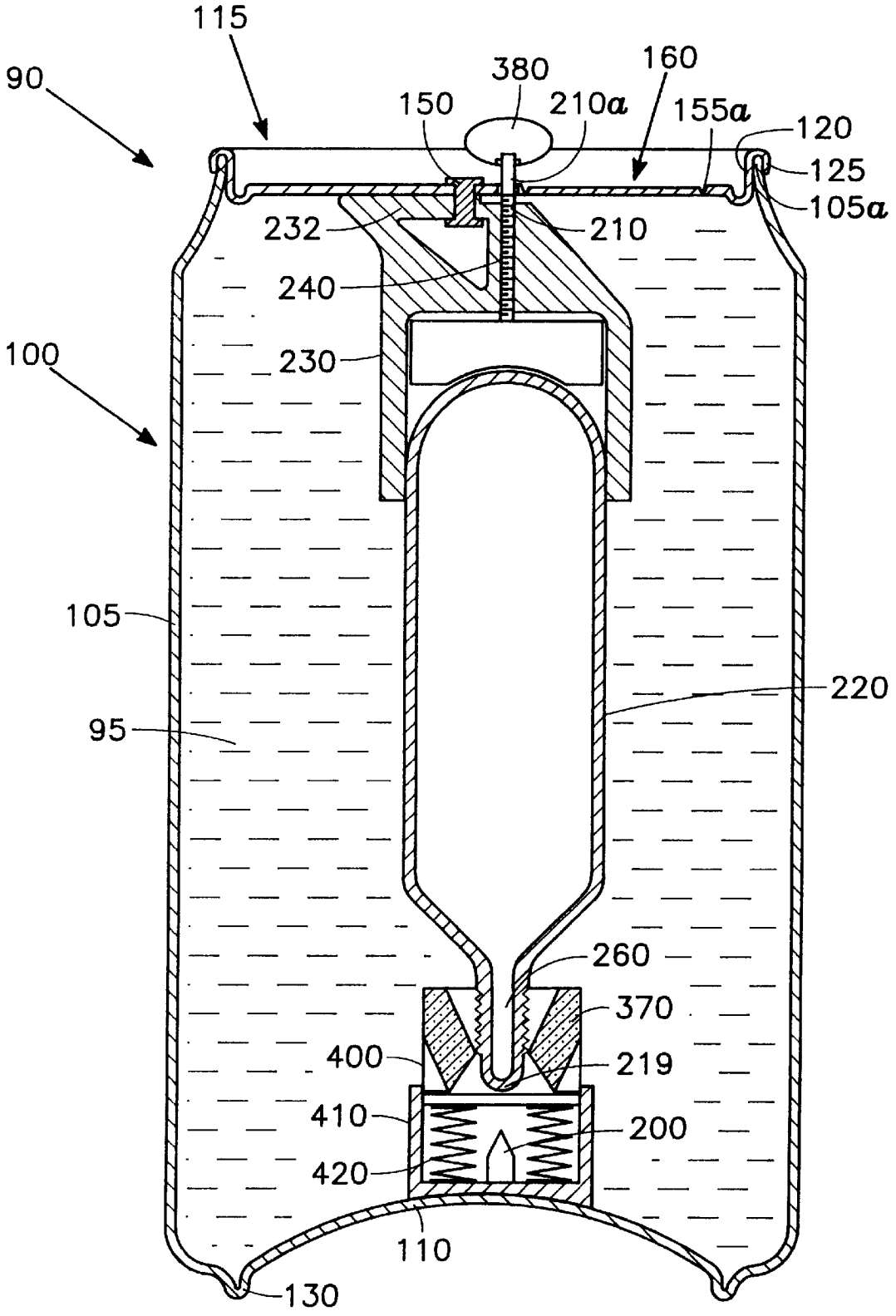
FIG. 9B cut-away cross-sectional view of an embodiment corresponding to FIG. 9A in which the coolant gas bottle faces the bottom of the beverage can.

FIG. 9B illustrates a variation of the embodiment of FIG. 9A in which the coolant gas bottle 220 is upside down inside the beverage can 90, as in FIG. 3. In the embodiment of FIG. 9B, the plunger 210 drives the back end of the bottle 220 so that the bottle neck 260 is driven toward the stationary needle 200 at the bottom of the can 90. The bottle neck 260 held in a piston 400 containing an annular diffuser 370, the piston 400 being held inside a cylinder 410 at the bottom of which the needle 200 is mounted facing the bottle 220. In order to prevent the bottle 220 from being inadvertently opened by the needle, either the friction fit of the piston 400 inside the cylinder 410 is relatively tight or else a spring 420 compressed between the piston 400 and the floor of the cylinder 410 provides a threshold force against downward movement of the bottle 220, or both.

Figure 10A:
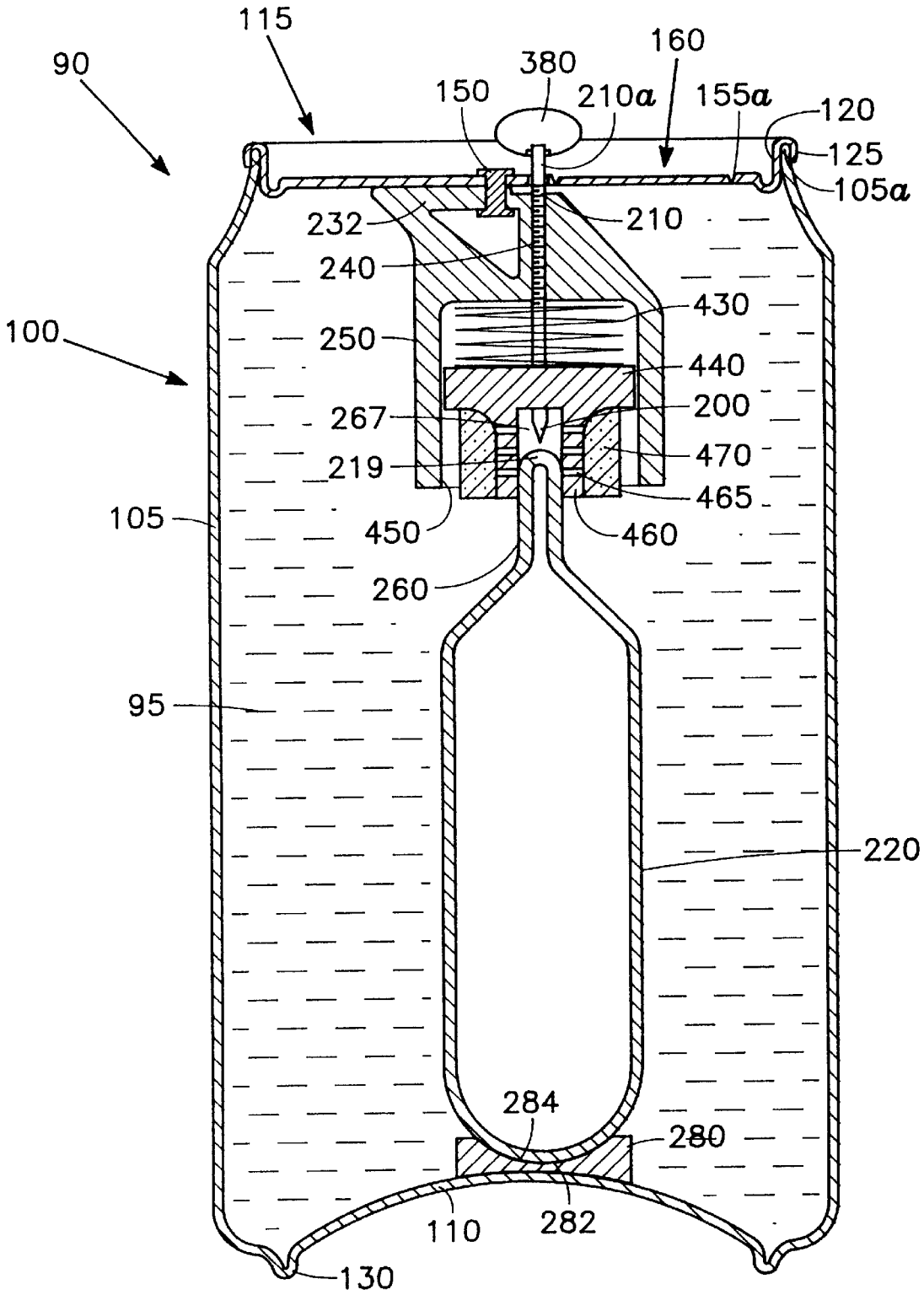
FIG. 10A is a cut-away cross-sectional view of an embodiment corresponding to FIG. 9A in which the threaded shaft is rotated by a pre-wound spring.

FIG. 10A illustrates an embodiment which employs a threaded plunger 210 like FIG. 9A, but further includes a rotationally wound spring 430 which, when released, rapidly rotates the threaded plunger 210, causing it to drive the needle end 200 down upon the top of the coolant gas bottle 220. In this embodiment, the skirt 250 is modified to accommodate the wound spring 430 and to avoid any fastening of the coolant gas bottle 220 thereto. Instead, the modified skirt 250 of FIG. 10A laterally stabilizes the bottle 220 but is downwardly movable along the bottle neck 260. The base 280 vertically braces the bottle 220 and laterally braces the bottom of the bottle 220. The plunger 210 is rotatable and is attached to and drives a piston 440 vertically movable in a cylinder 450 formed by the modified skirt 250 of FIG. 10A. The piston 440 includes an annulus 460 surrounding the bottle neck 260 and defining the cavity 267 into which the needle end 200 extends from the piston 440 toward the bottle 220. The annulus 460 slides along the outside of the bottle neck 260 as the spring 430 rotates the threaded plunger 210 to drive it down. Once the needle end 200 punctures the bottle top, the coolant gas from the bottle 260 escapes through radial orifices 465 in the annulus 460 and through an annular diffuser 470 into the beverage 95.

Figure 10B:
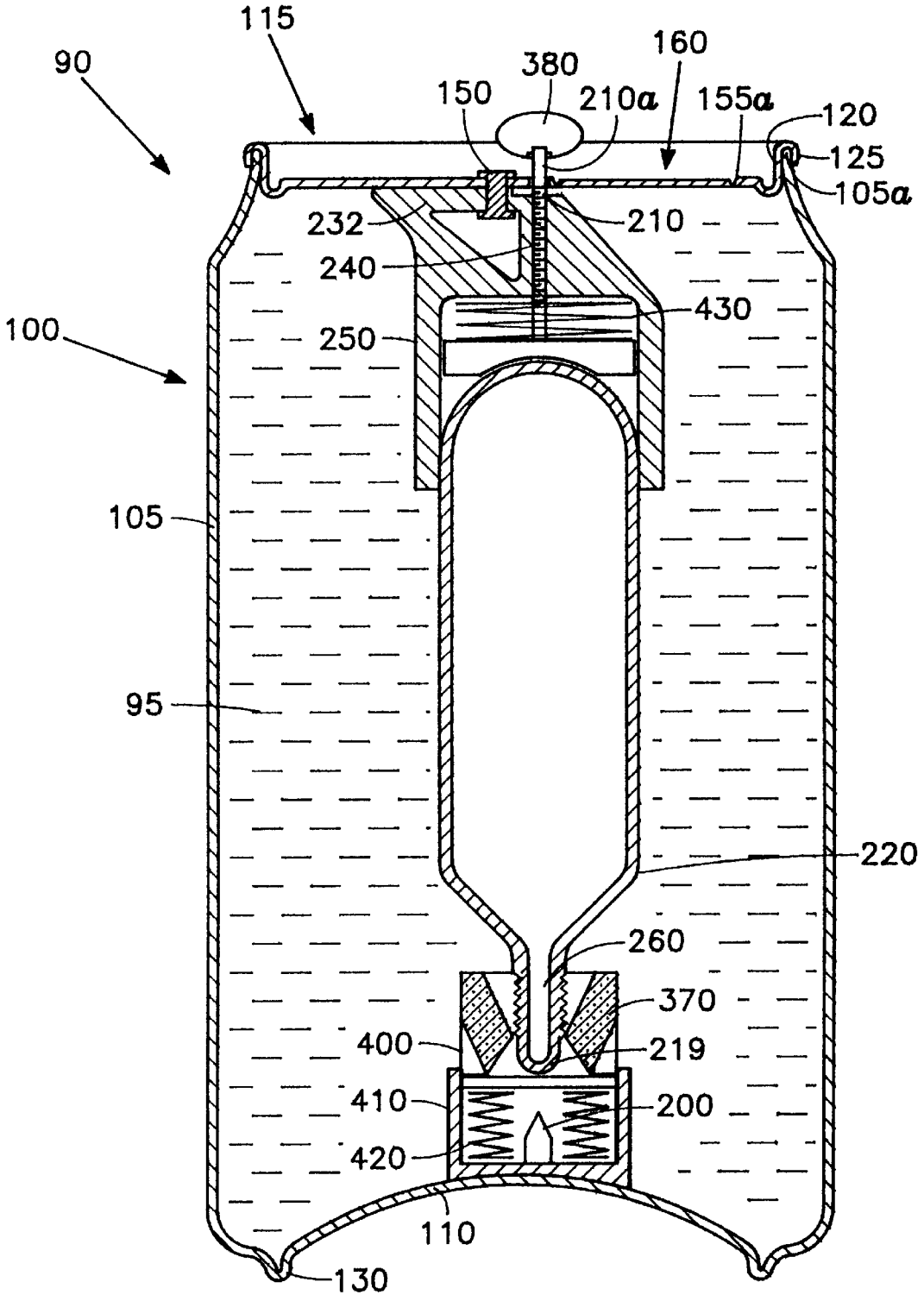
FIG. 10B is a cut-away cross-sectional view of an embodiment corresponding to FIG. 9B in which the threaded shaft is rotated by a pre-wound spring.

FIG 10B illustrates an embodiment corresponding to that of FIG. 9B but employing the releasable rotationally wound spring 430 of FIG. 10A.

Figure 10C:
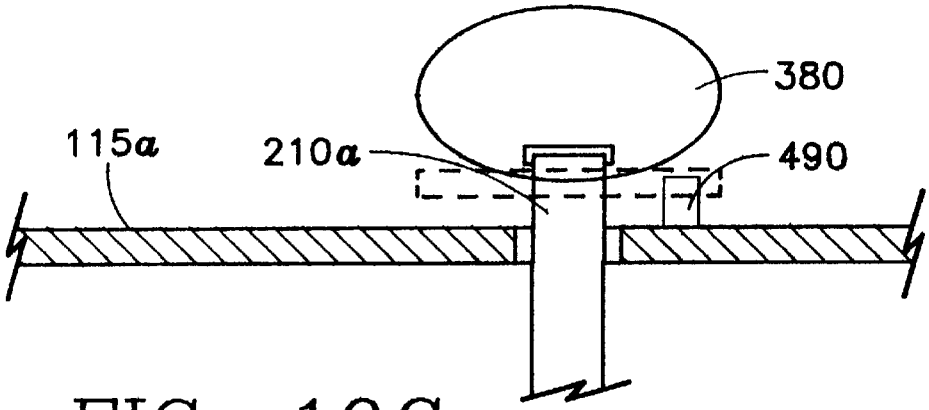
FIG. 10C is a diagram of the spring release employed in FIGS. 10A and 10B.

FIG. 10C illustrates a spring release mechanism for holding and releasing the rotationally wound spring 430, employing a brace 490 fastened to the can top surface 115*a*, the brace 490 engaging the twist tab 380 in its horizonal (dashed line) position of FIG. 10C until the twist tab 380 is rotated to the solid line vertical position of FIG. 10A or 10B.

Figure 10D:
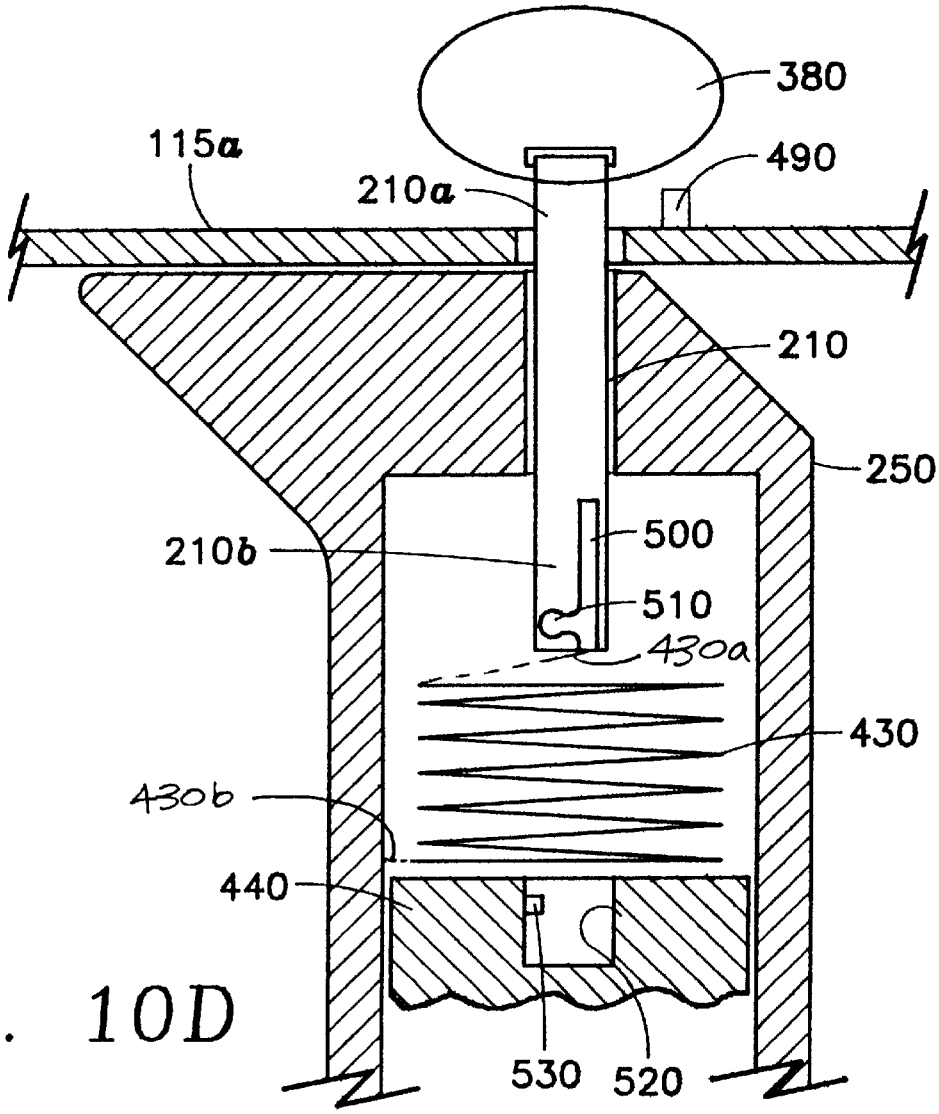
FIG. 10D is a cut-away cross-sectional view of the spring release mechanism employed in FIGS. 10A and 10B.

The spring 430, rather than being rotationally wound, may instead be a linearly compressed spring which directly pushes the plunger 210. In this case, the threads on the plunger 210 may be eliminated. FIG. 10D illustrates a partially disassembled spring release mechanism for holding and releasing the linearly compressed version of the spring 430 for the embodiments of either FIG. 10A or FIG. 10B. In FIG. 10D, the piston 440 has been dropped away from the plunger 210 to expose an axial slit 500 in the bottom end 210*b* of the plunger 210 and a radial key slot 510 extending circumferentially from the slit 500. The piston 440 has a cylinder 520 which receives the plunger bottom end 210*b*, and a key 530 extending radially inwardly from the inner surface of the cylinder 520. The linearly compressed spring 430 may have one of its ends 430*a* fastened to the threaded plunger 210 and its other end 430*b* fastened to a stationary object such as a side wall of the skirt 250, although this may not be necessary in most implementations. Expansion of the spring 430 is prevented as long as the key 530 is inside the radial key slot 520. Twisting of the tab 380 frees the key 530 into the axial slot 500, permitting the linearly compressed spring 430 to freely expand and drive the piston 440.

Figure 11A:
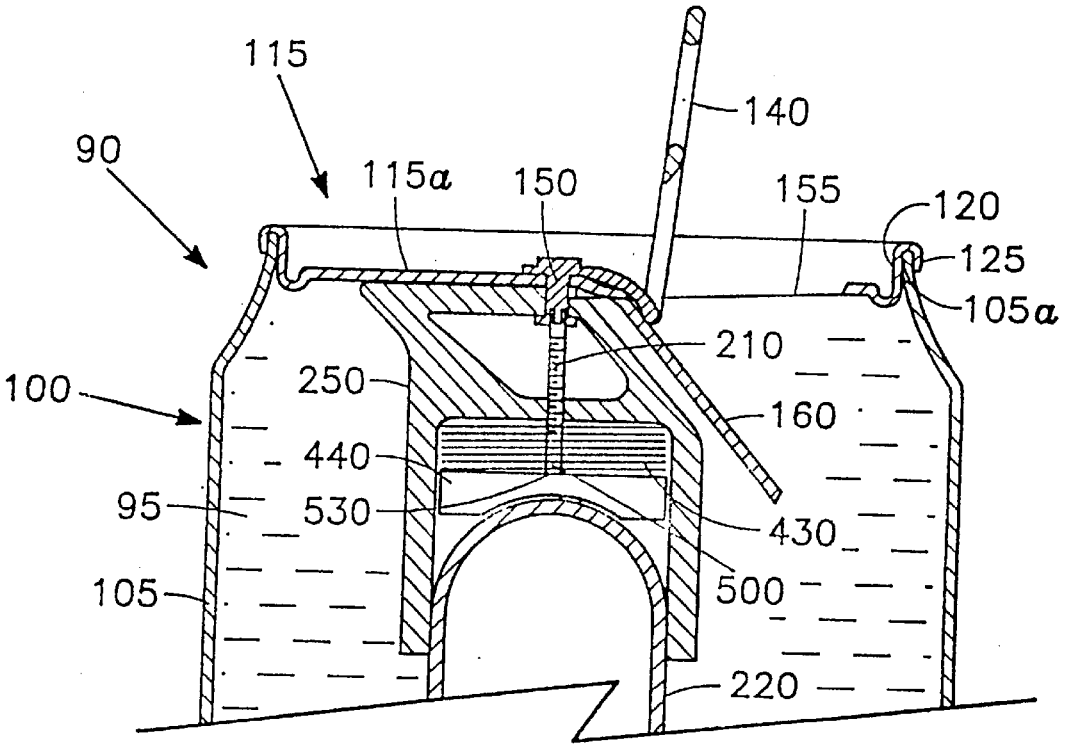
FIGS. 11A and 11B are sequential cut-away cross-sectional views illustrating the operation of a variation of the embodiment of FIG. 10A in which the spring release mechanism is combined with the finger pull-tab of the beverage can.
Figure 11B:
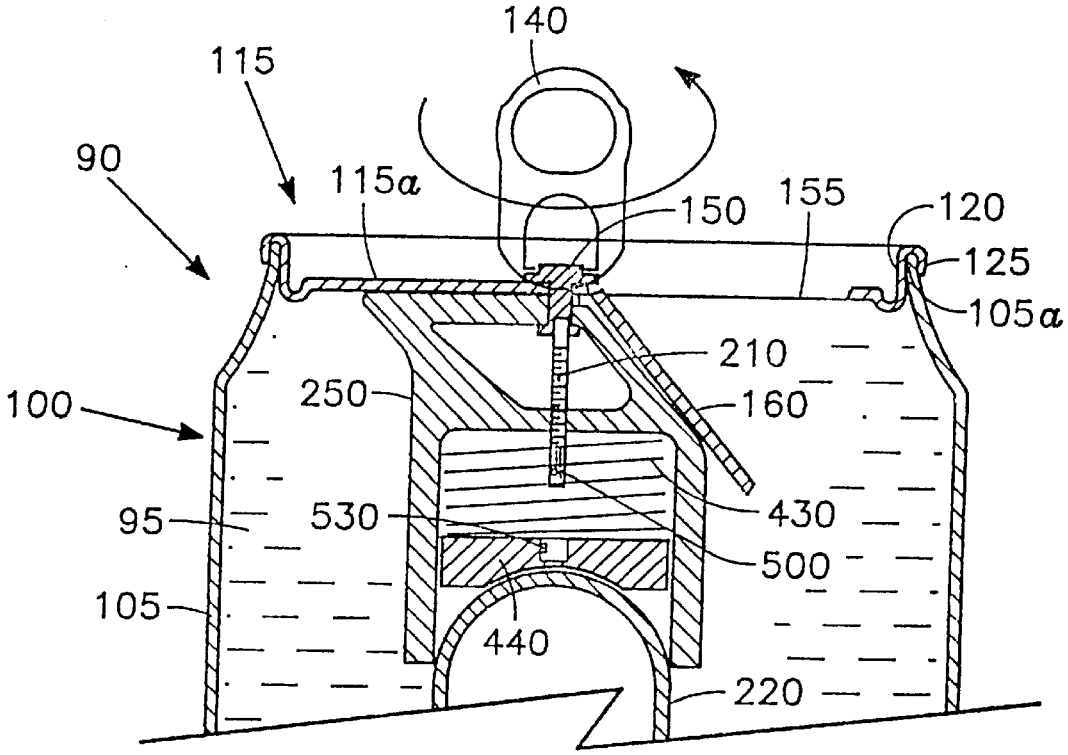

FIGS. 11A and 11B are chronologically sequential diagrams illustrating the operation of a variation of the embodiment of FIG. 10D, in which the twisting motion of the plunger 210 which frees the linearly compressed spring 430 is provided by the pull-tab 140 which, in the embodiment of FIGS. 11A and 11B, is attached to the plunger 210 so that the plunger 210 rotates with the pull-tab 140. Thus, the pull-tab 140 both opens the beverage can 90 and frees the linearly compressed spring 430. In FIG. 11A, the pull tab 140 opens the can 90 in the manner described above with reference to FIG. 1A. Then, in FIG. 11B, the pull-tab 140 is rotated about an axis normal to the can top surface 115*a* through a right angle to twist the plunger 210, thereby moving the key 530 into the axial slot 500 to free the linearly compressed spring 430.

Figure 12A:
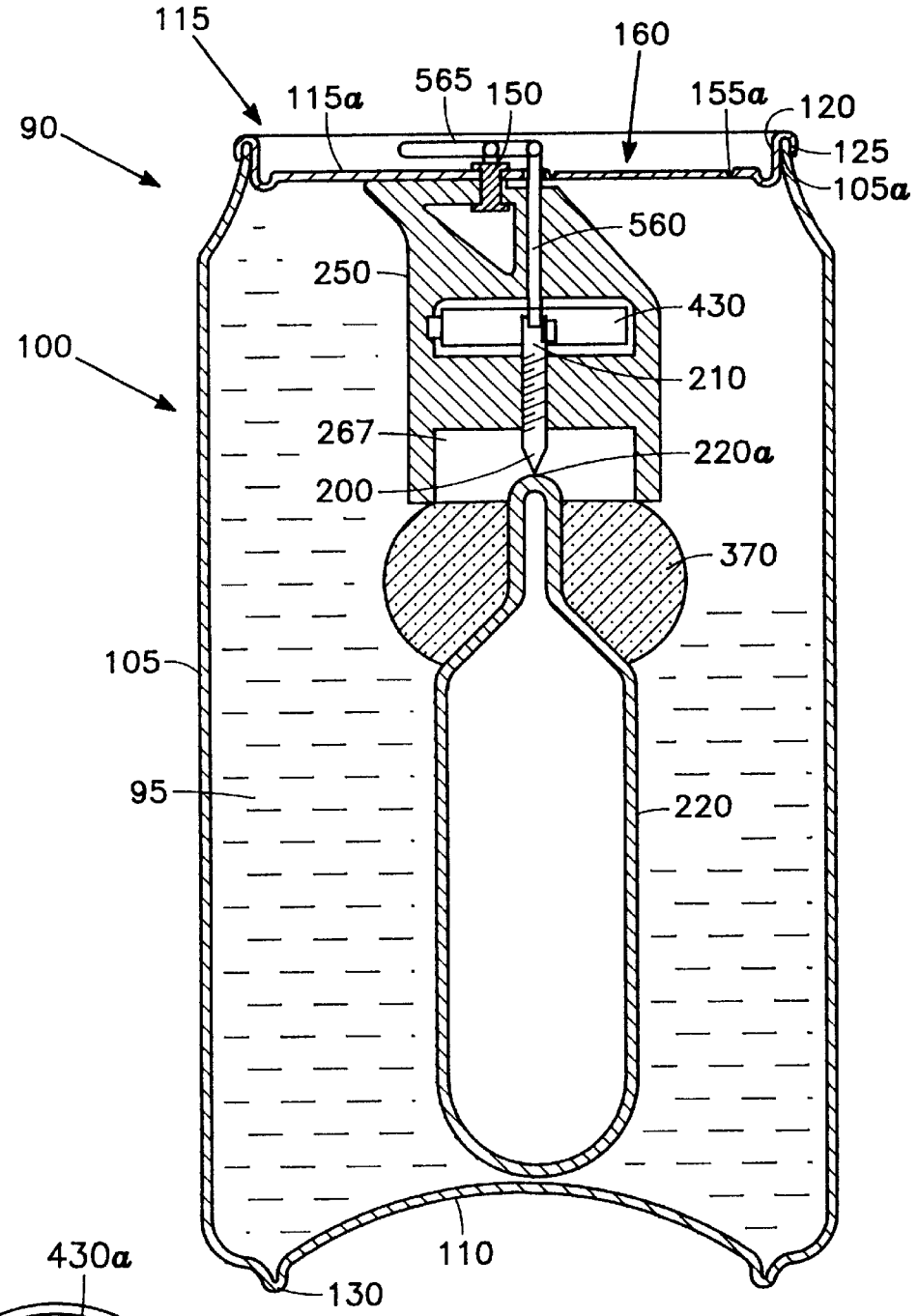
FIGS. 12A and 12B are sequential cut-away cross-sectional views illustrating the operation of an embodiment corresponding to FIG. 10A in which the pre-wound spring is released by a push-lever.
Figure 12C:
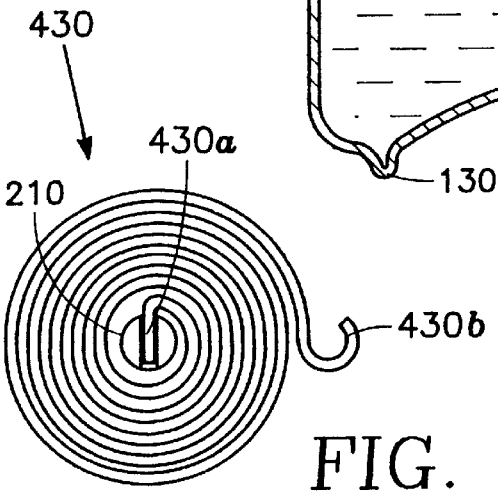
FIG. 12C is a top view of the pre-wound spring employed in the embodiment of FIG. 12A.
Figure 12B:
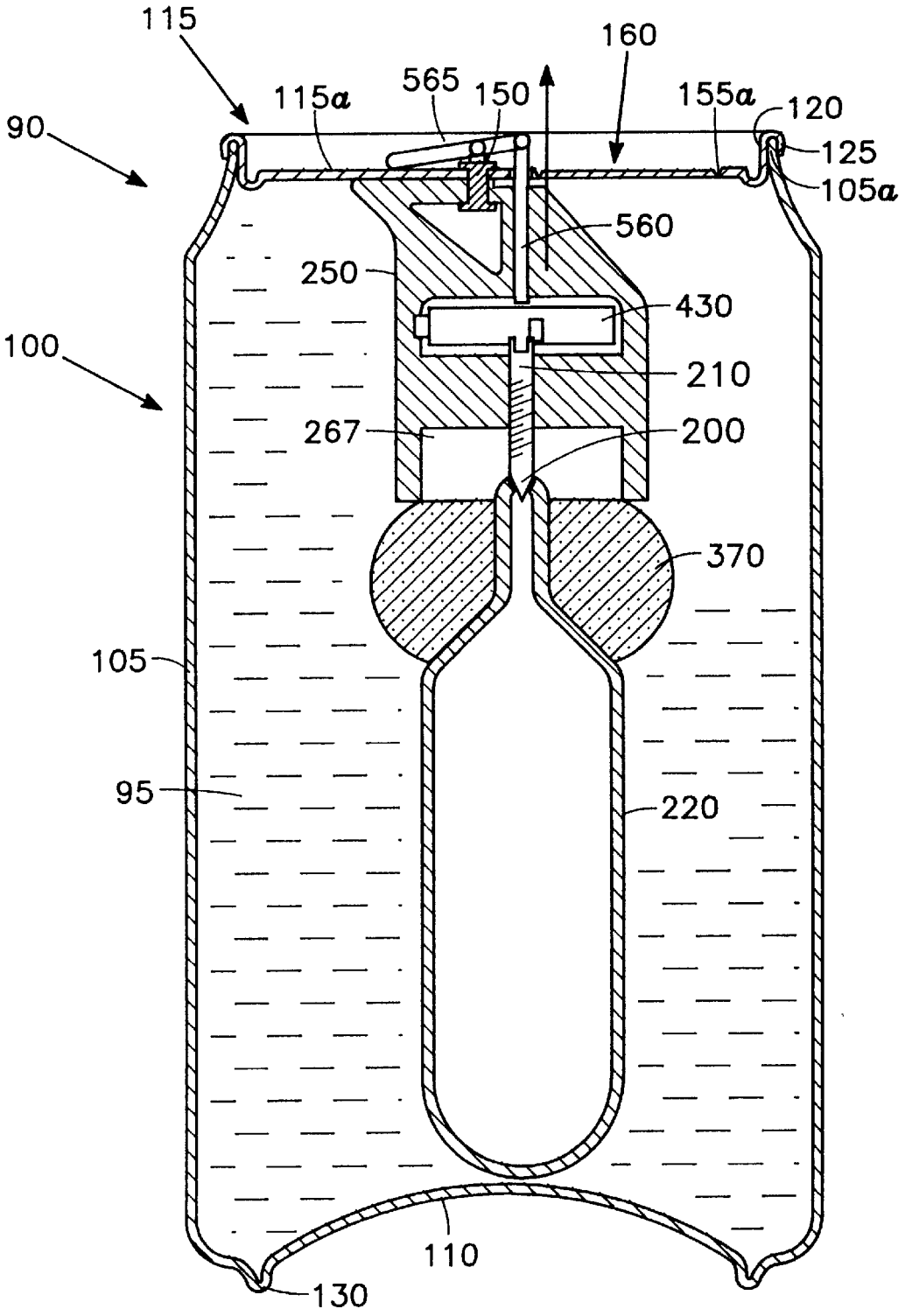

FIGS. 12A and 12B are sequential diagrams illustrating the operation of an embodiment employing a pre-wound coiled version of the spring 430, as illustrated in FIG. 12C. In this embodiment, one end 430*a* of the coiled spring 430 has a tab inserted into the threaded piston 210 while the other end 430*b* has a tab inserted into a slot in the skirt 250. One end of a vertically suspended leg 560 having a non-circular (e.g., square) cross-section is inserted in an opening of the same cross-section in the top of the plunger 210. The other end of the leg 560 extends upwardly through the can top 115 and is connected to the short arm of an external lever 565 whose fulcrum may be, for example, the rivet 150. As shown in FIG. 12B, pushing down on the long arm of the lever 565 disengages the leg 560 from the plunger 210, thereby freeing the threaded plunger 210 to rotate under the force exerted by the pre-wound coil spring 430. The plunger tip 200 penetrates the gas bottle as shown in FIG. 12B.

Figure 13:
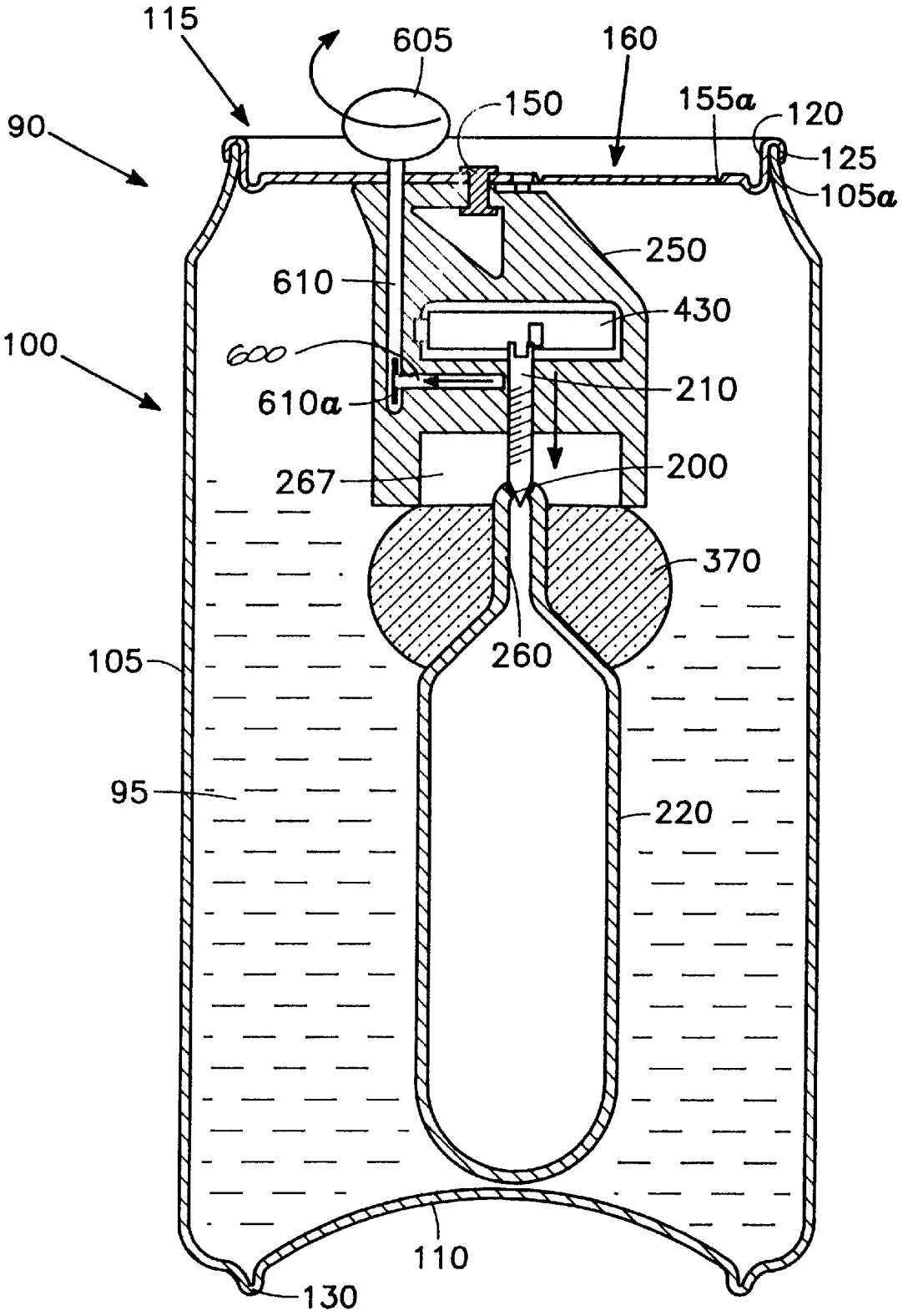
FIG. 13 is a cut-away cross-sectional view of an embodiment corresponding to FIG. 12A in which the pre-wound spring release is actuated by a twist tab.

FIG. 13 illustrates a modification of the embodiment of FIGS. 12A and 12B in which the spring release mechanism is a horizontal finger 600 engaging through a passage in the skirt 250 a matching hole in the threaded plunger 210. This engagement of the finger 600 with the threaded plunger 210 prevents rotation of the plunger despite the urging of the rotationally wound coil spring 430. The finger 600 is withdrawn from engagement with the threaded plunger 210 by twisting an external knob 605 attached to a vertical leg 610 extending downwardly through the can top 115 and having a bottom end 610*a* around which the finger 600 is wrapped and engaged through a slot.

Figure 14A:
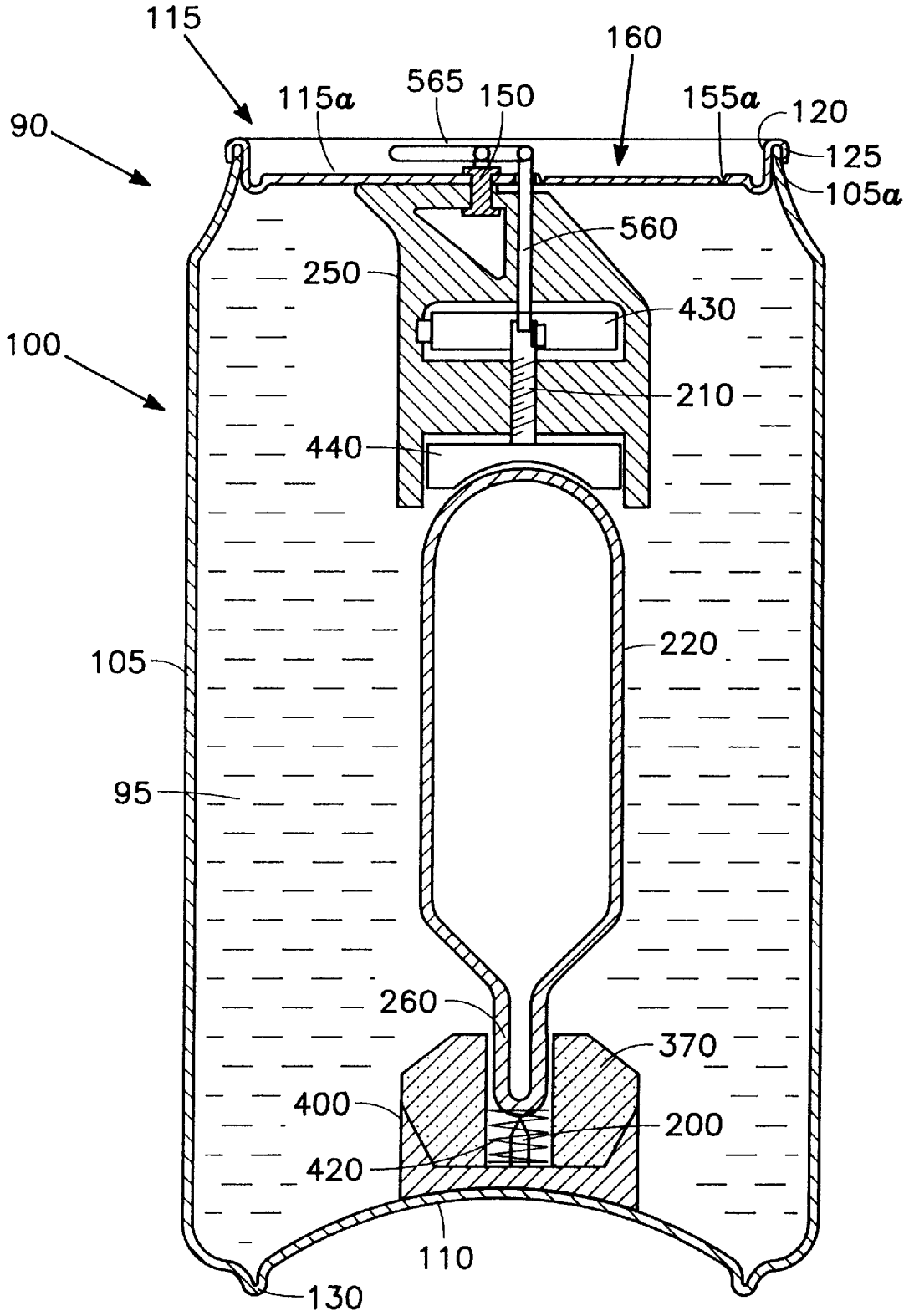
FIGS. 14A and 14B are sequential cut-away cross-sectional views illustrating the operation of an embodiment corresponding to FIG. 12A in which the coolant gas bottle faces the bottom of the beverage can.
Figure 14B:
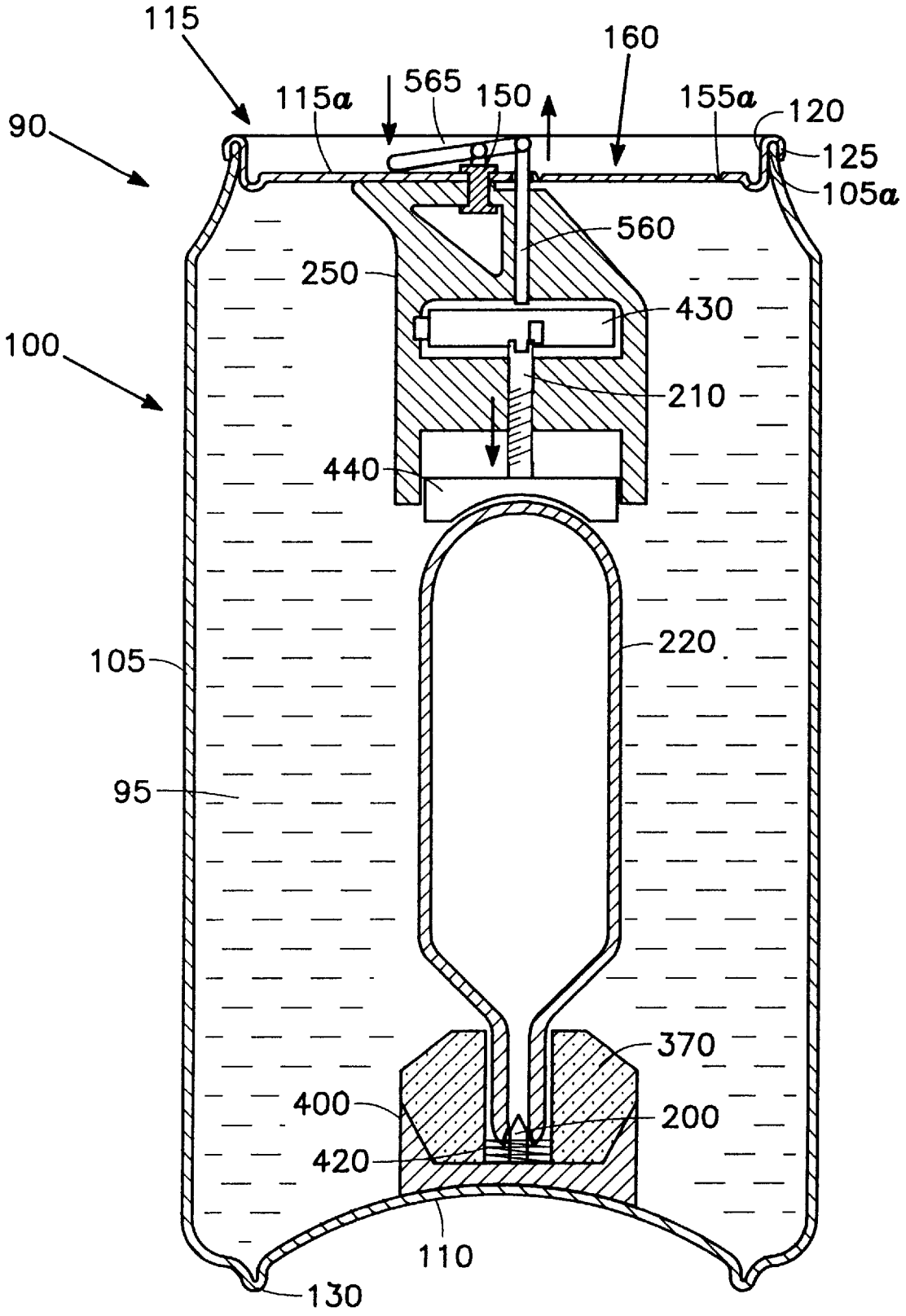

FIGS. 14A and 14B are sequential diagrams illustrating the operation of a variation of the embodiment of FIGS. 12A and 12B in which the coolant gas bottle 220 is upside down inside the beverage can 90, like the embodiment of FIG. 10B. In this case, the piston 400 and cylinder 420 of FIG. 10B at the bottle neck 260 are located at the bottom of the can 105. These are combined with the coil spring 430, locking leg 560 and lever 565 at the top of the can 105. These drive the base end of the bottle 220 in the embodiment of FIGS. 14A and 14B. As in the embodiment of FIGS. 12A and 12B, pushing on the lever 565 (as in FIG. 14B) frees the threaded plunger 210 to rotate with the coil spring 430.

Figure 15C:
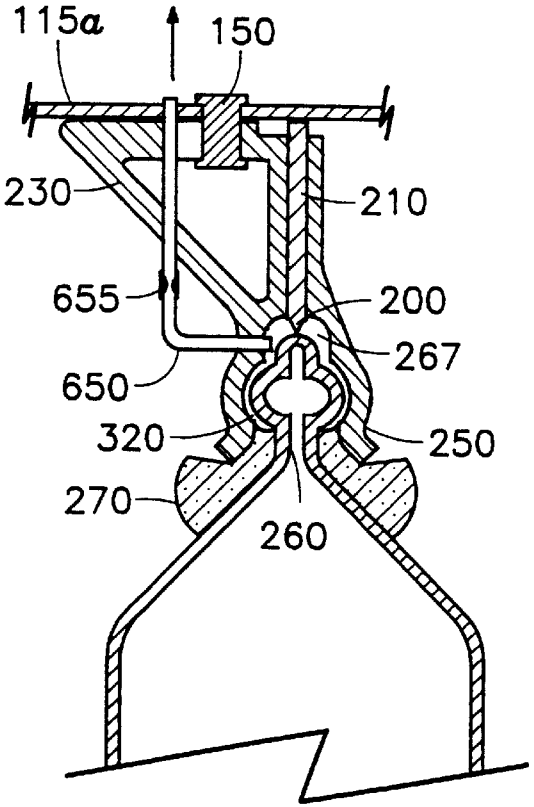
FIG. 15C is a partial cut-away cross-sectional view of a variation of the embodiment of FIG. 1A in which a portion of the coolant gas is evacuated externally of the can while the remainder enters the beverage through a diffuser attached to the can support.
Figure 15B:
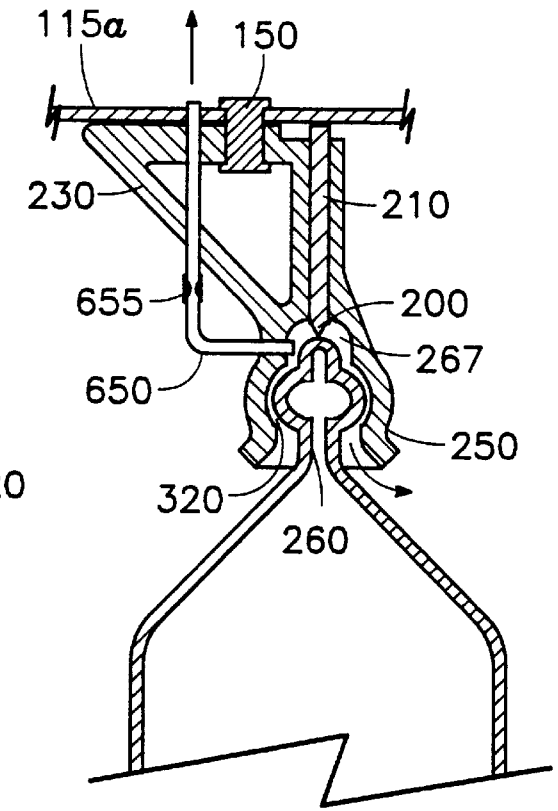
FIG. 15B is a partial cut-away cross-sectional view of a variation of the embodiment of FIG. 1A in which a portion of the coolant gas is evacuated externally of the can while the remainder enters the beverage through the connection between the can and the can support.
Figure 15A:
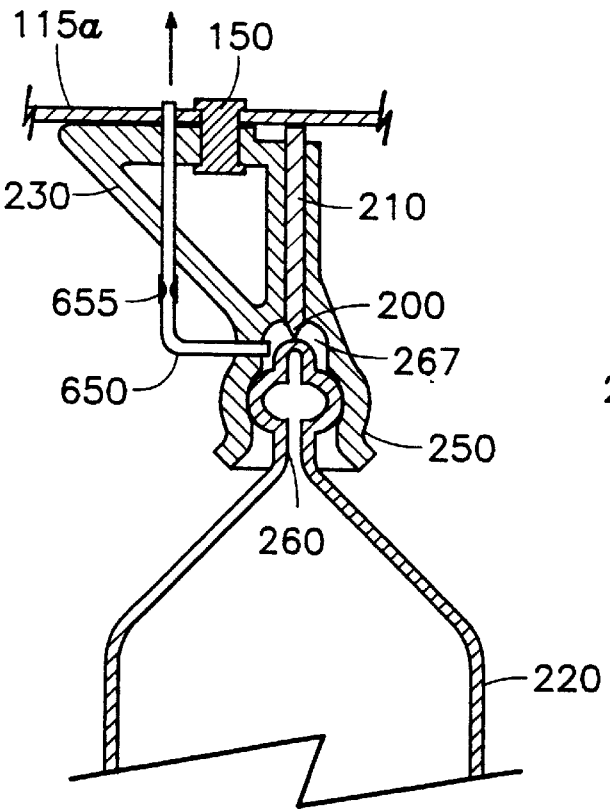
FIG. 15A is a partial cut-away cross-sectional view of a variation of the embodiment of FIG. 1A in which the coolant gas is evacuated externally of the beverage can.

FIG. 15A illustrates a variation of any of the embodiments with the bottle 220 facing upright in the can 90, such as the embodiment of FIG. 1A, in which all of the coolant gases are vented from the cavity 267 to the outside of the beverage can 90 by a gas line 650 extending upwardly through the can top 115. FIG. 15B illustrates a variation of the embodiment of FIGS. 6B and 6C in which some of the coolant gas in the cavity 267 is diverted from passing through the axial lands 320 by the gas line 650 and vents it outside the can 90 instead. FIG. 15C illustrates a variation of the embodiment of FIG. 1A in which the tube 650 diverts some of coolant gas in the cavity 267 from passing through the diffuser 270 and vents it outside the can 90 instead. Preferably, the gas line 650 has a constricted metering portion 655 which limits the flow rate therethrough, thereby establishing the proportion of coolant gas vented to the outside.

Figure 16A:
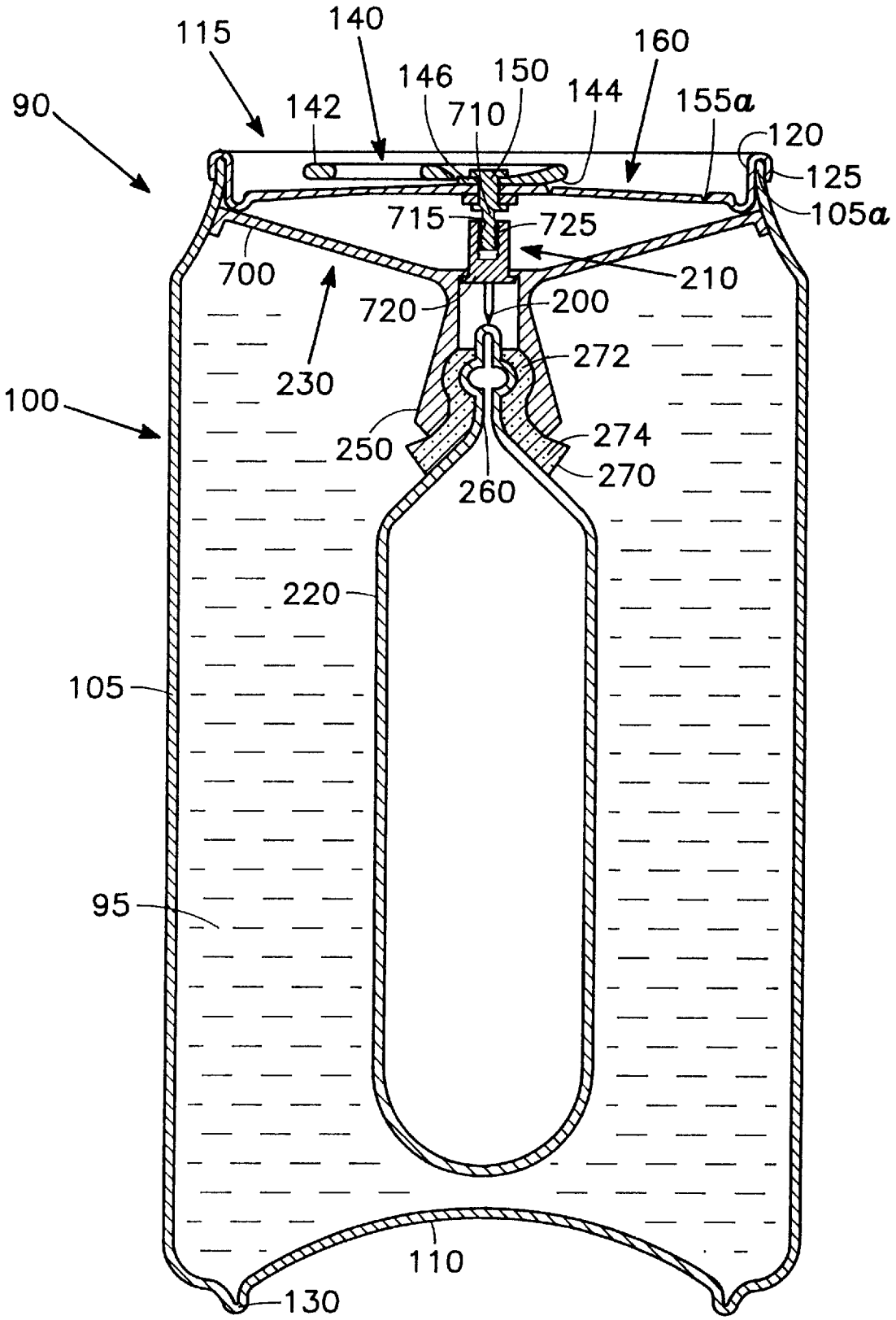
FIG. 16A is a cut-away cross-sectional view of another embodiment of the invention in which the bottle-piercing needle is driven by downward flexure of the can top when the internal can pressure is first released by movement of the finger pull-tab.

FIG. 16A illustrates an embodiment of the invention in which downward motion of the plunger 210 derives from the downward motion of the can top 115 upon opening of the can 90. This downward motion is occasioned by the release of the gases with which the can 90 was pressurized at the time it was sealed. The support 230 is modified so that it does not contact the can top 115, leaving the can top 115 completely free to deform and un-deform when the can 90 is pressurized during manufacture and then de-pressurized upon opening, respectively. Rather than being fastened the can top 115, the support 230 is fastened to the top of the vertical cylindrical side wall 105 by about three (or more) struts 700 extending from the bottle support 230 to the top of the cylindrical side wall 105. The struts are sufficiently stiff to hold the modified support 230 relatively immobile.

In FIG. 16A, the plunger 210 consists of a cylindrical upper portion 710 connected to the rivet 150 and having outwardly extending radial ratchet teeth 715 and an annular lower portion 720 having inwardly extending radial ratchet teeth 725 matching the ratchet teeth 715. The needle end 200 extends vertically downward from the lower plunger portion 720 toward the coolant gas bottle 220. The ratchet teeth permit the upper and lower plunger portions 710, 720 to be adjusted away from one another during assembly. FIG. 16A shows how the needle end 200 is held against the top of the coolant gas bottle 220 while the can top 115 is deformed upwardly by the pre-pressurization of the can 90. Each one of the struts 700 is bonded at one end to the modified support 230 and to the top of the cylindrical can wall 105 at the other end to hold the support 230 stationary during movement of the can top 115. The middle of the can top 115 travels down when the can is opened by the pull-tab 140, while the bottle 220 is held motionless by the support 230, forcing the downward traveling needle end 200 to pierce the top of the coolant bottle 220.

Figure 16B:
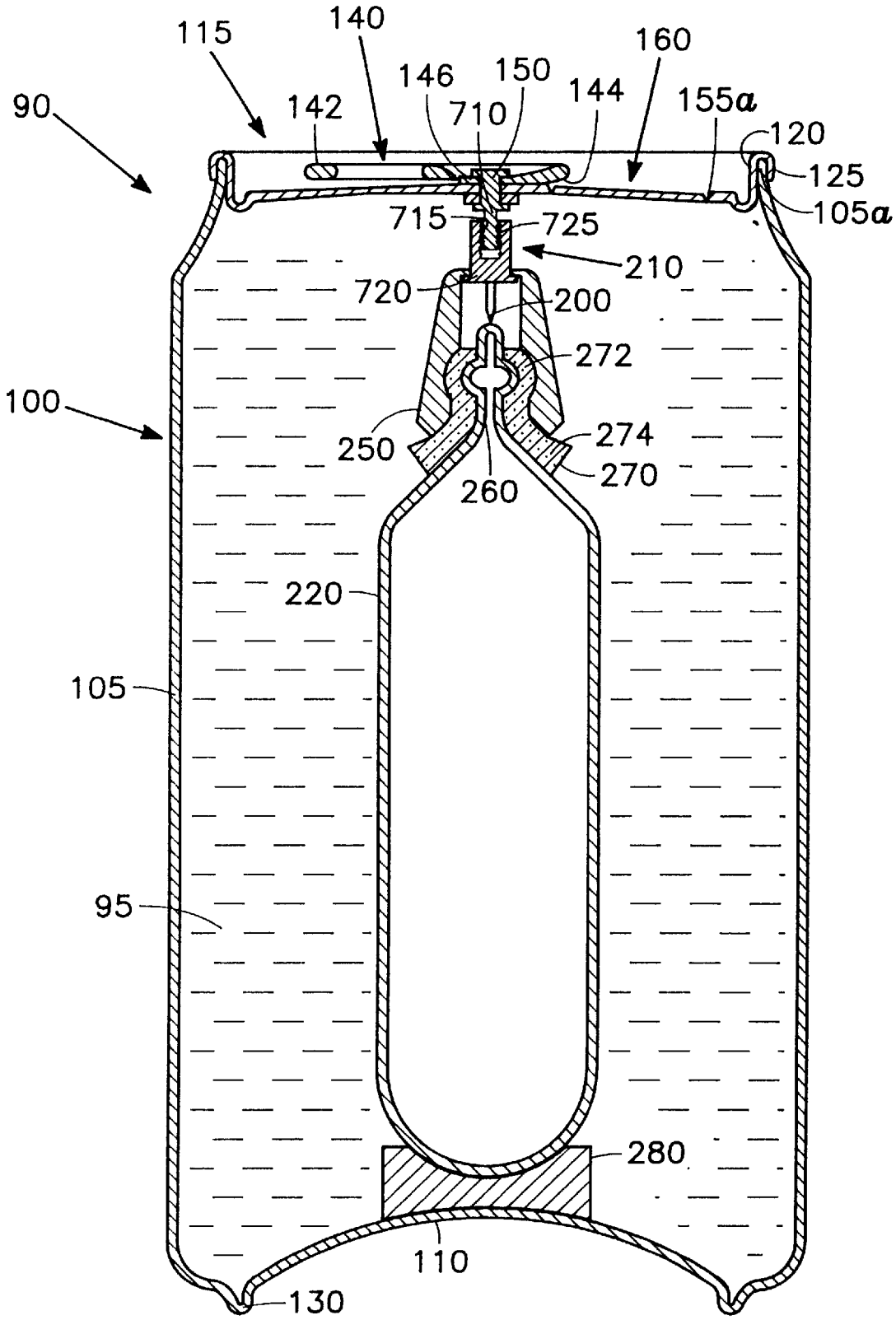
FIG. 16B is a cut-away cross-sectional view of a variation of the embodiment of FIG. 16A in which the coolant gas bottle is supported at the bottom of the beverage can.

FIG. 16B shows how the embodiment of FIG. 16A may be modified by resting the bottom of the coolant gas bottle 220 on the conforming base 280 bonded to the bottom of the can 90, thus obviating the need for the horizontal struts 700.

Figure 16C:
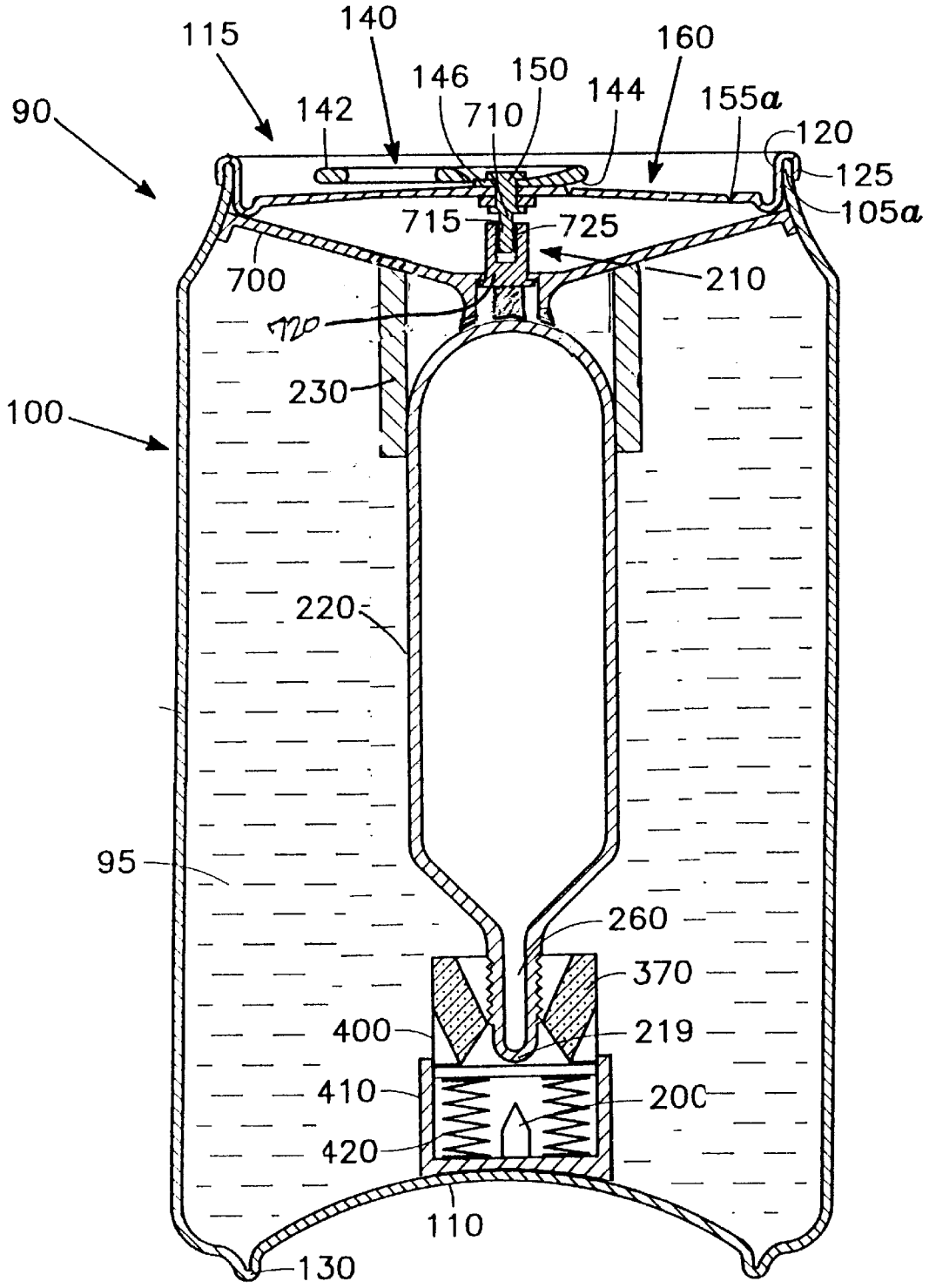
FIG. 16C is a cut-away cross-sectional view of a combination of the embodiments of FIGS. 9B and 16A.

FIG. 16C shows how the embodiment of FIG. 16A may be modified by turning the coolant gas bottle 220 upside down in accordance with the embodiment of FIG. 9A. In FIG. 16C, the bottle support 230 of FIG. 9A is coupled to the horizontal legs 700 of the support of FIG. 16A.

Figure 17A:
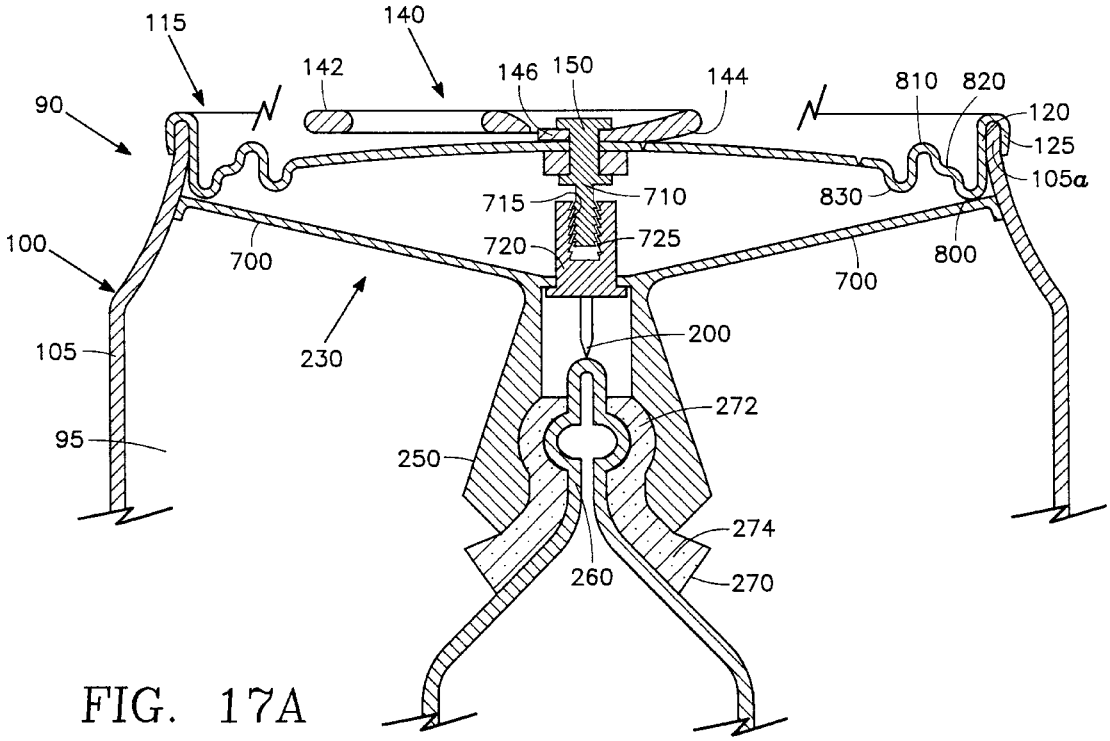
FIGS. 17A and 17B are sequential cut-way cross-sectional views illustrating the operation of an embodiment corresponding to FIG. 16A having a can top which is specially configured to maximize the downward flexure of the can top upon the internal can pressure being released by movement of the finger pull-tab.
Figure 17B:
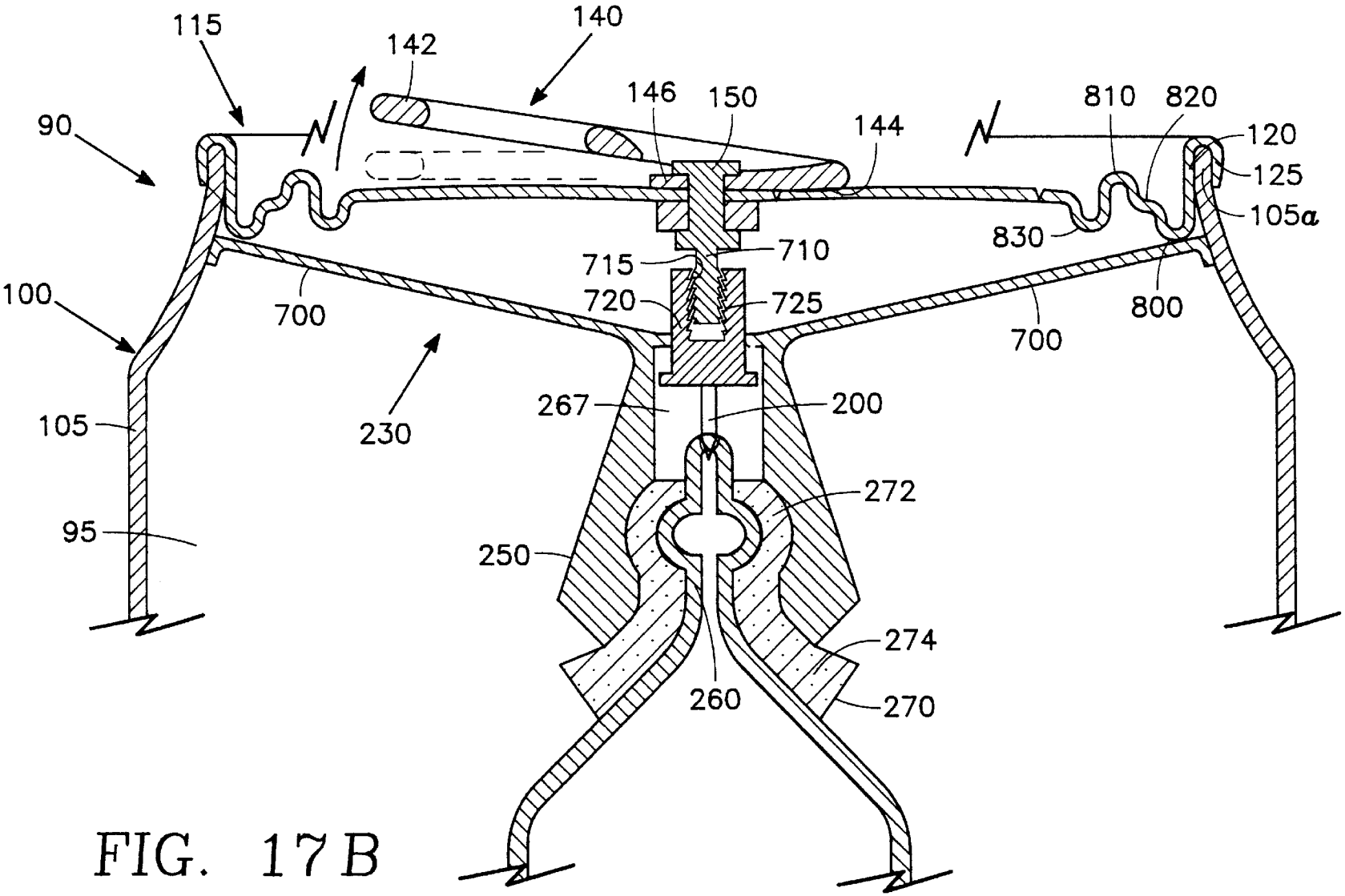
Figure 19A:
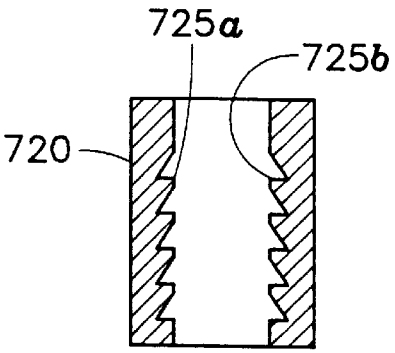
FIG. 19A is a side view a ratchet plunger housing employed in another implementation of the embodiment of FIG. 17A.
Figure 19B:
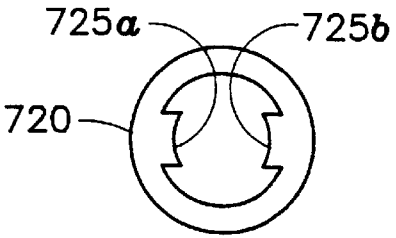
FIG. 19B is a top view of the ratchet plunger housing of FIG. 19A.

FIG. 17A illustrates a version of the embodiment of FIG. 16A in which the can top 115 has a cross-sectional shape which maximizes its deformation upon pre-pressurization of the can 90 and, consequently, maximizes its downward displacement upon opening of the can. The resulting increase in deformation of the can lid 115 increases the distance traveled by the plunger 210 and hence the distance that the needle end 200 penetrates the top of the coolant bottle 220. The performance of the embodiment of FIG. 17A is therefore superior to that of FIG. 16A. The novel cross-sectional shape of the can top 115 of FIG. 17A includes an outer downwardly extending annular well 800 near the periphery of the circular can lid 115, an intermediate upwardly extending annular well 810 separated from the outer annular well by an annular step 820. Finally, there is an inner annular well 830 inboard of the intermediate annular well 810. FIG. 17B shows how the middle of the can top 115, to which the plunger 210 is attached, travels downward as the can top assumes a flat shape upon the can being opened.

Figure 18A:
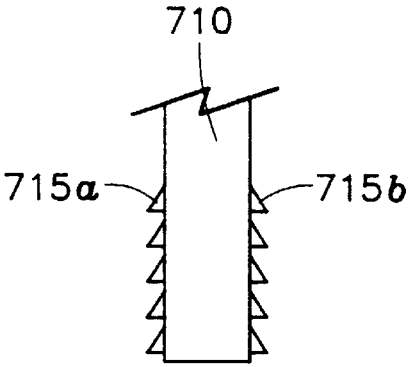
FIG. 18A is a side view a ratchet plunger employed in one implementation of the embodiment of FIG. 17A.
Figure 18B:
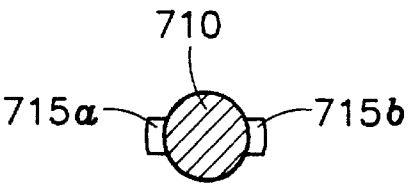
FIG. 18B is a top view of the ratchet plunger of FIG. 18A.
Figure 17C:
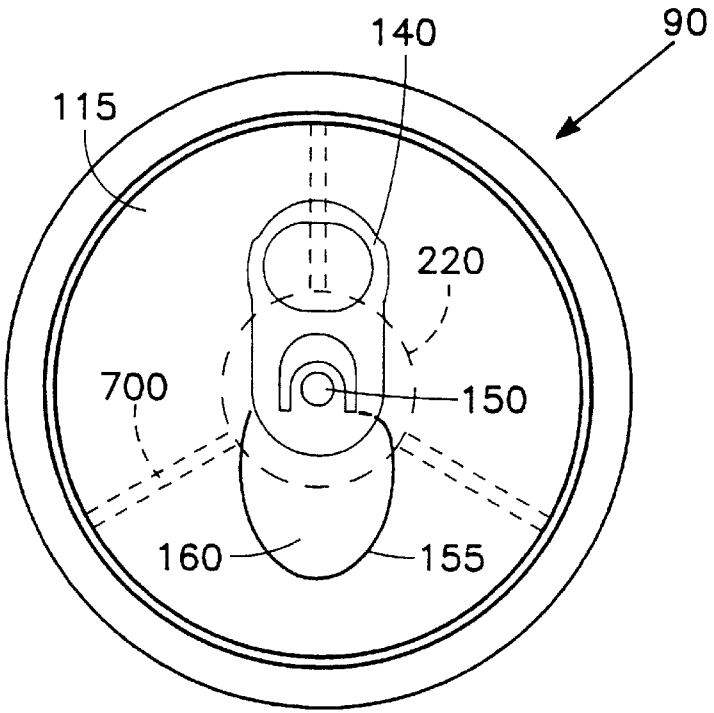
FIG. 17C is a top view corresponding to FIG. 17A.

As mentioned previously, the ratchet teeth in the two portions 710, 720 of the plunger 210 permit the length of the plunger 210 to be adjusted by axial movement of the two portions 710, 720 away from one another. Assembly of the support 230 is made practicable by making the two plunger portions 710, 720 freely adjustable both away from and toward one another upon rotation of one plunge portion relative to the other by 90 degrees. This free adjustment is accomplished in one embodiment illustrated in FIGS. 18A and 18B by limiting the ratchet teeth 715 on the upper plunger portion 710 to a pair of elongate vertical groups 715*a*, 715*b* on opposite sides of the upper plunger. Alternatively, the free adjustment of the two plunger portions 710, 720 is accomplished by limiting the ratchet teeth 725 on the lower plunger portion 720 to a pair of elongate vertical groups 725*a*, 725*b* on opposite sides of the lower plunger portion. In either of the embodiments of FIGS. 18A,B or 19A,B, during manufacture, the upper and lower plunger portions 710, 720 are rotated about their axes of symmetry by 90 degrees to disengage the ratchet teeth and permit their free adjustment. Preferably, this is done so that the length of the plunger 210 is such that the needle end 200 rests on the coolant gas bottle top once the can 90 has been pressurized. Then, prior to completion of manufacture, one of the plunger portions 710, 720 is rotated by 90 degrees about its cylindrical axis so as to engage the ratchet teeth 715, 725.

Figure 20B:
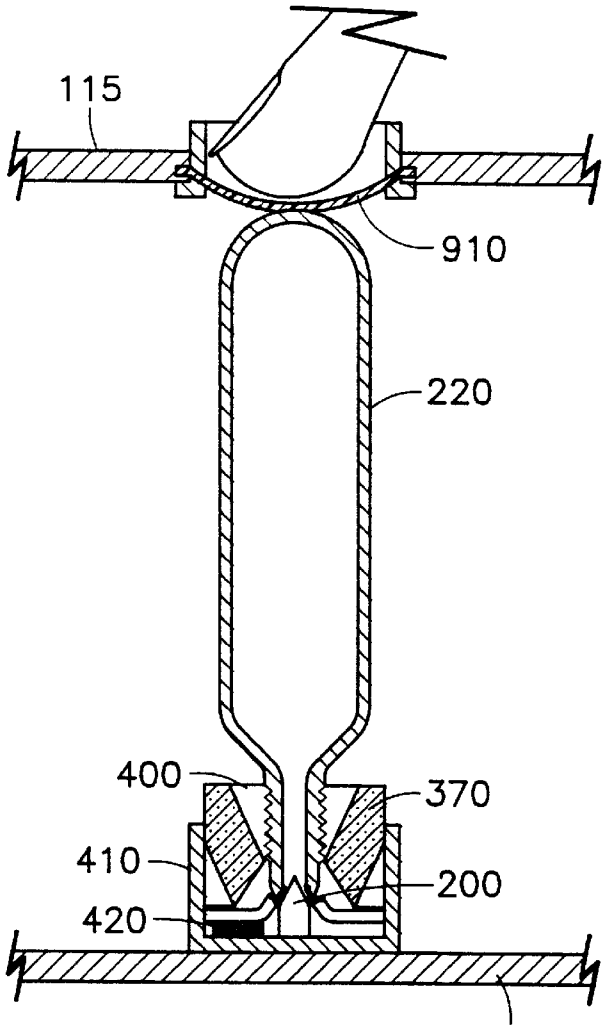
FIGS. 20A and 20B are sequential cut-away cross-sectional views of another implementation of the invention.
Figure 20A:
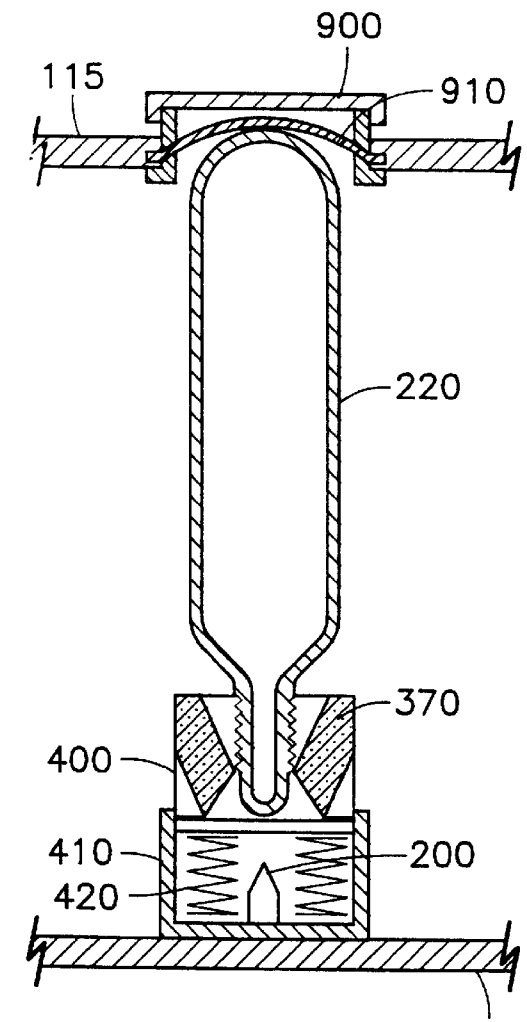

FIGS. 20A and 20B are sequential diagrams illustrating the operation of an embodiment with the coolant gas bottle 220 upside down in the beverage can 90, in which the bottle 220 is urged toward the needle 200 by a compressible button 910 in the can top 115 protected by a removable cap cover 900.

Figure 21A:
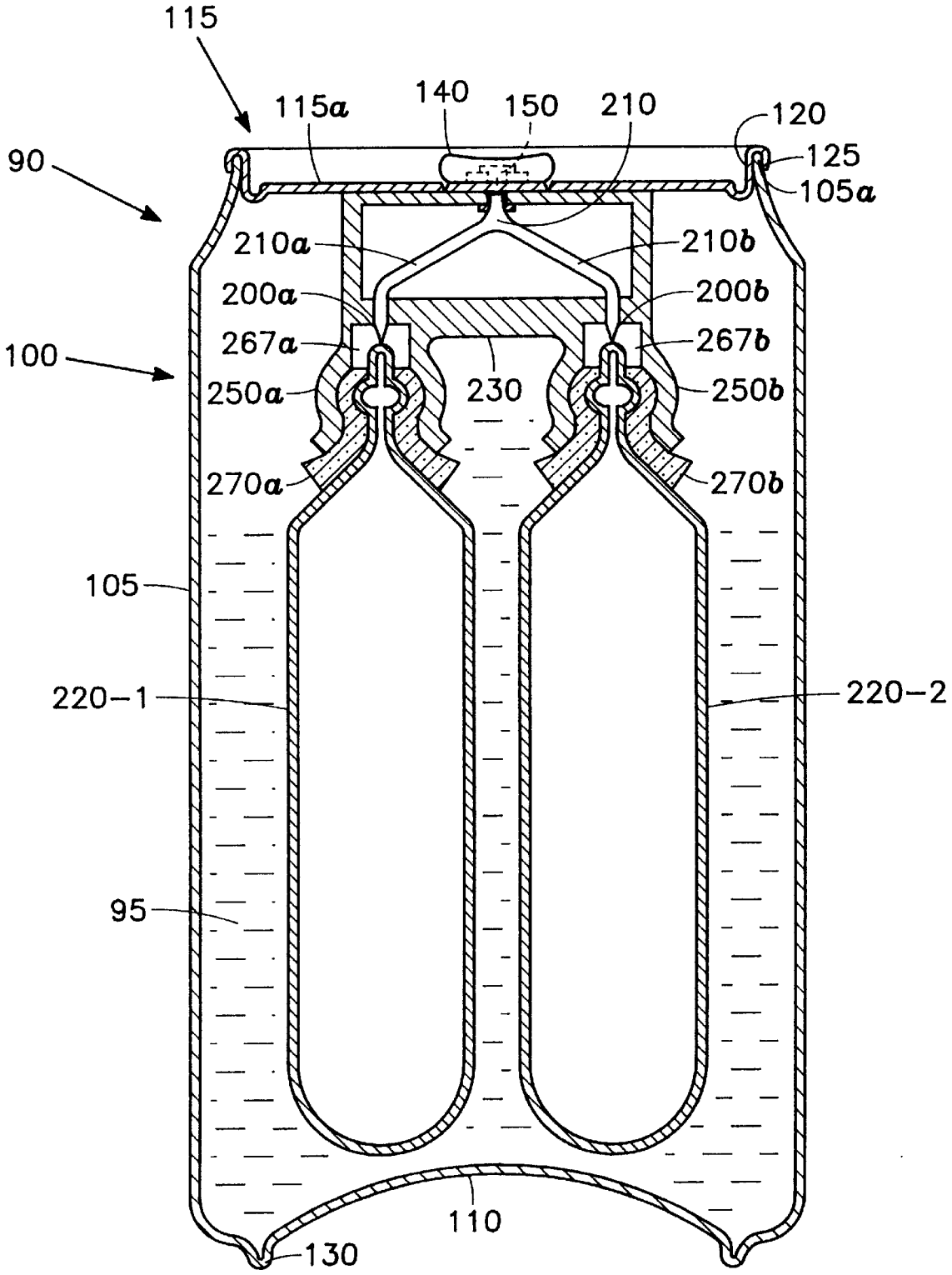
FIG. 21A is a cut-away cross-sectional view of a variation of the embodiment of FIG. 1A employing a pair of coolant gas bottles.

FIG. 21A is a diagram of an embodiment in which a pair of coolant gas bottles 220-1, 220-2 are mounted on a modified version of the support 230 of FIG. 1A.

Figure 21B:
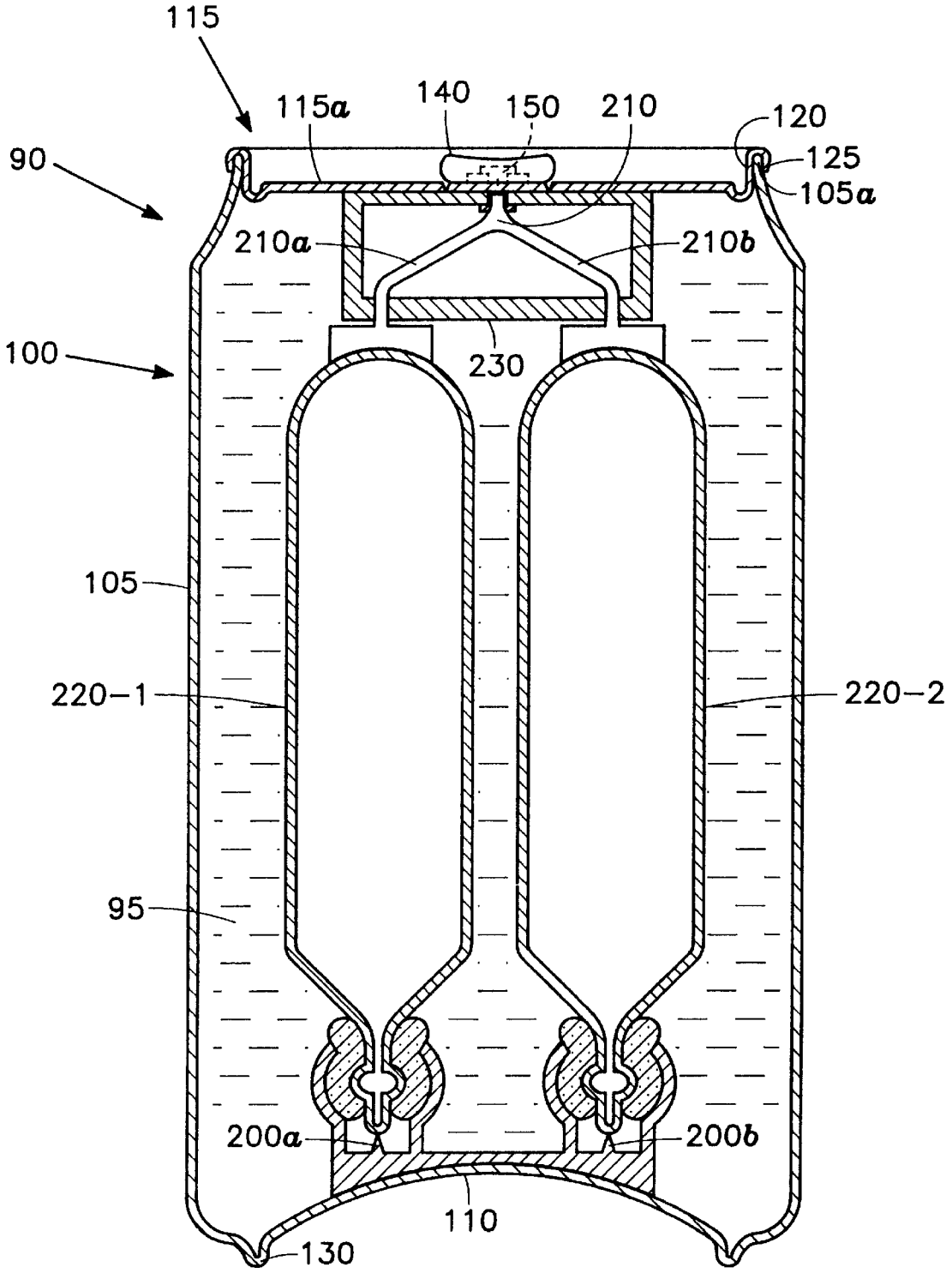
FIG. 21B is a cut-away cross-sectional view of a variation of the embodiment of FIG. 3 employing a pair of coolant gas bottles.

FIG. 21B is a diagram of an embodiment in which a pair of coolant gas bottles 220-1 and 220-2 are mounted upside down as in the embodiment of FIG. 3. In both cases, the plunger 210 branches to a pair of plungers 210*a*, 210*b*, with respective needles 200*a* and 200*b* driven toward the tops of the bottles 220-1, 220-2.

Figure 21C:
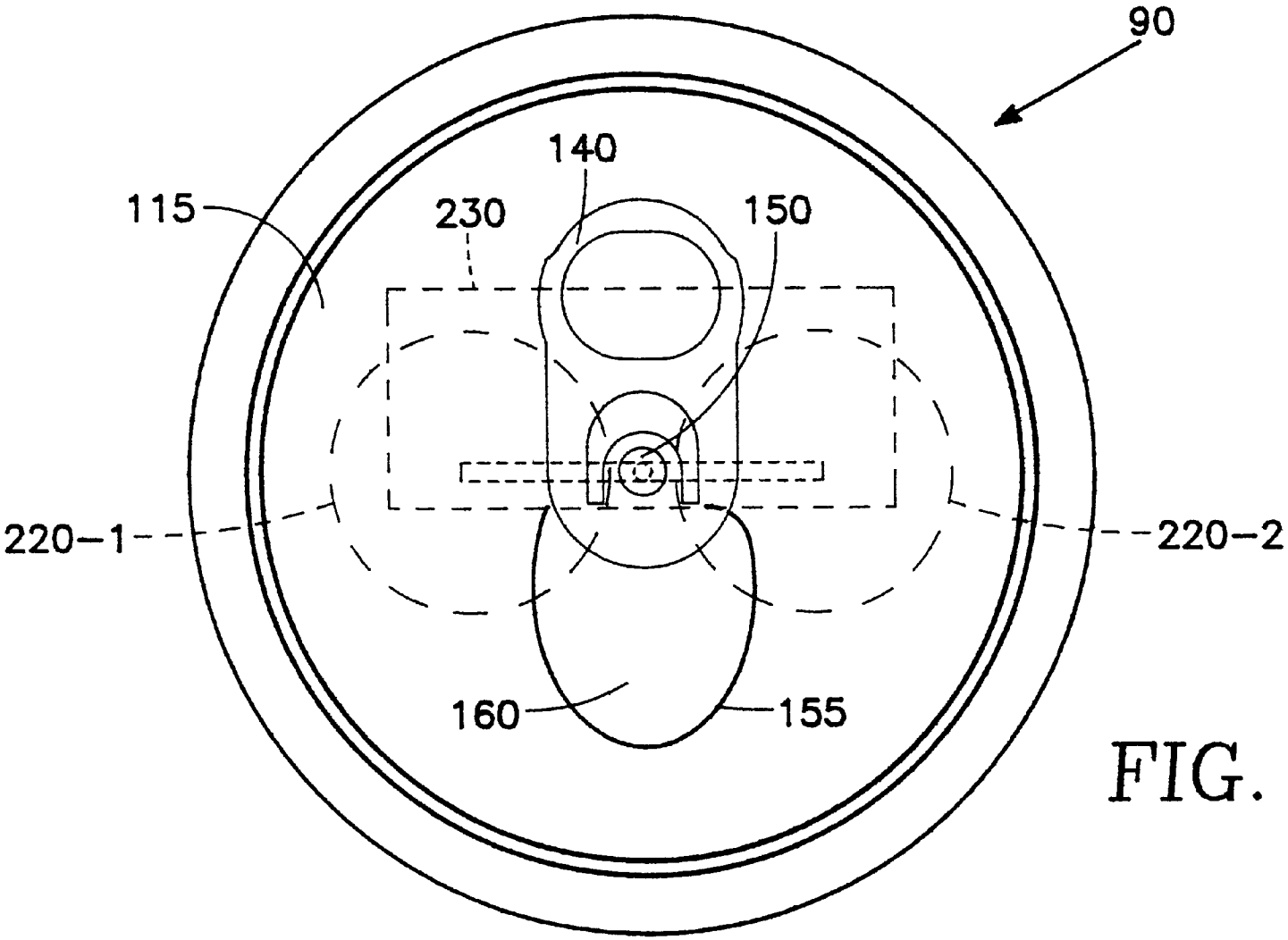
FIG. 21C is a top view of the embodiment of FIG. 21A in the bottle-down configuration.

FIG. 21C illustrates the symmetrical placement of the bottles 220-1 and 220-2 and the rectangular configuration of the bottle support 230.

Figure 21D:
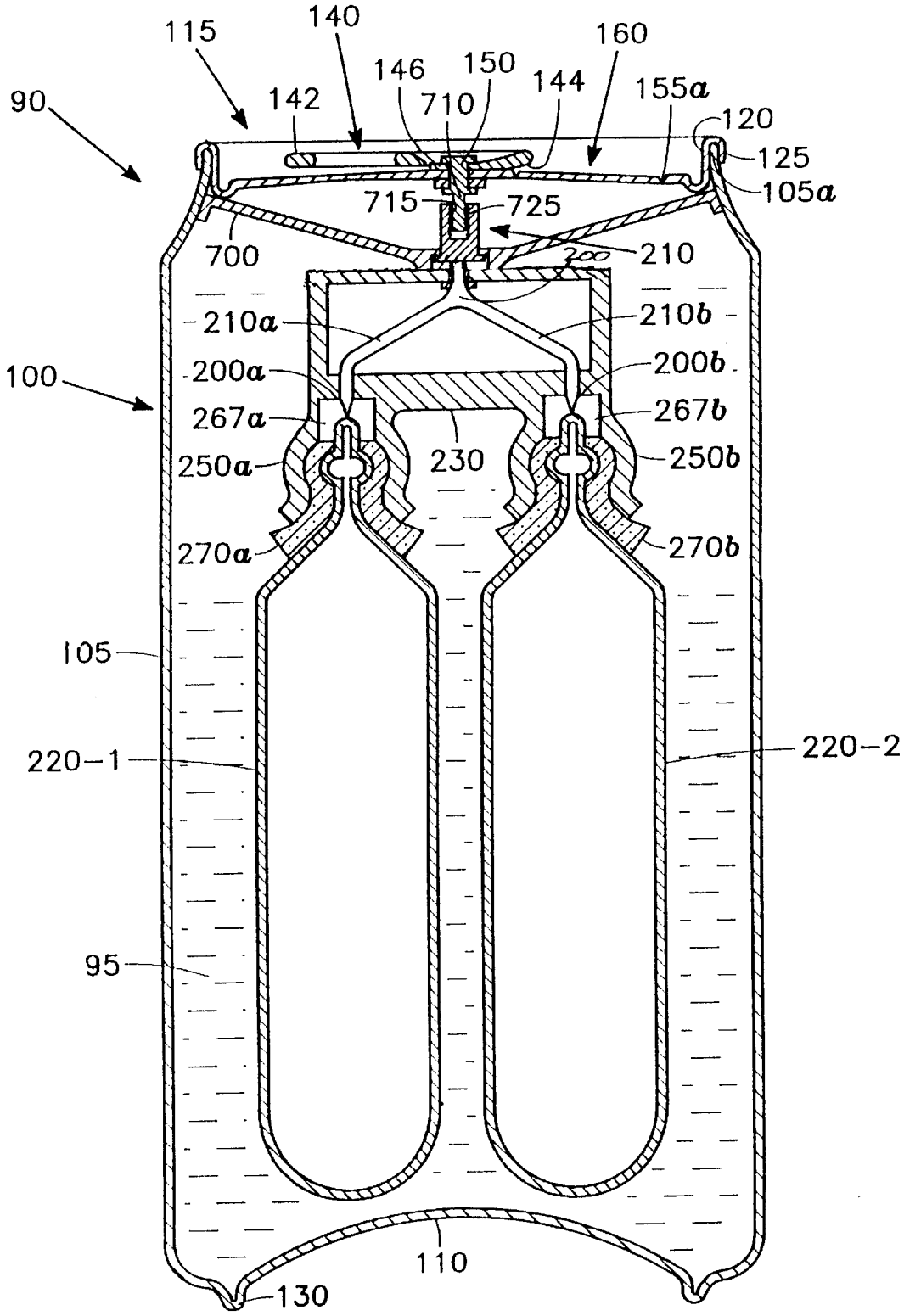
FIG. 21D is a cut-away cross-sectional view of a combination of the embodiments of FIGS. 16A and 21A.

FIG. 21D illustrates how the embodiments of FIGS. 16A and 21A may be combined to add a second bottle to the embodiment of FIG. 16A. In FIG. 21D, the multiple-bottle support 200 of FIG. 21A is fastened to the horizontal struts 700. The plunger 200 branches to a pair of plungers 210*a*, 210*b* driving the needles 200*a*, 200*b*.

While the embodiment of FIGS. 16A–16C has been described with reference to an actuation mechanism employing the pull-tab 140 of FIG. 1A, any one of the other actuation mechanisms described above may be employed instead, such as the screw-actuated, spring actuated or lever-actuated mechanisms of FIGS. 9–12, for example. The embodiment of FIGS. 16A–16C may be combined with any of the other features described above. For example, the embodiments of FIGS. 16C and 21B may be combined so that the embodiment of FIG. 16C may have more than one coolant gas bottle in the manner of FIG. 21B.

While the radial diffusion orifices 310 of FIG. 6A and the axial lands of FIGS. 6B and 6C have been described with reference to a bottle up configuration like that of FIG. 1A, they may also be combined with a bottle-down configuration like that of FIG. 3, for example. While the vortex tube 330 of FIGS. 7A–7C has been described in combination with a bottle-up configuration like that of FIG. 1A, it may also be employed in a bottle-down configuration, like that of FIG. 3, for example. Finally, while the diversionary exhaust gas tube 650 of FIGS. 15A–15C has been described with reference to bottle-up configurations like that of FIG. 1A, it is also useful in a bottle-down configuration like that of FIG. 3, for example.

The structures disclosed herein may be formed of die-cast 0.030" thick aluminum or injection molded plastic or nylon, for example.

While the invention has been described in detail by specific reference to preferred embodiments, it is understood that variations and modifications thereof may be made without departing from the true spirit and scope of the invention.

What is claimed is:

1. A self-cooling beverage container comprising:

a beverage container housing including a side wall portion, a container base and a container top having a breakable die-cut therein and a downwardly displaceable portion near said die-cut;

a pull tab attached to said container top at a fastener connecting said pull tab and said container top, said pull tab having an engagement end which pushes on said downwardly displaceable portion of said container top to break said die-cut whenever an opposite end of said pull-tab is pulled away from said top;

a coolant gas bottle inside said beverage container containing a coolant gas stored under pressure, said bottle having a bottle top with a breakable seal through which said coolant gas is released;

a needle inside said beverage container having a sharp end facing said breakable seal of said bottle;

means separate from said pull-tab fastener for forcing said needle and bottle toward one another for breaking said breakable seal of said bottle whenever said pull-tab opens said beverage container; and a bottle support inside said beverage container and connected to said beverage container, said bottle support holding said coolant gas bottle in a position relative to said needle.

2. The beverage container of claim 1 wherein:

said breakable seal of said coolant gas bottle faces said container top; and a needle facing said breakable seal is at one end of said plunger facing said breakable seal of said bottle whereby said plunger pushes said needle toward said bottle.

3. The beverage container of claim 1 wherein:

said breakable seal of said coolant gas bottle faces said container base, said needle facing said breakable seal is supported from said container base and faces said breakable seal; and said other end of said plunger pushes against said base of said coolant gas bottle whereby said plunger pushes said bottle toward said needle.

4. The beverage container of claim 2 wherein said bottle support comprises:

a ceiling grip by which said bottle support is fastened to said container top and a bottle holder by which said bottle support is fastened to said coolant gas bottle.

5. The beverage container of claim 4 wherein said coolant gas bottle comprises a bottle neck between said bottle top and a main body of said bottle, said bottle holder being fastened to said bottle neck.

6. The beverage container of claim 5 wherein said bottle holder is fastened to said bottle neck by one of: (a) press fitting, (b) threaded fastening.

7. The beverage container of claim 4 wherein said ceiling grip is fastened to said bottle top by said fastener.

8. The beverage container of claim 7 wherein said fastener comprises a rivet coupled to said bottle holder, said rivet penetrating through said container top.

9. The beverage container of claim 4 wherein said bottle holder comprises:

a leg extending from said ceiling grip toward said bottle top, said leg having an elongate passage axially aligned with said breakable seal and containing said plunger; and a skirt extending from said leg around said bottle neck.

10. The beverage container of claim 9 wherein said bottle support further comprises a truss member extending diagonally relative to said leg between said ceiling grip and said skirt.

11. The beverage container of claim 10 wherein said skirt is one of: (a) press fitted, (b) threaded, to said bottle neck.

12. The beverage container of claim 9 wherein said bottle support further comprises lateral supporters extending from said leg to said side wall portion of said beverage container.

13. The beverage container of claim 9 wherein said bottle support further comprises a base support coupled to an interior surface of said container base and to the base of said coolant gas bottle.

14. The beverage container of claim 1 further comprising a micro-porous diffuser through which said coolant gases escape from said breakable seal into a beverage stored in said beverage container.

15. The beverage container of claim 9 further comprising a microporous diffuser layer adjacent said skirt through which said coolant gases escape from said bottle to a beverage stored in said beverage container.

16. The beverage container of claim 15 wherein said diffuser layer is sandwiched between said skirt and said bottleneck.

17. The beverage container of claim 9 further comprising coolant gas passages through said skirt.

18. The beverage container of claim 17 wherein said coolant gas passages comprise radial orifices in said skirt.

19. The beverage container of claim 17 wherein said coolant gas passages comprise axial grooves in said skirt.

20. The beverage container of claim 3 wherein said bottle support comprises:

a base grip fastened to said container base and a bottle holder coupled to said base grip and fastened to said coolant gas bottle near said bottle top; and a ceiling grip fastened to said container top and coupled to said bottle near a bottom portion thereof.

21. The beverage container of claim 20 wherein said coolant gas bottle comprises a bottle neck between said bottle top and a main body of said bottle, said bottle holder being coupled to said bottle neck.

22. The beverage container of claim 1 further comprising means for exhausting at least a portion of the coolant gases from said bottle externally of said beverage container.

23. The beverage container of claim 20 wherein said ceiling grip is fastened to said bottle top by said fastener.

24. The beverage container of claim 23 wherein said fastener comprises a rivet penetrating through said container top.

25. The beverage container of claim 24 wherein said rivet is an integral portion of said ceiling grip.

26. The beverage container of claim 20 wherein said ceiling grip comprises:

a leg extending from said ceiling grip to a bottom portion of said bottle, said leg having an elongate passage containing said plunger, said plunger facing said bottom portion of said bottle.

27. The beverage container of claim 26 wherein said bottle support further comprises a truss member extending diagonally relative to said leg between said ceiling grip and a portion of said leg near said bottle.

28. The beverage container of claim 20 further comprising a skirt extending from said base grip and surrounding said bottle top.

29. The beverage container of claim 28 wherein said bottle neck is axially moveable inside said skirt toward said needle.

30. The beverage container of claim 28 further comprising a microporous diffuser layer adjacent said skirt through which said coolant gases escape from said bottle to a beverage stored in said beverage container.

31. The beverage container of claim 28 further comprising coolant gas passages through said skirt.

32. The beverage container of claim 31 wherein said coolant gas passages comprise radial orifices in said skirt.

33. The beverage container of claim 31 wherein said coolant gas passages comprise axial grooves in said skirt.

34. The beverage container of claim 2 wherein said coolant gas bottle comprises a main bottle portion having a radial extent approximately equal to the radial extent of said beverage container housing.

35. The beverage container of claim 2 wherein a bottom of said coolant gas bottle contacts an interior surface of said container base.

36. The beverage container of claim 1 further comprising:

a vortex tube cooling device inside said beverage container having an inlet, a hot exhaust and a cold exhaust;

means for channeling coolant gas from said bottle to said inlet of said vortex tube cooling device; and means for connecting said hot exhaust through said beverage container housing to an external port.

37. The beverage container of claim 36 further comprising means for coupling said cold exhaust of said vortex tube cooling device to a beverage stored inside said beverage container.

38. The beverage container of claim 37 wherein said means for coupling said cold exhaust comprise a microporous diffuser.

39. The beverage container of claim 36 further comprising means for connecting said cold exhaust through said beverage container housing to an external port.

40. A self-cooling beverage container, comprising:

a beverage container housing including a side wall portion, a container base and container top having a breakable die-cut therein and a downwardly displaceable portion near said die-cut;

a coolant gas bottle inside said beverage container containing a coolant gas stored under pressure, said bottle having a bottle top with a breakable seal through which said coolant gas is released;

a needle inside said beverage container having a sharp end facing said breakable seal of said bottle;

a threaded plunger inside said beverage container having a pair of ends, one end of said plunger coupled to said downwardly displaceable portion of said container top, the other end of said plunger being coupled to one of (a) said coolant gas bottle and (b) said needle whereby to force said needle and bottle toward one another to break said breakable seal of said bottle whenever said pull-tab opens said beverage container;

a bottle support inside said beverage container and connected to said beverage container, said bottle support holding said coolant gas bottle in a position relative to said needle and having a female portion threadably engaged with said plunger and holding said plunger in a position relative to said bottle; and means for axially rotating said plunger relative to said female portion so as drive said plunger.

41. The beverage container of claim 40 wherein:

said breakable seal of said coolant gas bottle faces said container top; and said needle facing said breakable seal is at one end of said plunger facing said breakable seal of said bottle whereby said plunger pushes said needle toward said bottle.

42. The beverage container of claim 40 wherein:

said breakable seal of said coolant gas bottle faces said container base, said needle facing said breakable seal is supported from said container base and faces said breakable seal; and said other end of said plunger pushes against said base of said coolant gas bottle whereby said plunger pushes said bottle toward said needle.

43. The beverage container of claim 41 wherein said bottle support comprises:

a ceiling grip by which said bottle support is fastened to said container top and a bottle holder by which said bottle support is fastened to said coolant gas bottle.

44. The beverage container of claim 43 wherein said coolant gas bottle comprises a bottle neck between said bottle top and a main body of said bottle, said bottle holder being fastened to said bottle neck.

45. The beverage container of claim 44 wherein said bottle holder is fastened to said bottle neck by one of: (a) press fitting, (b) threaded fastening.

46. The beverage container of claim 43 wherein said bottle holder comprises:

a leg extending from said ceiling grip toward said bottle top, said leg having an elongate passage axially aligned with said breakable seal and containing said plunger; and a skirt extending from said leg around said bottle neck.

47. The beverage container of claim 46 wherein said bottle support further comprises a truss member extending diagonally relative to said leg between said ceiling grip and said skirt.

48. The beverage container of claim 46 wherein said skirt is one of: (a) press fitted, (b) threaded, to said bottle neck.

49. The beverage container of claim 46 wherein said bottle support further comprises lateral supporters extending from said leg to said side wall portion of said beverage container.

50. The beverage container of claim 46 wherein said bottle support further comprises a base support coupled to an interior surface of said container base and to the base of said coolant gas bottle.

51. The beverage container of claim 40 further comprising a micro-porous diffuser through which said coolant gases escape from said breakable seal into a beverage stored in said beverage container.

52. The beverage container of claim 46 further comprising a microporous diffuser layer adjacent said skirt through which said coolant gases escape from said bottle to a beverage stored in said beverage container.

53. The beverage container of claim 46 further comprising coolant gas passages through said skirt.

54. The beverage container of claim 53 wherein said coolant gas passages comprise radial orifices in said skirt.

55. The beverage container of claim 53 wherein said coolant gas passages comprise axial grooves in said skirt.

56. The beverage container of claim 42 wherein said bottle support comprises:

a base grip fastened to said container base and a bottle holder coupled to said base grip and fastened to said coolant gas bottle near said bottle top; and a ceiling grip fastened to said container top and coupled to said bottle near a bottom portion thereof.

57. The beverage container of claim 56 wherein said coolant gas bottle comprises a bottle neck between said bottle top and a main body of said bottle, said bottle holder being coupled to said bottle neck.

58. The beverage container of claim 56 wherein said ceiling grip comprises:

a leg extending from said ceiling grip to a bottom portion of said bottle, said leg having an elongate threaded passage threadably engaged with said plunger, said plunger facing said bottom portion of said bottle.

59. The beverage container of claim 58 wherein said bottle support further comprises a truss member extending diagonally relative to said leg between said ceiling grip and a portion of said leg near said bottle.

60. The beverage container of claim 56 further comprising a skirt extending from said base grip and surrounding said bottle top.

61. The beverage container of claim 60 wherein said bottle neck is axially moveable inside said skirt toward said needle.

62. The beverage container of claim 60 further comprising a microporous diffuser layer adjacent said skirt through which said coolant gases escape from said bottle to a beverage stored in said beverage container.

63. The beverage container of claim 60 further comprising coolant gas passages through said skirt.

64. The beverage container of claim 63 wherein said coolant gas passages comprise radial orifices in said skirt.

65. The beverage container of claim 63 wherein said coolant gas passages comprise axial grooves in said skirt.

66. The beverage container of claim 41 wherein said coolant gas bottle comprises a main bottle portion having a radial extent approximately equal to the radial extent of said beverage container housing.

67. The beverage container of claim 41 wherein a bottom of said coolant gas bottle contacts an interior surface of said container base.

68. The beverage container of claim 40 further comprising:

a vortex tube cooling device inside said beverage container having an inlet, a hot exhaust and a cold exhaust;

means for channeling coolant gas from said bottle to said inlet of said vortex tube cooling device; and means for connecting said hot exhaust through said beverage container housing to an external port.

69. The beverage container of claim 68 further comprising means for coupling said cold exhaust of said vortex tube cooling device to a beverage stored inside said beverage container.

70. The beverage container of claim 69 wherein said means for coupling said cold exhaust comprise a microporous diffuser.

71. The beverage container of claim 68 further comprising means for connecting said cold exhaust through said beverage container housing to an external port.

72. The beverage container of claim 40 wherein said means for rotating said plunger comprise an external tab on said container top and connected through said container top to said plunger for directly rotating said plunger.

73. The beverage container of claim 40 wherein said means for rotating said plunger comprise:

a spring having a stationary end and an opposite end connected to said plunger;

a key engaged with said plunger for preventing rotation of said plunger; and an external member on said beverage container lined with said key for disengaging said key from said plunger.

74. The beverage container of claim 73 wherein said external member comprises an external rotatable tab having a shaft penetrating said container top and linked to said key.

75. The beverage container of claim 74 further comprising a slot in said plunger, said key being engaged upon insertion in said slot and said key being withdrawn from said slot upon rotation of said tab.

76. The beverage container of claim 75 wherein said key has a portion wound around said shaft.

77. The beverage container of claim 73 wherein said external member comprises an external lever and linkage connected thereto and passing through said container top and coupled to said key for disengaging said key upon movement of said lever.

78. The beverage container of claim 73 wherein said spring is a rotationally wound coil spring.

79. A self-cooling beverage container, comprising:

a beverage container housing including a side wall portion, a container base and a container top;

a storage gas held inside said beverage container under a pressure sufficient to elastically deform said container top outwardly in a direction away from the interior of said beverage container, whereby said container top elastically relaxes upon release of the pressure of said storage gas so that said container top moves inwardly toward the interior of said beverage container upon the release of said storage gas pressure;

a coolant gas bottle inside said beverage container containing a coolant gas stored under pressure, said bottle having a bottle top with a breakable seal through which said coolant gas is released;

a needle inside said beverage container having a sharp end facing said breakable seal of said bottle;

a plunger inside said beverage container having a pair of ends, one end of said plunger coupled to said container top, the other end of said plunger being coupled to one of (a) said coolant gas bottle and (b) said needle whereby to force said needle and bottle toward one another to break said breakable seal of said bottle whenever said pull-tab opens said beverage container;

a bottle support inside said beverage container and connected to said beverage container, said bottle support holding said coolant gas bottle in a position relative to said needle and holding said plunger in a position relative to said bottle; and means for opening said beverage container so that elastic relaxation of said container top pushes said plunger to drive said needle into said breakable seal of said coolant gas bottle.

80. The beverage container of claim 79 wherein said bottle support is coupled to said side wall portion so as to leave said container top free to deform.

81. The beverage container of claim 79 wherein said container top is circular in shape and comprises an elastic annulus which enhances the deformation of said container top.

82. The beverage container of claim 81 wherein said elastic annulus comprises plural concentric ridges, alternate ones of said ridges facing toward the beverage container interior and remaining ones facing away from said beverage container interior.

83. The beverage container of claim 82, wherein said plural concentric ridges comprise:

an outer ridge in said container top facing toward the beverage container interior;

an intermediate ridge in said container top facing away from said beverage container interior; and an inner ridge in said container top facing toward said beverage container interior.

84. The beverage container of claim 79 wherein said means for opening said beverage container comprise:

a breakable die-cut in said container top and a downwardly displaceable portion of said container top near said die-cut; and a pull tab attached to said container top at a fastener connecting said pull tab and said container top, said pull tab having an engagement end which pushes on said downwardly displaceable portion of said container top to break said die-cut whenever an opposite end of said pull-tab is pulled away from said top.

85. The beverage container of claim 79 wherein:

said breakable seal of said coolant gas bottle faces said container top; and said needle facing said breakable seal is at one end of said plunger facing said breakable seal of said bottle whereby said plunger pushes said needle toward said bottle.

86. The beverage container of claim 79 wherein:

said breakable seal of said coolant gas bottle faces said container base, said needle facing said breakable seal is supported from said container base and faces said breakable seal; and said other end of said plunger pushes against said base of said coolant gas bottle whereby said plunger pushes said bottle toward said needle.

87. The beverage container of claim 85 wherein said bottle support comprises:

a side wall grip by which said bottle support is fastened to said side wall portion of said container housing and a bottle holder by which said bottle support is fastened to said coolant gas bottle.

88. The beverage container of claim 87 wherein said coolant gas bottle comprises a bottle neck between said bottle top and a main body of said bottle, said bottle holder being fastened to said bottle neck.

89. The beverage container of claim 88 wherein said bottle holder is fastened to said bottle neck by one of: (a) press fitting, (b) threaded fastening.

90. The beverage container of claim 87 wherein said bottle holder comprises:

a leg extending from said side wall grip toward said bottle top, said leg having an elongate passage axially aligned with said breakable seal and containing said plunger; and a skirt extending from said leg around said bottle neck.

91. The beverage container of claim 90 wherein said bottle support further comprises a truss member extending diagonally relative to said leg between said side wall portion of said beverage container housing and said skirt.

92. The beverage container of claim 90 wherein:

said elongate passage containing said plunger has ratcheting teeth facing said plunger;

said plunger has ratcheting teeth engaging the ratcheting teeth of said elongate passage, whereby said plunger is movable in a direction toward the beverage container interior and is locked from movement in the opposite direction.

93. The beverage container of claim 92 wherein:

the ratcheting teeth of said elongate passage each comprises an annular ridge extending radially outward toward said plunger, said annular ridge being interrupted by at least an axial circumferential groove extending longitudinally along said elongate passage;

the ratcheting teeth of said plunger each comprises an annular ridge extending radially outward toward an interior surface of said elongate passage and having at least an axial circumferential groove extending longitudinally along said plunger, the ratcheting teeth of said elongate passage and of said plunger nesting in the groove of the other so as to disengage in one rotational position of said plunger.

94. The beverage container of claim 91 wherein said skirt is one of: (a) press fitted, (b) threaded, to said bottle neck.

95. The beverage container of claim 87 wherein said bottle support further comprises a base support coupled to an interior surface of said container base and to the base of said coolant gas bottle.

96. The beverage container of claim 79 further comprising a micro-porous diffuser through which said coolant gases escape from said breakable seal into a beverage stored in said beverage container.

97. The beverage container of claim 90 further comprising a microporous diffuser layer adjacent said skirt through which said coolant gases escape from said bottle to a beverage stored in said beverage container.

98. The beverage container of claim 97 wherein said diffuser layer is sandwiched between said skirt and said bottleneck.

99. The beverage container of claim 90 further comprising coolant gas passages through said skirt.

100. The beverage container of claim 99 wherein said coolant gas passages comprise radial orifices in said skirt.

101. The container of claim 99 wherein said coolant gas passages comprise axial grooves in said skirt.

102. The beverage container of claim 86 wherein said bottle support comprises:

a base grip fastened to said container base and a bottle holder coupled to said base grip and fastened to said coolant gas bottle near said bottle top; and a bottle bottom grip fastened to said beverage container and coupled to said bottle near a bottom portion of the bottle.

103. The beverage container of claim 102 wherein said coolant gas bottle comprises a bottle neck between said bottle top and a main body of said bottle, said bottle holder being coupled to said bottle neck.

104. The beverage container of claim 103 wherein said side wall grip comprises:

a leg extending in a direction away from said container top toward said bottle, said leg having an elongate passage containing said plunger, said plunger facing said bottle.

105. The beverage container of claim 104 wherein said bottle support further comprises a truss member extending diagonally relative to said leg and coupled to said side wall portion of said beverage container.

106. The beverage container of claim 102 further comprising a skirt extending from said base grip and surrounding said bottle top.

107. The beverage container of claim 106 wherein said bottle neck is axially moveable inside said skirt toward said needle.

108. The beverage container of claim 106 further comprising a microporous diffuser layer adjacent said skirt through which said coolant gases escape from said bottle to a beverage stored in said beverage container.

109. The beverage container of claim 106 further comprising coolant gas passages through said skirt.

110. The beverage container of claim 109 wherein said coolant gas passages comprise radial orifices in said skirt.

111. The beverage container of claim 109 wherein said coolant gas passages comprise axial grooves in said skirt.

112. The beverage container of claim 79 further comprising:

a vortex tube cooling device inside said beverage container having an inlet, a hot exhaust and a cold exhaust;

means for channeling coolant gas from said bottle to said inlet of said vortex tube cooling device; and means for connecting said hot exhaust through said beverage container housing to an external port.

113. The beverage container of claim 112 further comprising means for coupling said cold exhaust of said vortex tube cooling device to a beverage stored inside said beverage container.

114. The beverage container of claim 113 wherein said means for coupling said cold exhaust comprise a microporous diffuser.

115. The beverage container of claim 112 further comprising means for connecting said cold exhaust through said beverage container housing to an external port.

116. The beverage container of claim 79 further comprising:

a second coolant gas bottle held by said bottle support, said second coolant gas bottle containing a coolant gas stored under pressure, said bottle having a bottle top with a breakable seal through which said coolant gas is released;

a second needle inside said beverage container having a sharp end facing said breakable seal of said second bottle, whereby to break said seal of said second bottle upon movement of said plunger.

117. The beverage container of claim 7 wherein said rivet is an integral portion of said bottle top.

118. The beverage container of claim 79 wherein said container has a floor on an end opposite said container top, and said bottle support comprises means for bracing a portion of said bottle against said floor.

119. The beverage container of claim 79 wherein said bottle top faces said container top and said plunger is coupled to said needle.

120. The beverage container of claim 79 wherein said bottle top faces away from said container top and said plunger is coupled to said bottle.

121. A self-cooling beverage container comprising:

a beverage container housing including a side wall portion, a container base and a container top having a breakable die-cut therein and a downwardly displaceable portion near said die-cut;

a pull tab attached to said container top at a fastener connecting said pull tab and said container top, said pull tab having an engagement end which pushes on said downwardly displaceable portion of said container top to break said die-cut whenever an opposite end of said pull-tab is pulled away from said top;

a coolant gas bottle inside said beverage container containing a coolant gas stored under pressure, said bottle having a bottle top with a breakable seal through which said coolant gas is released, said breakable seal of said coolant gas bottle facing said container top;

a needle inside said beverage container having a sharp end facing said breakable seal of said bottle;

a plunger inside said beverage container having a pair of ends, one end of said plunger coupled to said downwardly displaceable portion of said container top, the other end of said plunger being coupled to one of (a) said coolant gas bottle and (b) said needle whereby to force said needle and bottle toward one another to break said breakable seal of said bottle whenever said pull-tab opens said beverage container;

a bottle support inside said beverage container and connected to said beverage container, said bottle support comprising a ceiling grip by which said bottle support is fastened to said container top and a bottle holder by which said bottle support is fastened to said coolant gas bottle, said bottle support holding said coolant gas bottle in a position relative to said needle and holding said plunger in a position relative to said bottle, said bottle holder including a leg extending from said ceiling grip toward said bottle top, said leg having an elongate passage axially aligned with said breakable seal and containing said plunger; and a skirt extending from said leg around said bottle neck.

122. The beverage container of claim 121 wherein said bottle support further comprises a truss member extending diagonally relative to said leg between said ceiling grip and said skirt.

123. The beverage container of claim 122 wherein said skirt is one of: (a) press fitted, (b) threaded, to said bottle neck.

124. The beverage container of claim 121 further comprising a microporous diffuser layer adjacent said skirt through which said coolant gases escape from said bottle to a beverage stored in said beverage container.

125. The beverage container of claim 124 wherein said diffuser layer is sandwiched between said skirt and said bottle neck.

126. A self-cooling beverage container comprising:

walls, base and top forming and closing said self-cooling beverage container, said beverage container being configured so that a deflectable portion of said beverage container has an undeflected position and deflects with respect to the remainder of said beverage container when said beverage container is pressurized and returns toward its undeflected position when said beverage container is depressurized;

means for depressurizing said beverage container and permitting discharge of beverage therefrom;

a coolant gas vessel containing coolant gas stored under pressure which cools said coolant gas vessel when coolant gas is released therefrom, means for releasing coolant gas from said vessel, said means for releasing coolant gas from said coolant gas vessel being coupled to said deflectable portion of said beverage container so that return of said deflectable portion of said beverage container toward said undeflected position, when said beverage container is depressurized, causes release of coolant gas from said coolant gas vessel, said coolant gas vessel being thermally connected to said beverage container to cool beverage in said beverage container when said beverage container is depressurized.

127. The self-cooling beverage container of claim 126 wherein said coolant gas bottle is positioned within said beverage container.

128. The self-cooling beverage container of claim 126 wherein said means for releasing coolant from said coolant gas vessel comprises a breakable seal on said coolant gas vessel and a member positioned to break said breakable seal when said deflectable portion of said beverage container returns toward its undeflected position.

129. The beverage container of claim 128 wherein said breakable seal on said coolant gas vessel is a puncturable seal and a needle is positioned adjacent thereto, said needle being connected to be actuated by return of said deflectable portion of said beverage container.

* * * * *